US006353726B1

(12) United States Patent
Murata et al.

(10) Patent No.: US 6,353,726 B1
(45) Date of Patent: Mar. 5, 2002

(54) SHEET PROCESSING APPARATUS WITH CONTROL OF SHEET CONVEYANCE BASED ON SKEW AMOUNT, CONTROL METHOD, IMAGE FORMING APPARATUS, AND STORAGE MEDIUM

(75) Inventors: Mitsushige Murata, Abiko; Norifumi Miyake, Kashiwa; Kiyoshi Okamoto, Toride, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/610,375

(22) Filed: Jul. 5, 2000

(30) Foreign Application Priority Data

Jul. 21, 1999 (JP) ..... 11-206074

(51) Int. Cl.[7] ..... G03G 15/00
(52) U.S. Cl. ..... 399/407; 399/18; 399/395
(58) Field of Search ..... 271/37, 58.08, 271/188, 298; 399/16, 18, 394, 395, 396, 407, 408, 410

(56) References Cited

U.S. PATENT DOCUMENTS

| | | | | |
|---|---|---|---|---|
| 5,299,795 A | | 4/1994 | Miyake | 271/9 |
| 5,455,667 A | | 10/1995 | Hiroi et al. | |
| 5,580,039 A | | 12/1996 | Takehara et al. | 270/58.11 |
| 5,758,251 A | * | 5/1998 | Takahashi et al. | 399/395 Q |
| 5,761,600 A | | 6/1998 | Murata | |
| 5,822,672 A | * | 10/1998 | Johdai et al. | 399/368 |

* cited by examiner

*Primary Examiner*—Sophia S. Chen
*Assistant Examiner*—Hoang Ngo
(74) *Attorney, Agent, or Firm*—Fitzpatrick, Cella, Harper & Scinto

(57) ABSTRACT

Conveyance of a sheet is controlled based on a detected skew amount of a conveyed sheet and a result of determination on whether an operation mode set through an operation console is a punching mode or not, thus protecting a user from spending extra time and efforts and extra cost in the event that a sheet skews.

20 Claims, 32 Drawing Sheets

FIG. 7A

POST PROCESSING MENU

SELECT TYPE OF POST PROCESSING

CANCEL

SORTING

GROUPING

STAPLING & SORTING

Z-FOLDING

PUNCHING

BINDING

OK

FIG. 7B

COVER SHEET MENU

SPECIFY COVER SHEET MODE

CANCEL

INSERTER

MANUAL

OK

SKEW_CN : COUNTER FOR DETECTING SKEW
skew_detectf_g : UNDER-SKEW-DETECTION FLAG
SKEW_REF1 : SKEW REFERENCE VALUE 1
SKEW_REF2 : SKEW REFERENCE VALUE 2

SHEET PROCESSING APPARATUS WITH CONTROL OF SHEET CONVEYANCE BASED ON SKEW AMOUNT, CONTROL METHOD, IMAGE FORMING APPARATUS, AND STORAGE MEDIUM

BACKGROUND OF THE INVENTION

1. Field of the Invention

The present invention relates to a sheet processing apparatus and an image forming apparatus incorporating a sheet processing apparatus.

2. Description of the Related Art

There has conventionally been a copying apparatus equipped with modes, such as a cover sheet mode and an identification sheet mode, in which a type of sheet (hereinafter referred to as a "special sheet") different from a regular recording sheet can be inserted as a first or last page or inserted anywhere among the pages. A user sets these modes through a control panel of the copying apparatus to enable, for example, a sheet of a different color to be inserted as a cover sheet or as a separating sheet.

As a method for supplying a special sheet, there has been proposed the method in which a special cassette provided in a main unit of a copying apparatus supplies the special sheet, or a method in which a sheet feeder for supplying a special sheet is provided in a sheet processing device, such as a finisher, so as to supply the special sheet from the sheet feeder. There has been also proposed to provide the capability of stapling or punching special sheets conveyed from the sheet feeder.

However, no satisfactory corrective measures have been taken for skewing of special sheets conveyed from a sheet feeder or a special cassette or the like. Hence, if a special sheet is conveyed in a skewed state from the sheet feeder or the special cassette or the like mentioned above, then a paper jam may occur during conveyance and, even without a paper jam, an inconvenience, such as a failure of punching or the like at a desired position of a sheet may occur. This causes a user a problem in which the user has to prepare another sheet of the same type, involving extra efforts and labor for the user, in addition to increased cost.

SUMMARY OF THE INVENTION

Accordingly, the present invention has been made with a view toward overcoming the shortcomings described above, and it is an object thereof to provide a sheet processing apparatus and control method, an image forming apparatus, and a storage medium.

To this end, according to the present invention, there is provided a sheet processing apparatus and control method, an image forming apparatus, and a storage medium that are able to prevent causing a user extra time and efforts and extra cost even if a sheet skews.

In accordance with these objects, there is provided a sheet processing apparatus comprising a first stacking tray connectable to an image forming apparatus and on which sheets are stacked, conveying means for conveying a sheet loaded on the first stacking tray and a sheet on which an image has been formed by the image forming apparatus, and a second stacking tray for stacking the sheets conveyed from the first stacking tray and the sheet on which an image has been formed by the image forming apparatus. Sheet processing is performed on the sheet conveyed by the conveying means from the first stacking tray, according to an operation mode of the image forming apparatus, the sheet processing apparatus comprising, detecting means for detecting a skew amount of a sheet conveyed from the first stacking tray, determining means for determining whether to perform sheet processing by the sheet processing apparatus, and control means for controlling conveyance of the sheet by the conveying means based on a skew amount of the sheet detected by the detecting means and a determination result of the determining means.

In accordance with another aspect of the present invention, there is provided a sheet processing apparatus for implementing sheet processing on a sheet, comprising, conveying means for conveying a sheet for processing, and control means for inhibiting operation of the conveying means based on a skew amount of the sheet conveyed by the conveying means. The control means permits the operation of the conveying means if the skew amount of the sheet conveyed by the conveying means is a skew amount lower than an amount that will cause sheet conveyance failure, and the control means inhibits the operation of the conveying means if the sheet is a sheet for a job involving sheet processing, and permits the operation of the conveying means if the sheet is a sheet for a job in which sheet processing is not performed when the skew amount of the sheet conveyed by the conveying means is the skew amount lower than the amount that will cause sheet conveyance failure.

In accordance with yet other aspects of the present invention, there are provided methods for carrying out the above sheet processing, as well as computer readable storage medium for storing programs for controlling the above apparatus.

Further objects, features and advantages of the present invention will be better understood from the following description taken in connection with the accompanying drawings.

BRIEF DESCRIPTION OF THE DRAWINGS

FIG. 7 provides diagrams showing display panels of an operation unit.

DESCRIPTION OF THE PREFERRED EMBODIMENT

Figure 1:
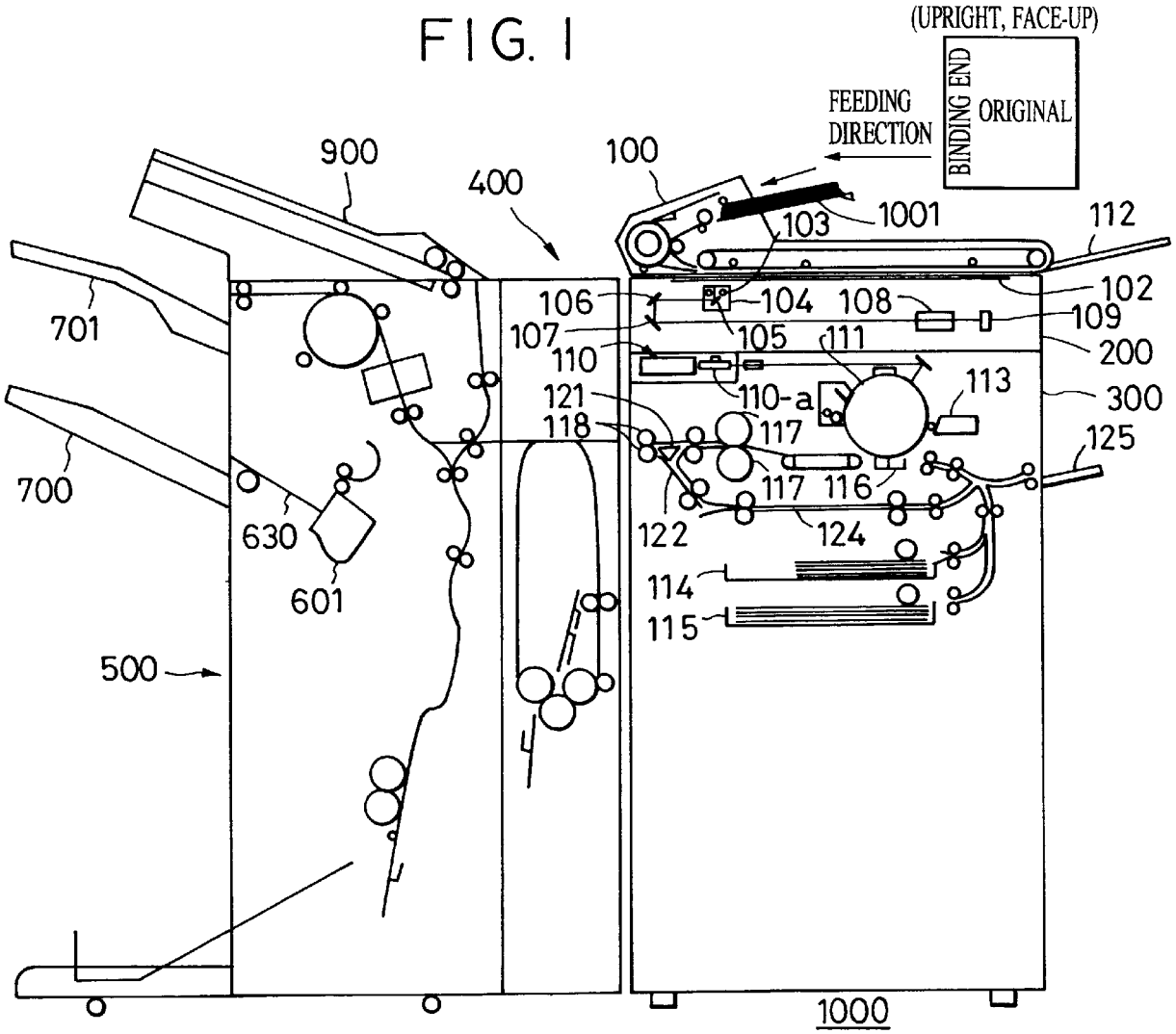
FIG. 1 is a sectional view showing an example of a copying apparatus.

FIG. 1 is a sectional view showing the internal construction of a copying apparatus 1000 which is an embodiment in accordance with the present invention. The copying apparatus 1000 has an original feeder 100, an image reader 200, a printer 300, a folder 400, a finisher 500, and an inserter 900.

Referring to FIG. 1, it is assumed that an original is set on a tray 1001 of the original feeder 100 so that the original is upright with its image side face up (a surface on which an image has been formed faces upward), and a binding end of the original is on a left edge of the original, as observed from a user. The originals placed on the tray 1001 are conveyed in sequence one by one to the left (in the direction of the arrow) by the original feeder 100, beginning with a first page. In other words, the originals are conveyed, with the binding ends being leading edges. The originals are further conveyed through a curved path from left to right on a platen glass 102, then discharged onto a discharged-sheet tray 112. At this time, a scanner unit 104 is retained in a predetermined position, and the originals are read as they pass from left to right on the scanner unit 104. The reading method mentioned above is referred to as "a moving-original reading mode." In this mode, as an original passes across the platen glass 102, the original is subjected to light of a lamp 103 of the scanner unit 104, and light reflected from the original is guided to an image sensor 109 via mirrors 105, 106, and 107, and a lens 108.

Alternatively, an original that has been conveyed by the original feeder 100 is temporarily stopped on the platen glass 102, and the scanner unit 104 is moved from left to right to read the stationary original. This reading method is referred to as "a stationary-original reading mode." If the originals are read without using the original feeder 100, then the user lifts the original feeder 100, and places an original on the platen glass 102. In this case, the foregoing stationary-original reading mode is implemented.

Image data of an original read by the image sensor 109 is subjected to predetermined image processing before it is sent to an exposure control unit 110. The exposure control unit 110 outputs a laser beam based on an image signal. The laser beam is applied onto a photoconductive drum 111 while being scanned by a polygon mirror 110*a*. An electrostatic latent image based on the scanned laser beam is formed on the photoconductive drum 111.

The electrostatic latent image formed on the photoconductive drum 111 is developed by a developing device 113 into a visible toner image. Meanwhile, a recording sheet is conveyed to a transferring unit 116 from a cassette 114 or 115, a manual sheet feeder 125, or a two-side copy conveying path 124. Then, the visualized toner image is transferred onto the recording sheet in the transferring unit 116. After the transferring step, the recording sheet is subjected to a fixing process implemented by a fixing unit 117.

The recording sheet that has passed through the fixing unit 117 is guided temporarily to a path 122 by a flapper 121. As soon as a trailing edge of the recording sheet leaves the flapper 121, the recording sheet is switched back to be conveyed to discharging rollers 118 by the flapper 121. Then, the discharging rollers 118 discharge the recording sheet from the printer 300. In this way, the recording sheet can be discharged from the printer 300 with its image surface, on which the toner image has been formed, facing downward (face-down). This is referred to as "switchback discharge."

Thus, the recording sheets are discharged from the printer with their faces down. When image forming is performed from a first page, printed pages can be loaded on a proper order when, for example, an image forming process is implemented using the original feeder 100 or the image forming process is implemented on image data received from a computer.

When the images are formed on hard sheets, such as OHP sheets, conveyed from the manual sheet feeder 125, the sheets are discharged from the printer 300 by the discharging roller 118 with their surfaces, on which toner images have been formed, facing upward (face-up), without being guided to the path 122.

When images are formed on both sides of a sheet, the sheet is directly led toward the discharge rollers 118 from the fixing unit 117, then switched back immediately after a trailing edge of the sheet leaves the flapper 121 and led to a two-side copy conveying path by the flapper 121.

Referring now to FIG. 2, image forming methods in the stationary-original reading mode and the moving-original reading mode will be described.

Figure 2A:
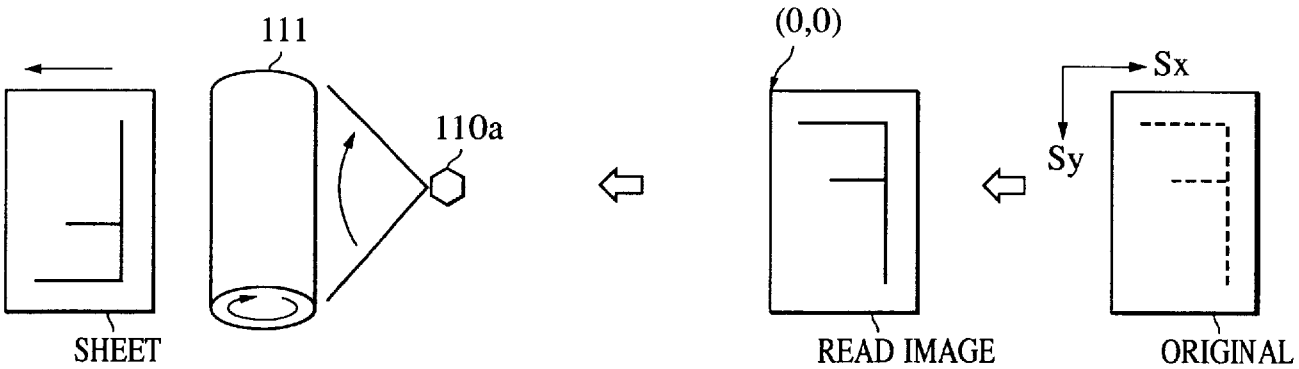
FIG. 2 is a diagram for explaining image forming methods for a stationary-original reading mode and a moving-original reading mode.

In the case of the stationary-original reading mode, an image on an original is scanned by the scanner unit 104 moved from left to right for scanning. More specifically, as shown in FIG. 2A, an image on the original is read by the image sensor 109 by scanning wherein a main scanning direction is denoted as Sy and a secondary scanning direction is denoted as Sx. Regarding the image that has been read by the image sensor 109, an image read in the main scanning direction Sy is converted into a laser beam in succession by the exposure control unit 110, and the laser beam is scanned by the polygon mirror 110*a* in a direction of an arrow in the drawing thereby to form an electrostatic latent image on the photoconductive drum 111.

When the electrostatic latent image thus formed is visualized in the form of a toner image and the toner image is formed on a sheet, an orthoscopic image, i.e. a non-mirror image, is formed on the sheet.

Figure 2B:
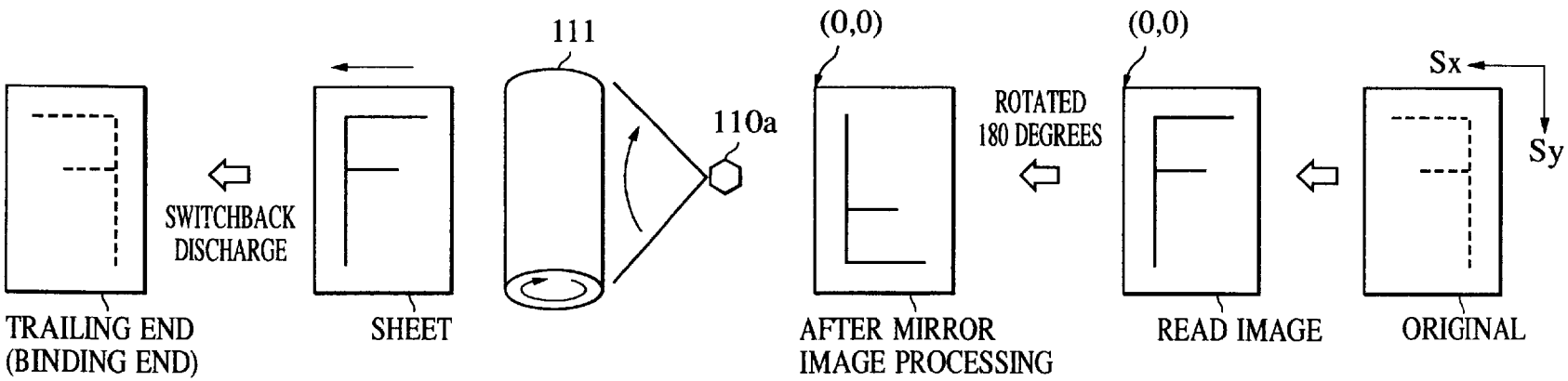

In the case of the moving-original reading mode, an image of an original is read by the image sensor 109 by scanning in which the main scanning direction is denoted as Sy and the secondary scanning direction is denoted as Sx as shown in FIG. 2B. In the moving-original reading mode, the original is conveyed from left to right, and therefore, the direction of the secondary scanning is opposite from that in the stationary-original reading mode. Hence, an image read by the image sensor 109 turns into a mirror image in relation to the original image, and the mirror image must be corrected into an orthoscopic image. For this purpose, in the moving-original reading mode, mirror image processing is performed to turn the image read by the image sensor 109 into an orthoscopic image. In the mirror image processing, to switch the main scanning direction to the opposite direction, an image read in one direction of the main scanning directions is inverted into an opposite direction in relation to the one direction of the main scanning directions.

More specifically, the mirror image processing in this embodiment is carried out to rotate a read image by 180 degrees before outputting the image as illustrated in FIG. 2B. The rotational processing for rotating an input image by 180 degrees is referred to as the "mirror image processing" in this embodiment.

The image read by the image sensor 109 in the mirror image processing step is converted into an orthoscopic image, and an electrostatic latent image subjected to the mirror image processing is formed on the photoconductive drum 111. When the electrostatic latent image thus formed is visualized in the form of a toner image and the toner image is formed on a sheet, an orthoscopic image, rather than a mirror image, is formed on the sheet. In addition, by switchback-discharging the sheet on which the image has been formed, the sheet can be discharged from the printer 300 with its surface, which carries the toner image, facing downward. Binding trailing edges of sheets ejected by the switchback discharge by a stapler 601 of the finisher 500 allows left ends of the sheets in relation to the images to be bound when the sheets are observed from the surfaces bearing the images.

The mirror image processing can alternatively be performed by reversing the secondary scanning direction; in this case, however, the mirror image processing cannot be started until the reading of a one-page image of an original is completed. In addition to the inconvenience, since the left ends of the sheets in relation to images are bound by binding the trailing ends of switchback-discharged sheets, the mirror image processing implemented by reversing the main scanning direction is more preferable.

Referring to FIG. 1, the sheet discharged from the printer 300 by the discharging rollers 118 is fed to the folder 400. The folder 400 folds the sheet into a Z shape. For example, if an A3- or B4-size sheet is used and "Folding" is specified through an operation unit, then the sheet discharged from the printer 300 is folded; otherwise, sheets discharged from the printer 300 are not folded, and are directly fed to the finisher 500.

The inserter 900 is provided on the finisher 500. The inserter 900 inserts a sheet different from regular recording sheets as a first or last page, or anywhere in the middle of recording sheets. More specifically, the inserter 900 inserts a cover sheet or an identification sheet between adjacent sheets bearing images formed by the printer 300. The finisher main unit 500 performs bookbinding or binding, punching, etc. on a bundle of sheets including the sheets conveyed from the printer 300 or sheets from the inserter 900.

Figure 3:
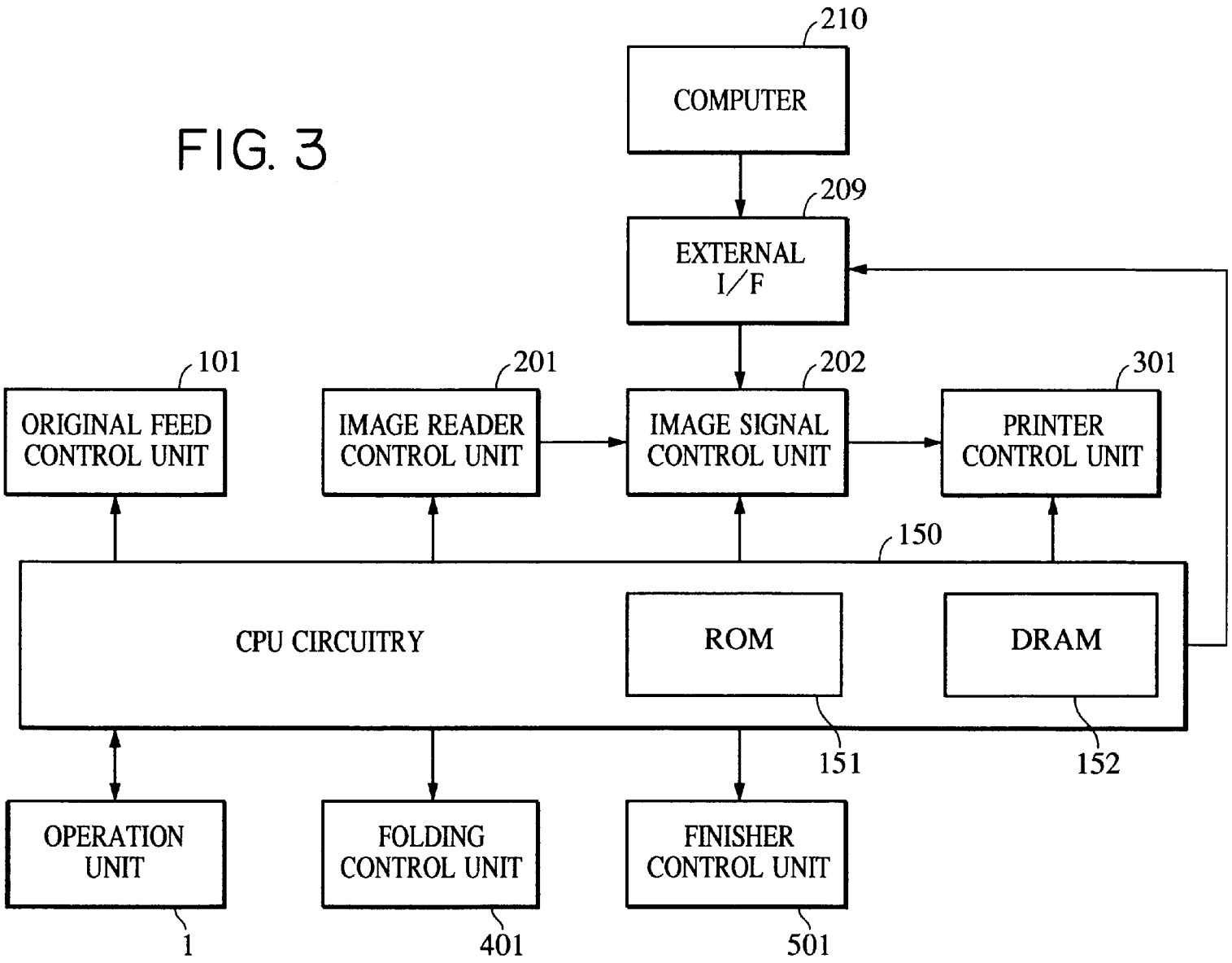
FIG. 3 is a block diagram of a copying apparatus.

FIG. 3 is a block diagram of the copying apparatus 1000. CPU circuitry 150 having a CPU (not shown) controls an original feed control unit 101, an image reader control unit 201, an image signal control unit 202, a printer control unit 301, a folding control unit 401, a finisher control unit 501, and an external I/F 209 according to a control program stored in a ROM 151 and setting made through an operation unit 1. The original feed control unit 101 controls the original feeder 100, the image reader control unit 201 controls the image reader 200, the printer control unit 301 controls the printer 300, the folding control unit 401 controls the folder 400, and the finisher control unit 501 controls the finisher 500. The operation unit 1 primarily has a plurality of keys for setting various functions for image formation, and display sections for displaying states that have been set. The operation unit 1 outputs key signals corresponding to keys operated by a user to the CPU circuitry 150 and also displays information on the display sections based on signals received from the CPU circuitry 150.

A RAM 152 is used as an area for temporarily retaining control data or as a work area for operations involved in control. An external I/F 209 is an interface between the copying apparatus 1000 and an external computer 210, and expands print data from the computer 210 into a bit map image, then output the bit map image as image data to the image signal control unit 202. The image reader control unit 201 outputs an image of an original read by the image sensor 209 to the image signal control unit 202. The printer control unit 301 outputs image data from the image signal control unit 202 to the exposure control unit 110.

Figure 4:
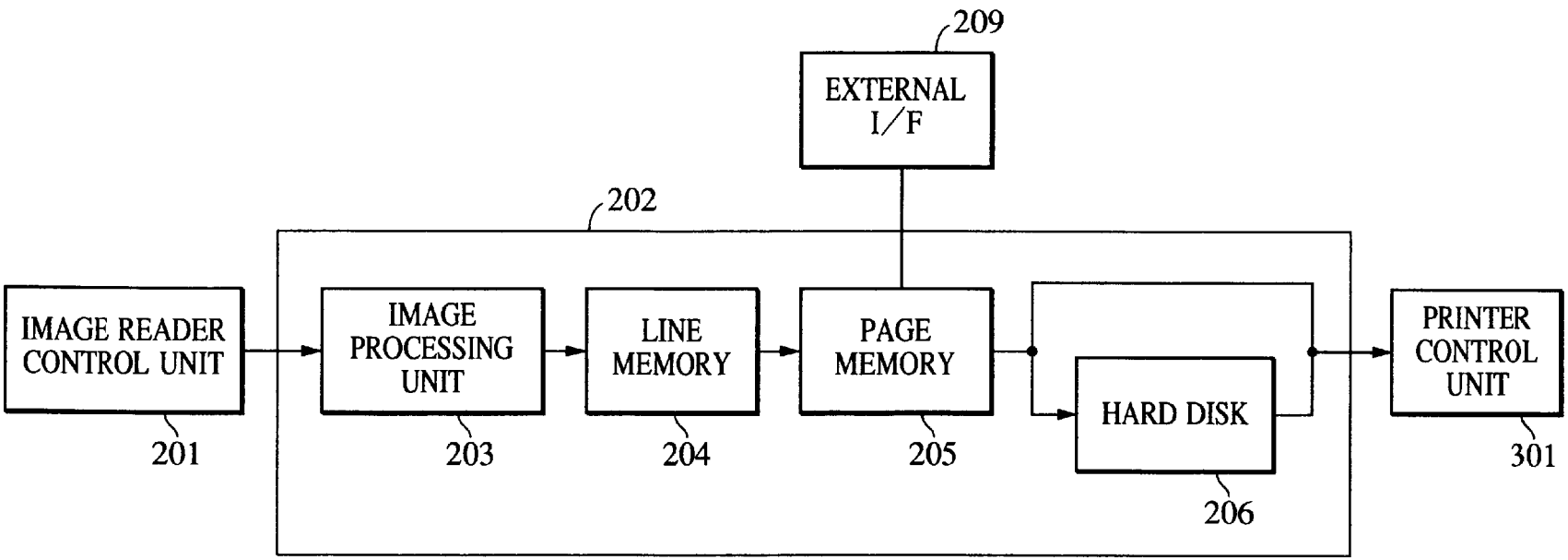
FIG. 4 is a block diagram for providing a detailed description of an image signal control unit.

FIG. 4 is a block diagram for describing the image signal control unit 202 in detail. The image signal control unit 202 has an image processor 203, a line memory 204, a page memory 205, and a hard disk 206. The image processor 203 corrects or edits an image according to a setting made through the operation unit 1. In the line memory 204, the processing takes place for reversing the main scanning direction, i.e., the mirror image processing set forth above. An image output from the line memory 204 is supplied to the printer control unit 301 via the page memory 205. The hard disk 206 is employed primarily for changing an order of pages, i.e., electronic sorting.

Figure 5:
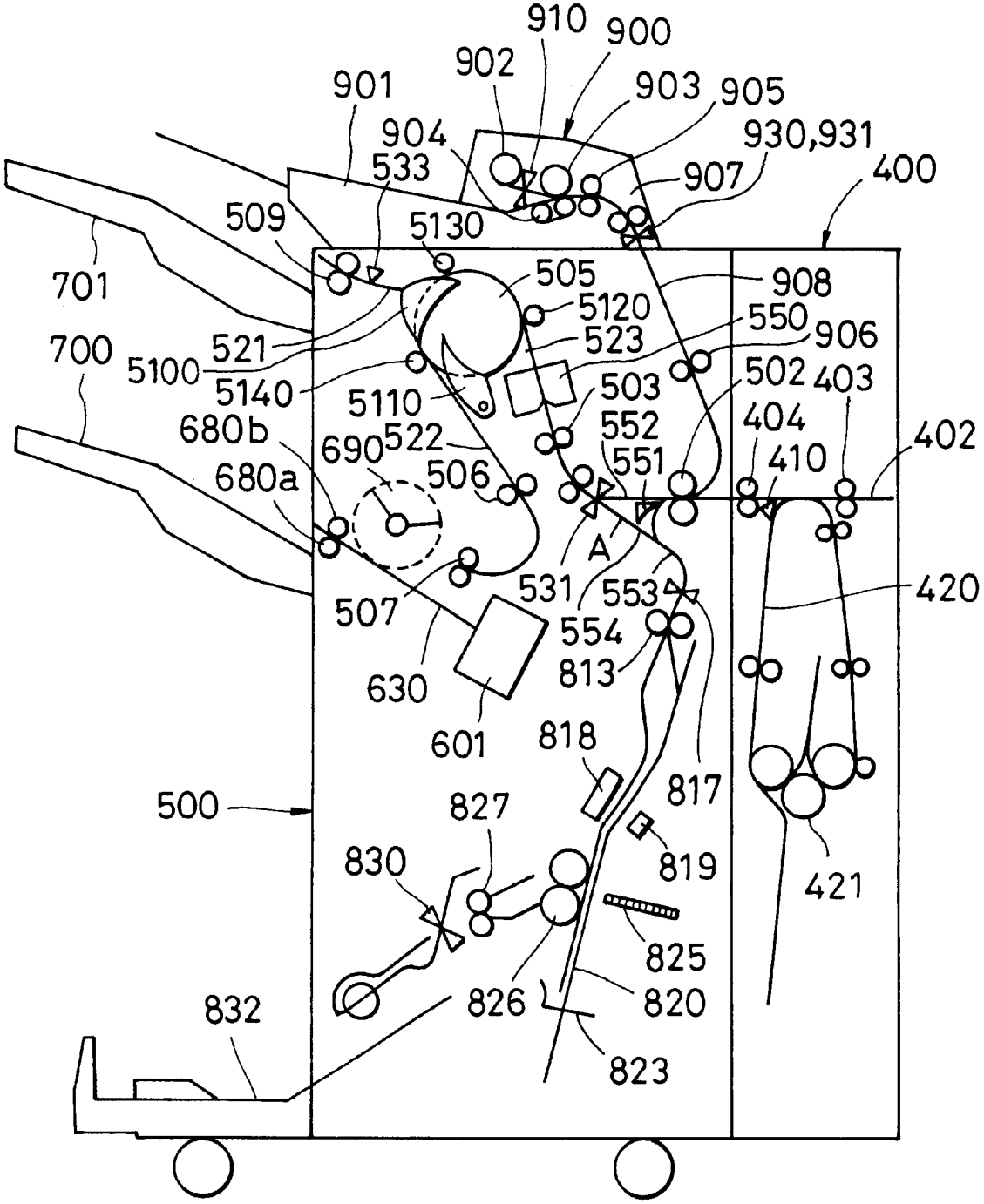
FIG. 5 is a diagram showing a configuration of a folding unit and a finisher.

Referring now to FIG. 5, constructions of the folder 400 and the finisher 500 will be described. FIG. 5 illustrates the constructions of the folder 400 and the finisher 500 shown in FIG. 1.

The folder 400 has a conveying path 402 for guiding a sheet discharged from the printer 300 into the finisher 500. Pairs of conveying rollers 403 and 404 are provided on the conveying path 402. A switching flapper 410 provided in the vicinity of the pair of conveying rollers 404 guides a sheet, which has been conveyed by the pair of conveying rollers 403, to a folding path 420 or the finisher 500.

To perform folding, the switching flapper 410 is changed over to the folding path 420, and the sheet is led to the folding path 420. The sheet led to the folding path 420 is carried to folding rollers 421 and folded in a Z shape. If no folding is performed, the switching flapper 410 is changed over to the finisher 500, so that a sheet discharged from the printer 300 is directly fed to the finisher 500 via the conveying path 402.

The construction of the finisher 500 will now be described. The finisher 500 captures sheets from the printer 300 that have been conveyed via the folder 400, and carries out post processing of the sheets, such as bundling in which a plurality of captured sheets are aligned into a bundle of sheets, stapling or binding in which a trailing edge of a bundle of sheets is stapled or bound, sorting, non-sorting, and bookbinding. In the finisher 500, a punching unit 550 is provided on a sheet conveying path, so that sheets from the inserter 900 or the printer 300 can be perforated or punched by the punching unit 550. The punching unit 550 has a punch roller (not shown), the punching roller being comprised of a die and a punch. To perform punching, when the trailing edge of a sheet reaches the punching unit 550, the punching roller is rotated once to punch holes in the trailing edge portion of the sheet. The punching is carried out on each sheet conveyed and performed at the same time as the sheet conveyance.

As shown in FIG. 5, the finisher 500 has a pair of inlet rollers 502 for capturing a sheet from the printer 300 that has been conveyed via the folder 400. On a downstream side of the pair of inlet rollers 502, a switching flapper 551 for leading a sheet to a finisher path 552 or a first bookbinding path 553 is provided.

A sheet led to the finisher path 552 is carried toward a buffer roller 505 via a pair of conveying rollers 503. The pair of conveying rollers 503 and the buffer roller 505 are configured so that they can be rotated in forward and reverse directions.

An inlet sensor 531 is provided between a pair of inlet rollers 502 and the pair of conveying rollers 503. In the vicinity of an upstream side of the inlet sensor 531, a second bookbinding path 554 is branched from the finisher path 552. The branching point will be referred to as "branch point A."

Branch point A constitutes a branch point to a conveying path for carrying sheets from the pair of inlet rollers 502 to the pair of conveying rollers 503. However, branch point A constitutes a one-way mechanism for conveying a sheet only to the second binding path 554 when the pair of conveying rollers 503 is rotated in the reverse direction to convey the sheet from the pair of conveying rollers 503 to the inlet sensor 531.

The punching unit 550 is provided between the pair of conveying rollers 503 and the buffer roller 505. The punching unit is operated in an operation mode set through the operation unit 1 so as to punch or perforate in the vicinity of a trailing edge of a sheet conveyed via the pair of conveying rollers 503.

The buffer roller 505 is capable of wrapping around itself a predetermined number of sheets carried via the pair of conveying rollers 503. While the roller 505 is rotating, sheets are wrapped therearound by pressing rollers 5120, 5130, and 5140. The sheets wrapped around the buffer roller 505 are carried in a direction in which the buffer roller 505 rotates.

A switching flapper 5100 is provided between the pressing roller 5130 and the pressing roller 5140, and a switching flapper 5110 is provided on a downstream side of the pressing roller 5140. The switching flapper 5100 peels the sheets, which have been wrapped around the buffer roller 505, from the buffer roller 505 and leads the sheets to a non-sorting path 521 or a sorting path 522.

A switching flapper 5110 peels sheets wrapped around the buffer roller 505 from the buffer roller 505, and leads the sheets to the sorting path 522. Furthermore, the switching flapper 5110 guides the sheets wrapped around the buffer roller 505 to a buffer path 523 in a state wherein the sheets remain wrapped.

The sheets led by the switching flapper 5100 to the non-sorting path 521 are discharged onto a sample tray 701 via a pair of discharging rollers 509. In the middle of the non-sorting path 521, a sheet discharge sensor 533 for detecting a jam is provided.

The sheet guided by the switching flapper 5100 to the sorting path 522 is stacked on an intermediate tray (hereinafter referred to as "processing tray") 630 via pairs of conveying rollers 506 and 507. A group of sheets loaded on a bundle on the processing tray 630 is subjected to alignment or stapling according to setting made through the operation unit 1, then discharged onto a stack tray 700 via discharging rollers 680*a* and 680*b*. The stapling mentioned above is performed by the stapler 601. The stack tray 700 is configured to be able to move up and down.

A sheet from the first bookbinding path 553 or the second bookbinding path 554 passes a bookbinding inlet sensor 817 and is placed in an accommodating guide 820 via a pair of conveying rollers 813. The sheet conveyed by the conveying rollers 813 is carried until a leading edge thereof reaches a movable sheet positioning member 823. The bookbinding inlet sensor 817 is disposed on an upstream side of the conveying rollers 813. Furthermore, two pairs of staplers 818 are provided on a downstream side of the conveying rollers 813, i.e., in the middle of the accommodating guide 820. An anvil 819 is provided in a position opposing the staplers 818. The staplers 818 are configured to bind a center of a bundle of sheets in cooperation with the anvil 819.

A pair of folding rollers 826 is provided on a downstream side of the staplers 818. A thrust member 825 is provided in a position where it opposes the pair of folding rollers 826. The thrust member 825 is thrust toward a bundle of sheets in the accommodating guide 820 thereby to cause the bundle of sheets to be pushed out between the pair of folding rollers 826. The bundle of sheets is folded by the pair of folding rollers 826, then discharged onto a discharge tray 832 via sheet discharging rollers 827. A bookbinding sheet discharge sensor 830 is disposed on a downstream side of the sheet discharging rollers 827.

To fold a bundle of sheets that has been bound by the staplers 818, the positioning member 823 is moved down by a predetermined distance from a location for stapling so that a stapled spot of the bundle of sheets is positioned at a center or a nipping point of the pair of folding rollers 826 after the stapling is completed. This enables the bundle of sheets to be folded about the stapled spot.

The inserter 900 provided on the finisher 500 will now be described. The inserter 900 feeds a sheet set in a tray 901 to the sample tray 701, the stack tray 700, or the tray 832 without passing the sheet through the printer 300. In this embodiment, it is assumed that a sheet for a cover sheet (or an identification sheet) has been set face-up (a front surface up) in the tray 901 of the inserter 900 by a user. A bundle of sheets stacked on the tray 901 by a user is separated one by one in order and conveyed to the finisher path 552 or the bookbinding path 553. The following will describe a construction of the inserter 900.

The bundle of sheets stacked on the tray 901 is conveyed by a feeding roller 902 to a separator composed of a conveying roller 903 and a separating belt 904. Then, the sheets are separated one by one, beginning with a top sheet, by the conveying roller 903 and the separating belt 904. The separated sheets are carried to a conveying path 908 by a pair of drawing rollers 905 adjacent to the separator, and further carried to the pair of inlet rollers 502 via a pair of conveying rollers 906.

A sheet set sensor 910 for detecting whether a sheet has been set or not is provided between the feeding roller 902 and the conveying roller 903. In the vicinity of the pair of drawing rollers 905, a feed sensor 907 for detecting whether a sheet has been conveyed by the pair of drawing rollers 905 or not is provided. Furthermore, skew sensors 930 and 931 are provided on a downstream side of the feed sensor 907. The skew sensors 930 and 931 are disposed at different positions on the same line oriented in a direction orthogonal to a sheet conveying direction. These sensors detect skew or a skew amount of sheets fed from the tray 901 of the inserter. For instance, a skew amount of a sheet in a sheet feeding direction is calculated based on a difference between a time at which the sensor 930 detects a leading edge of the sheet and a time at which the sensor 931 detects the leading edge of the sheet. Thus, in this embodiment, a skew amount or inclination amount of the sheet is detected while the sheet is being fed from the inserter 900. The conveying path 908 for conveying sheets from the inserter 900 merges with the conveying path 402 for conveying sheets from the printer 300 at a location near an upstream side of the pair of inlet rollers 502.

Figure 6:
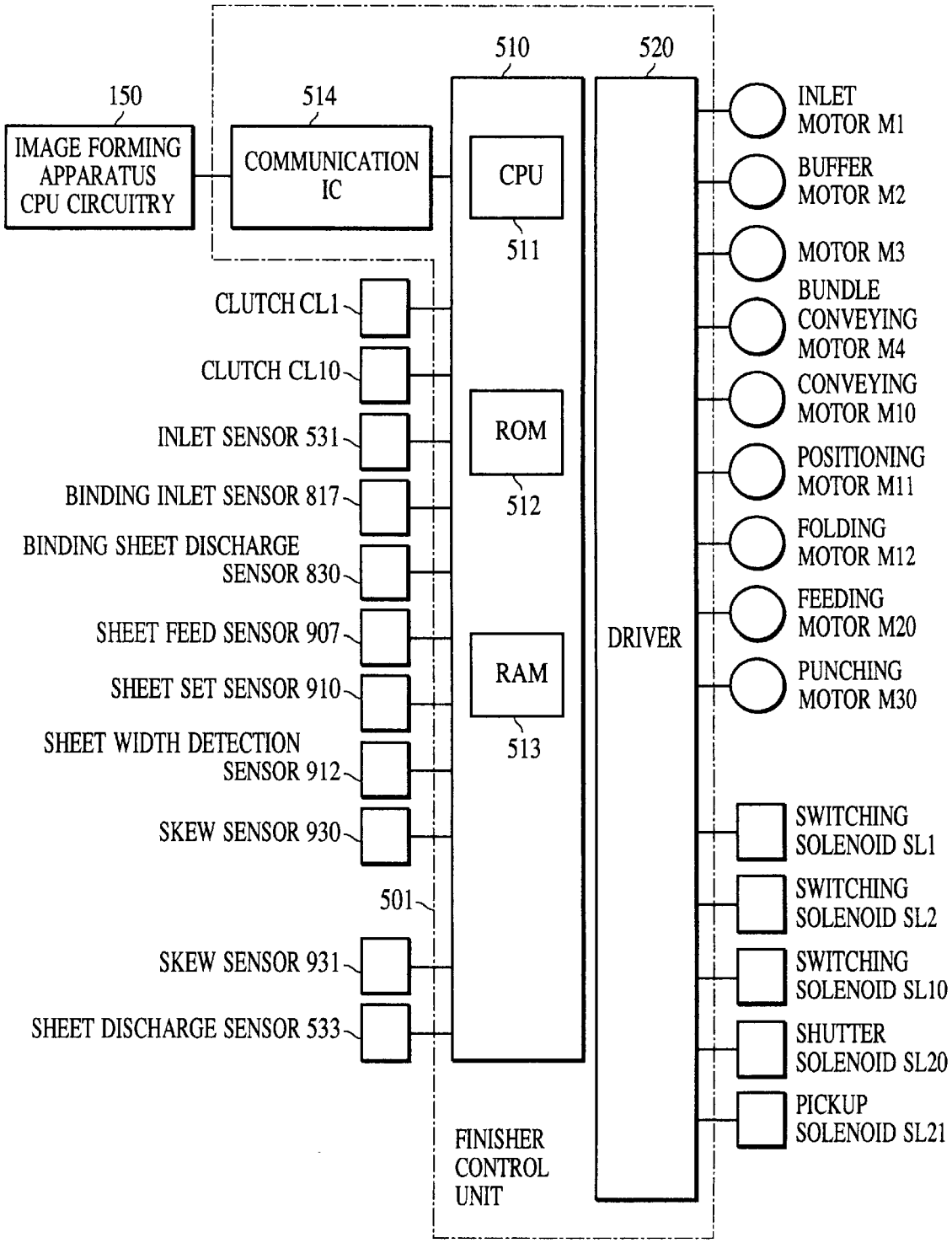
FIG. 6 is a block diagram showing a configuration of a finisher control unit.

Referring now to FIG. 6, a construction of the finisher control unit 501 for controlling drive of the finisher 500 will be described. FIG. 6 is a block diagram showing the construction of the finisher control unit 501 of FIG. 3.

The finisher control unit 501 has CPU circuitry 510 consisting of a CPU 511, a ROM 512, and a RAM 513 as shown in the block diagram. The CPU circuitry 510 communicates with the CPU circuitry 150 provided in the main unit of the copying apparatus via a communication IC 514, and performs data conversion. The CPU circuitry 510 executes various programs stored in the ROM 512 to control the drive of the finisher 500 according to instructions from the CPU circuitry 150. The CPU circuitry 510 further includes a jam timer (not shown) for detecting a jam.

To control the drive of the finisher 500, detection signals from various sensors are supplied to the CPU circuitry 510. Various sensors include an inlet sensor 531, a binding inlet sensor 817, the bookbinding sheet discharge sensor 830, the feed sensor 907, a sheet set sensor 910, a sheet discharge sensor 533, and the skew sensors 930 and 931 (see FIG. 5).

A driver 520 is connected to the CPU circuitry 510. The driver 520 drives various motors and solenoids, clutch CL1, clutch CL10, etc. based on signals from the CPU circuitry 510.

Various motors include an inlet motor M1 serving as a driving source of the pair of inlet rollers 502, the pair of conveying rollers 503, and the pair of conveying rollers 906, a buffer motor M2 serving as a driving source of the buffer roller 505, a sheet discharging motor M3 serving as a driving source of the pair of conveying rollers 506, the pair of discharging rollers 507, the pair of discharging rollers 509, a bundle discharging motor M4 serving as a driving source of the discharging rollers 680*a* and 680*b*, a conveying motor M10 serving as a driving source of the pair of conveying rollers 813, a positioning motor M11 serving as a driving source of the sheet positioning member 823, a folding motor M12 serving as a driving source of the thrust member 825, the pair of folding rollers 826, and the pair of sheet discharging rollers 827, a feeding motor M20 serving as a driving source of the feeding roller 902, the conveying roller 903, the separating belt 904, and the pair of drawing rollers 905 of the inserter 900, and a punching motor M30 serving as a driving source of the punching roller in the punching unit 550.

The inlet motor M1, the buffer motor M2, and the discharging motor M3 are composed of stepping motors; they are able to rotate the roller pairs, which are driven by the motors, at the same speed or at different speeds by controlling exciting pulse rates. The inlet motor M1 and the buffer motor M2 can be driven in forward and reverse directions by the driver 520.

The conveying motor M10 and the positioning motor M11 are formed of stepping motors, and the folding motor M12 is formed of a DC motor. The conveying motor M10 is configured to be able to convey sheets at a synchronized speed with the inlet motor M1.

The feeding motor M20 is composed of a stepping motor, and configured to be able to feed sheets in synchronization with the inlet motor M1 in speed.

Solenoids include a solenoid SL1 for changing over the switching flapper 5100, a solenoid SL2 for changing over the switching flapper 5110, a solenoid SL10 for changing over the switching flapper 551, a solenoid SL20 for driving a feeding shutter (not shown) of the inserter 900, and a solenoid SL21 for raising and lowering the feeding roller 902 of the inserter 900.

Referring now to FIG. 7, descriptions will be given of a method for setting operation modes. FIG. 7A and FIG. 7B illustrate display screens on a display panel of the operation unit 1 of the copying apparatus main body 1000. The display panel is of a touch panel; displayed functions in boxes may be touched to implement the functions.

The screen shown in FIG. 7A enables a user to select operation modes, such as a non-sorting mode, a sorting mode, a stapling and sorting mode (binding mode), a bookbinding mode, and a punching mode (perforating mode).

The screen shown in FIG. 7B enables the user to set a cover sheet mode and an identification sheet mode so as to allow a cover sheet or an identification sheet supplied from the inserter 900 or the manual sheet feeder 125 to be inserted as a first or last page or anywhere in the middle of recording sheets.

Referring now to FIG. 8 through FIG. 13, descriptions will be given of conveyance of sheets from the inserter 900 and the printer 300 to the processing tray 630 in the finisher 500. FIGS. 8 through 13 illustrate flows of sheets when a sheet from the inserter 900 and a sheet from the printer 300 are conveyed and accommodated in the processing tray 630 of the finisher 500.

In this embodiment, a sheet conveyed from the inserter 900 will be a cover sheet, and a total of three sheets consisting of the cover sheet from the inserter 900 and two sheets conveyed from the printer 300 will be accommodated as a set in the processing tray.

Figure 8A:
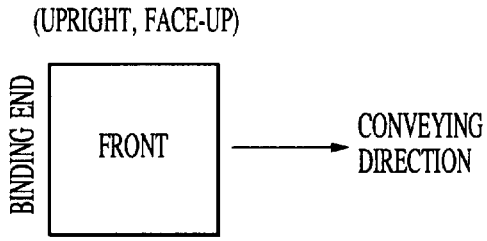
FIG. 8 provides diagrams showing a flow of accommodating a sheet supplied from an inserter and a sheet supplied from a printer unit onto a processing tray.
Figure 8B:
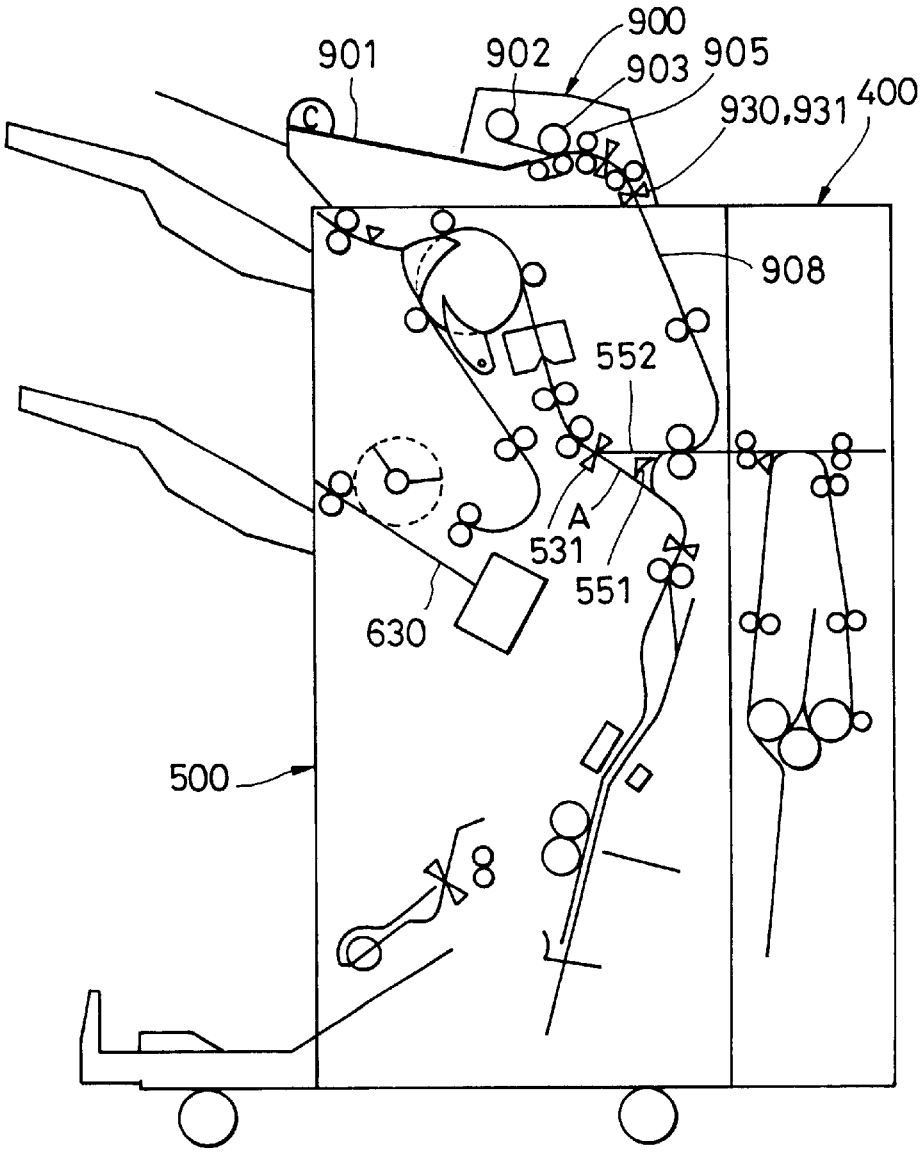

To insert a sheet of a bundle of sheets C as a cover sheet among the sheets on which images have been formed by the printer 300, the bundle of sheets C is set in the tray 901 of the inserter 900 by a user as shown in FIG. 8B. At this time, the bundle of sheets C is set by the user so that it is placed on the tray 901 of the inserter 900 in a face-up state (a surface on which an image has been formed faces upward), its binding edge being positioned on the left, i.e., in an upright state as shown in FIG. 8A. The sheets set in the tray 901 are conveyed in a direction of an arrow shown in the drawing.

Figure 9:
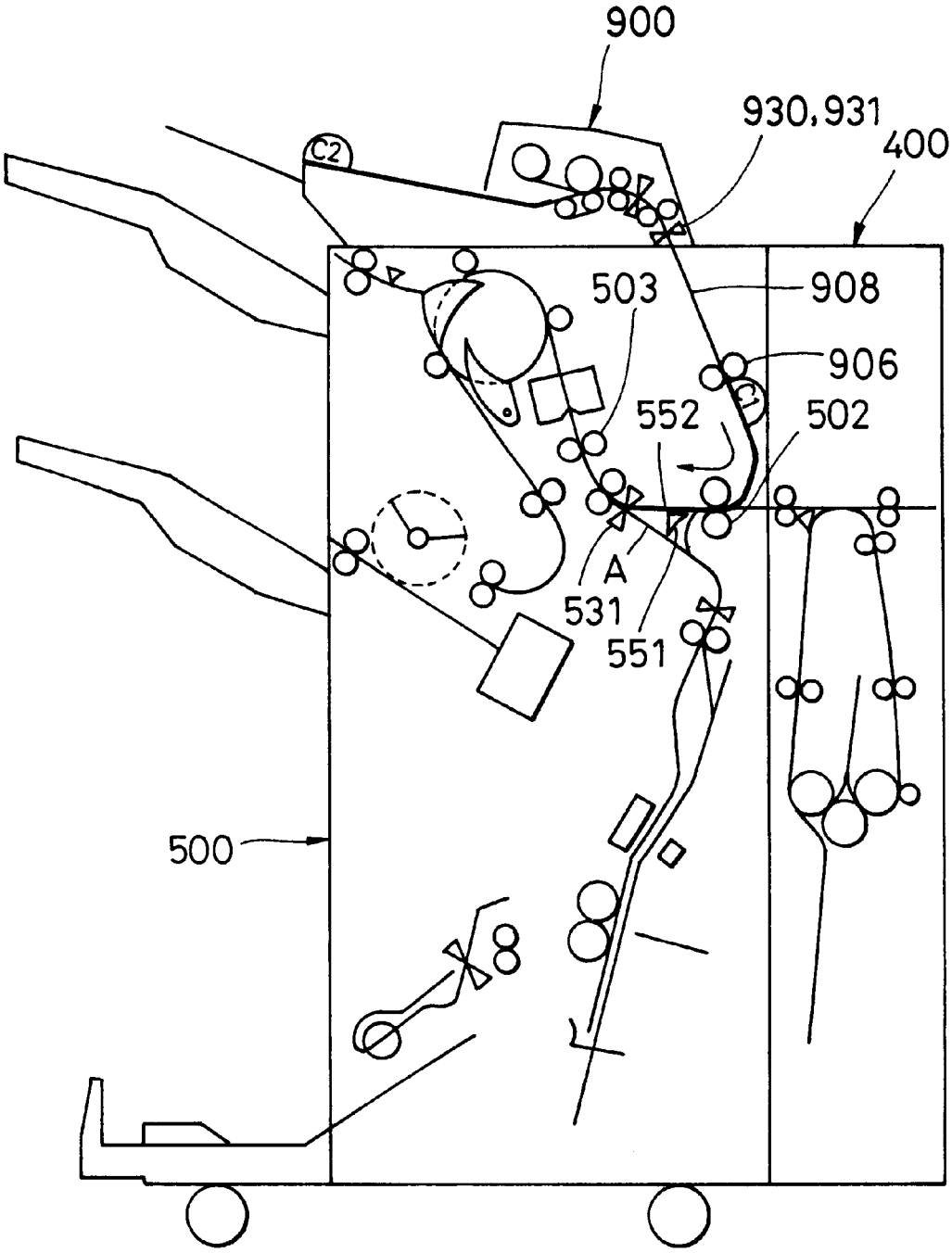
FIG. 9 is another diagram illustrating a flow of accommodating the sheet from the inserter and the sheet from the printer unit onto the processing tray.

Referring now to FIG. 9, when the user sets the bundle of sheets C on the tray 901 and presses a start key (not shown) on the operation unit 1, the sheets are successively separated from a top sheet (hereinafter referred to as "sheet C1) of the bundle of sheets C by the separator constituted by the conveying roller 903 and the separating belt 904 in the inserter 900, and carried to the conveying path 908. At this time, the switching flapper 551 is changed over to the finisher path 552 as shown in the drawing.

The top sheet C1 of the bundle of sheets C conveyed to the conveying path 908 is conveyed to the buffer roller 505. As illustrated in FIG. 9, the sheet C1 is carried to the buffer roller 505, with its surface bearing an image facing downward (face down).

The moment a leading edge of the sheet C1 conveyed from the conveying path 908 via the pair of inlet rollers 502 passes the inlet sensor 531, i.e., as soon as the inlet sensor 531 turns ON, conveyance of the sheets from the printer 300 to the finisher 500 is started. The sheets conveyed from the printer 300 into the finisher 500 are denoted as a sheet P1 and a sheet P2 (see FIG. 10 through FIG. 13). The sheet P1 is conveyed first, then the sheet P2 follows.

Figure 32:
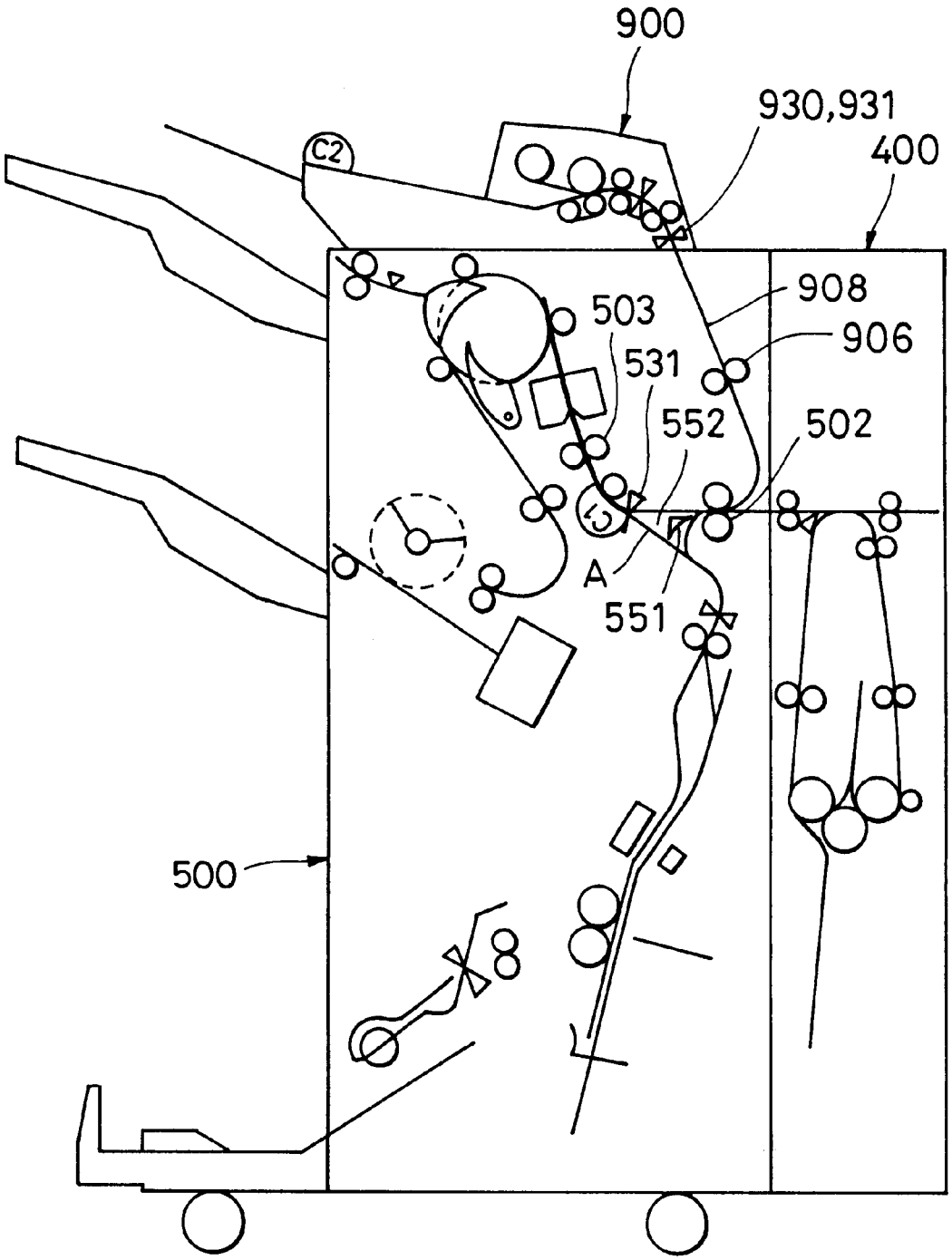
FIG. 32 illustrates a punching process.

If the punching mode has been preset by the user on the post processing menu screen of the operation unit 1 shown in FIG. 7A, the program checks whether or not the inlet sensor 531 is OFF (whether a trailing edge of the sheet C1 has passed the inlet sensor 531). If it is determined that the trailing edge of the sheet C1 has passed the inlet sensor 531, then the punching motor M30 shown in FIG. 6 is actuated after a predetermined time elapses from the moment the trailing edge of the sheet passes the sensor 531 (FIG. 32). Thus, when the trailing edge of the sheet C1 passes through the punching unit 550, a punching roller (not shown) in the punching unit 550 rotates, causing a punch and a die on the punch roller to meet at a predetermined position of the trailing edge of the sheet thereby to permit the trailing edge of the sheet to be punched at predetermined positions. The punching roller is controlled so that it stops when it rotates once, and stands by for the next punching. The same processing described above is carried out on each of the sheets P1 and P2 following the sheet C1.

As discussed above, in this embodiment, the punching unit 550 is provided in the sheet conveying path, so that sheets are punched when they pass through the punching unit 550. This leads to higher productivity.

Figure 10:
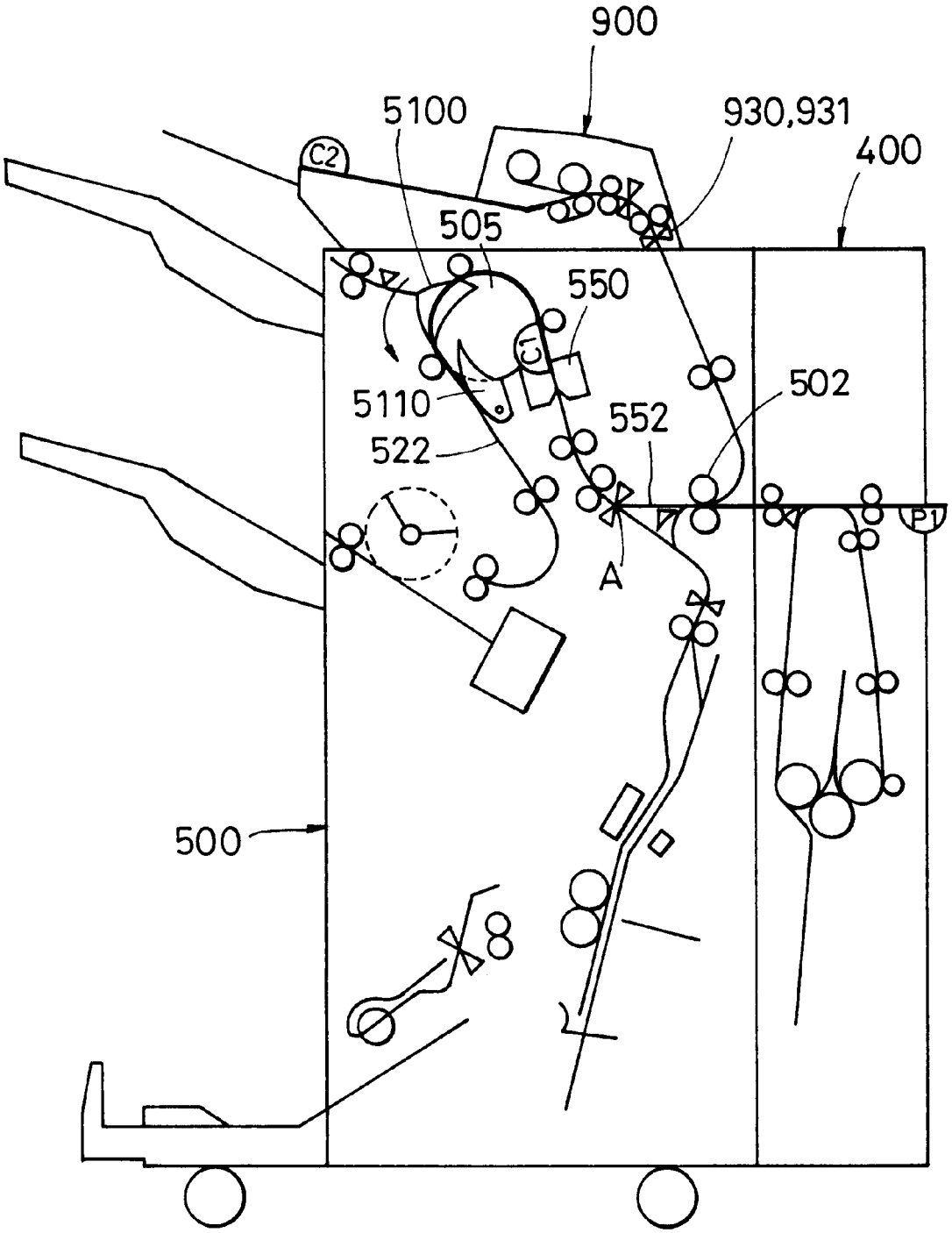
FIG. 10 is yet another diagram illustrating a flow of accommodating the sheet from the inserter and the sheet from the printer unit onto the processing tray.

Referring now to FIG. 10, the switching flappers 5100 and 5110 are both switched to the sorting path 522, and the sheet C1 conveyed to the buffer roller 505 is guided to the sorting path 522. At this time, the sheet P1 from the printer 300 is carried into the finisher 500, following the sheet C1. As shown in the drawing, the sheet P1 is guided to the finisher 500, its surface on which an image has been formed facing downward. More detailed descriptions will be given below.

In this embodiment, an original set on the original feeder 100 is read by the image reader 200, and an image of the read original is subjected to image information processing implemented by the printer 300 so as to form the image of the read original on a sheet. The original is read in the moving-original reading mode.

As previously described, in the moving-original reading mode, a read image is subjected to the mirror image processing in which the input image is rotated 180 degrees so as to form an orthoscopic image on a sheet. Then, the image that has undergone the mirror image processing is formed on a sheet. Furthermore, when the sheet with the image formed thereon is discharged from the printer 300, switchback discharge is performed so as to cause the sheet to be ejected with its surface with the image facing downward (face down). Accordingly, as shown in FIG. 10 through FIG. 13, the sheet P1 and the sheet P2 from the printer 300 are fed to the finisher 500 with their surfaces, on which the images have been formed, facing downward.

Figure 11:
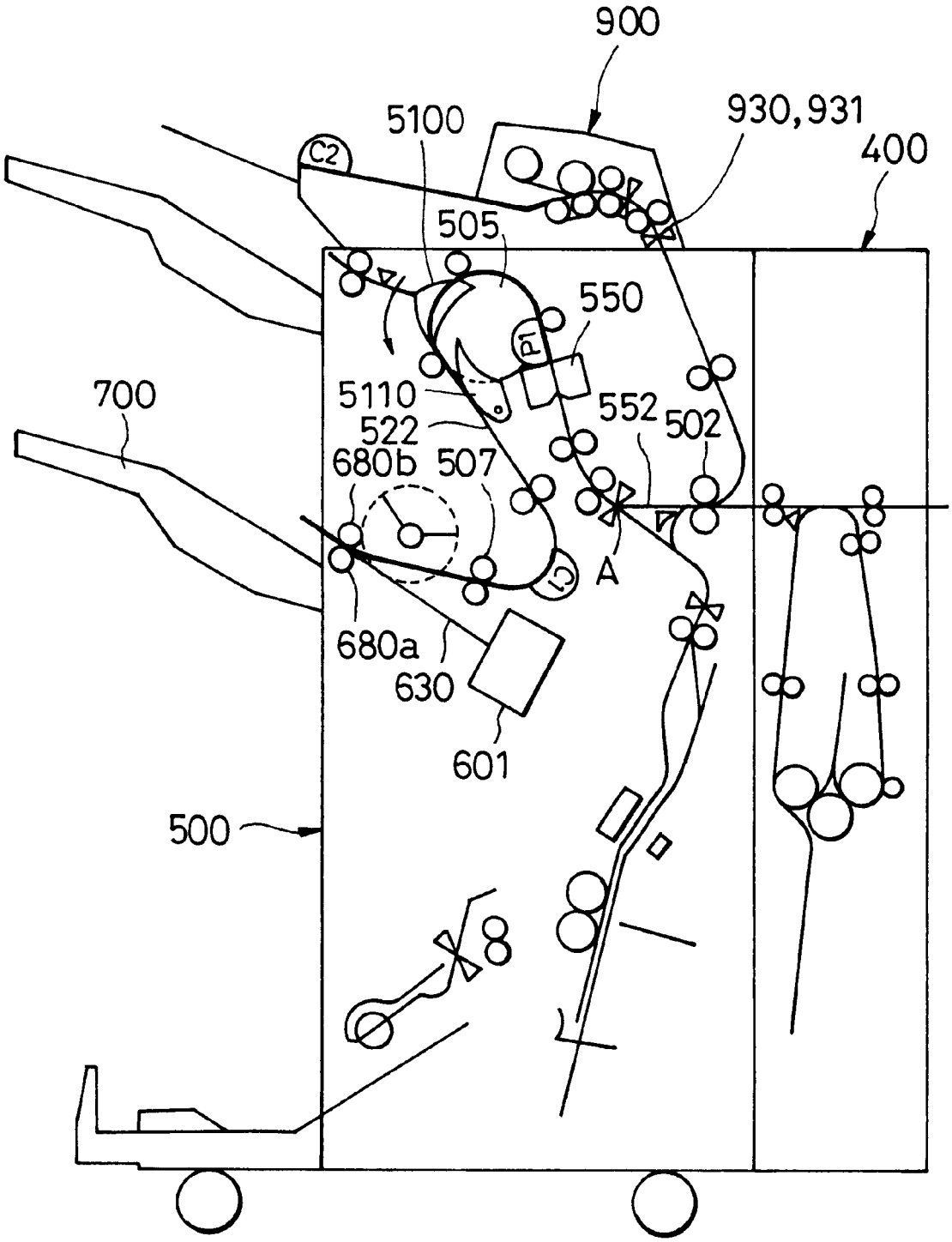
FIG. 11 is a further diagram illustrating a flow of accommodating the sheet from the inserter and the sheet from the printer unit onto the processing tray.

Referring to FIG. 11, the sheet C1 conveyed to the sorting path 522 is carried to the processing tray 630. The sheet P1 from the printer 300 that is conveyed following the sheet C1 is conveyed to the buffer roller 505 via the finisher path 552 and led to the sorting path 522. At this time, following the sheet P1, the conveyance of the sheet P2 from the printer 300 to the finisher 500 is started. At this point, if there is a second set to follow, then a sheet (a sheet C2 in this case) following the sheet C1 stacked on the tray 901 is separated by the separator of the inserter 900.

Figure 12:
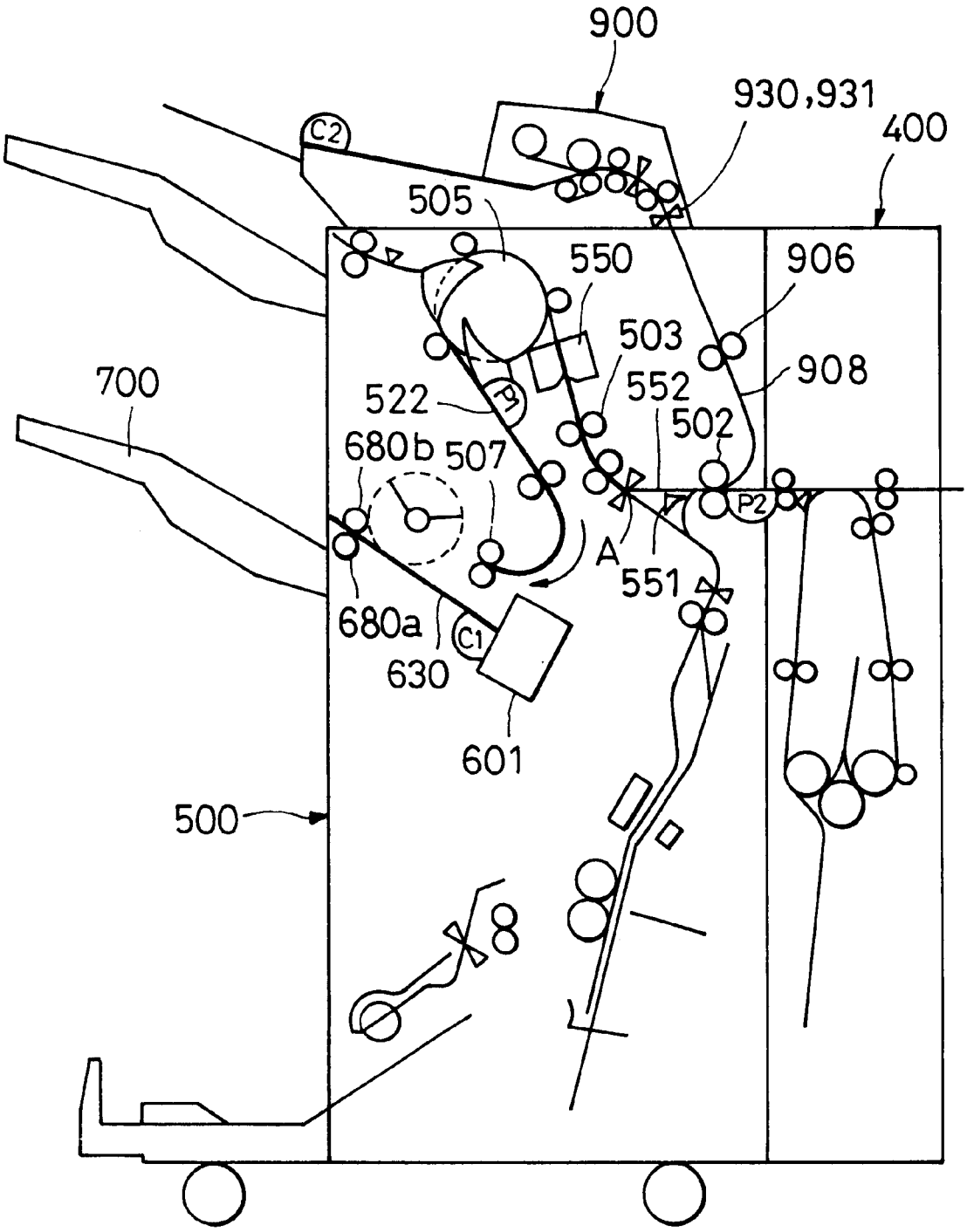
FIG. 12 is another diagram illustrating a flow of accommodating the sheet from the inserter and the sheet from the printer unit onto the processing tray.

Referring now to FIG. 12, the sheet C1 is placed in the processing tray 630, with its image-formed surface facing down and its binding edge positioned adjacent to the stapler 601. The sheet P1 following the sheet C1 is conveyed toward the processing tray 630 as in the case of the sheet C1. The sheet P2 following the sheet P1 is guided to the main unit of the finisher 500 and conveyed to the buffer roller 505. These sheets P1 and P2 are conveyed to and placed in the processing tray 630 in succession.

At this point, if the second set is output, the sheet C2 serving as a cover sheet of the second set is conveyed to the conveying path 908, following the sheet P2. The sheet C2, however, is temporarily stopped before the pair of conveying rollers 906 while the sheet P2 is being conveyed to the processing tray 630. When the sheet P2 of the preceding first set is accommodated in the processing tray 630, the conveyance of the sheet C2 is restarted.

Figure 13A:
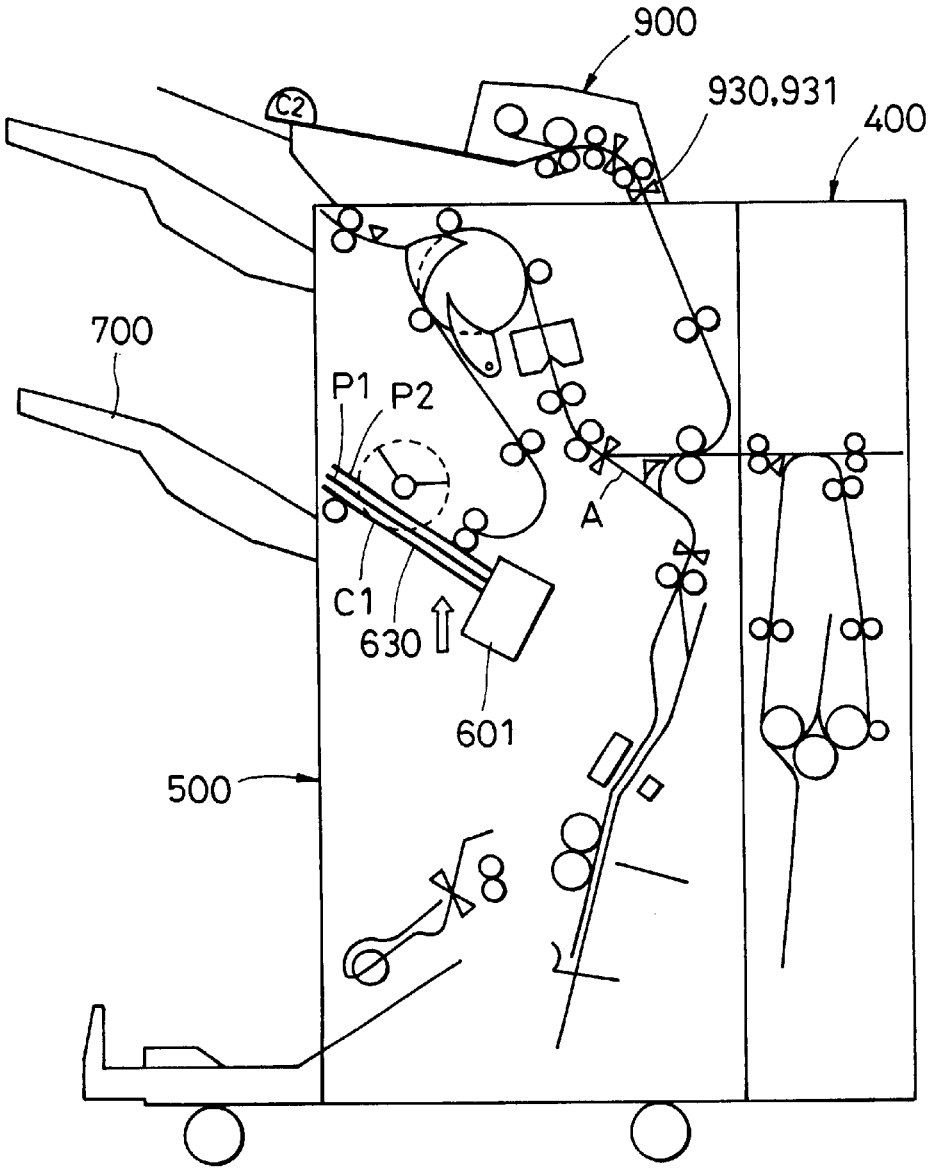
FIG. 13 is still another diagram illustrating a flow of accommodating the sheet from the inserter and the sheet from the printer unit onto the processing tray.

Referring now to FIG. 13, the sheet P1 is accommodated by being stacked over the sheet C1 already accommodated in the processing tray 630, and the sheet P2 following the sheet P1 is also accommodated by being stacked over the sheet P1 as illustrated in FIG. 13A. The images formed on the sheets P1 and P2 have been subjected to the mirror image processing so as to be turned into orthoscopic images. When sheets are conveyed from the printer 300 to the finisher 500, the sheets are switchback-discharged at the printer 300; hence, the sheets P1 and P2 are accommodated in the processing tray 630 with their image-carrying surfaces facing downward (face down) and their binding edges positioned adjacently to the stapler 601, as in the case of the sheet C1.

Figure 13B:
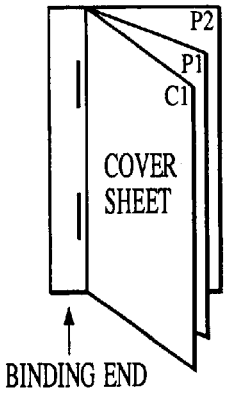

When binding is performed, as post processing, on the bundle of sheets consisting of the plural sheets, the stapler 601 staples the sheet bundle as soon as the sheet P2 is placed in the processing tray 630. FIG. 13B illustrates the sheet bundle bound by the stapler 601 as observed from a direction of an arrow shown in FIG. 13A. Thus, when the bundle of sheets composed of the sheet from the inserter and the sheets on which images have been formed by the printer 300 is stapled, orientations of the images and binding positions of the sheets coincide with each other. This means that, when a sheet from the inserter 900 and sheets on which images are formed by the printer 300 are loaded in a mixed manner, processing of a first page and post processing can be made compatible.

As described above, in this embodiment, in order to make the orientation of an image on a sheet set in the tray 901 of the inserter 900 coincide with the orientation of an image supplied from the image reader 200, the processing for rotating the input image by 180 degrees, which is referred to as the mirror image processing in this embodiment, is carried out, and the image that has undergone the mirror image processing is formed on a sheet. Then, a sheet from the inserter 900 and the sheet on which the image has been formed are loaded on the processing tray 630 or the accommodating guide 820, which will be discussed later.

Thus, the orientation of an image on a sheet from the inserter 900 and the orientation of images on sheets from the printer 300 can be matched when a sheet from the inserter 900 and sheets from the printer 300 are loaded in a mixed manner on the processing tray 630 or the accommodating guide 820, which will be discussed hereinafter. This arrangement permits easier alignment of sheets during post processing, making it possible to prevent inconveniences encountered when post processing is carried out on a bundle of sheets consisting of a mixture of a sheet from the inserter 900 and sheets from the printer 300.

To convey sheets to the processing tray 630, a sheet set in the inserter 900 is switched back before being conveyed to the processing tray 630, and a sheet on which an image has been formed by the printer 300 is also switched back before being conveyed to the processing tray 630. The conveyance of the sheet from the inserter 900 precedes the conveyance of the sheet from the printer 300. With this arrangement, processing on a first page and post processing can be made compatible when a sheet from the inserter 900 and a sheet on which an image has been formed by the printer 300 are loaded in a mixed manner. For instance, when a bundle of sheets consisting of a plurality of these sheets loaded on the processing tray 630 is stapled by the stapler 601, the orientations of the images of the sheets and the binding positions can be matched as shown in FIG. 13B.

Furthermore, a setting direction of originals set in the tray 1001 of the original feeder 100, i.e., a direction in which originals are loaded in the tray 1001, coincides with a setting direction of sheets set in the tray 901 of the inserter 900 as shown in FIG. 1 and FIG. 8. As observed by a user, the originals and the sheets can be set in the trays in the upright, face-up (an image carrying surface faces upward) state. Hence, in using the cover sheet mode or the identification sheet mode, incorrect loading by a user can be prevented, permitting more user-friendly apparatus to be achieved.

In this embodiment, referring back to FIG. 1, a feeding direction (from right to left) of the originals loaded on the tray 1001 of the original feeder 100 is opposite to a feeding direction (from left to right) of the sheets loaded on the tray 901 of the inserter 900, and these trays are constructed so that they face away from the apparatus. This arrangement makes it possible to reduce the size of the apparatus and also to facilitate setting of sheets on the inserter 900.

In this embodiment, the descriptions have been given of the case wherein images of originals are input through the image reader 200. The present invention, however, can be applied also to a case wherein image data is entered from the external computer 210 as shown in FIG. 3. In this case, an input image is subjected to the rotation processing, which is referred to as "the mirror image processing" in this embodiment, as necessary, considering the orientation of an image and a binding position on a sheet set in the tray 901 of the inserter 900. Then, the processed image is formed on the sheet, and the sheet is switched back before it is discharged to the finisher 500. With this arrangement, when a sheet from the inserter 900 and a sheet from the printer 300 are loaded in a mixed manner, processing of a first page and post processing can be made compatible. Moreover, when a bundle of sheets consisting of a plurality of sheets accommodated in the processing tray 630 is subjected to post processing, such as stapling, the orientations of the images of the sheets and the binding positions can be matched.

Furthermore, in FIG. 8 through FIG. 13, the descriptions have been given of the case wherein the sheet from the inserter 900 is inserted at the beginning page of the sheets from the printer 300 in the cover sheet mode. The present invention, however, can also be applied to the identification sheet mode wherein a sheet from the inserter 900 is inserted as a partitioning sheet for identification between adjacent sheets from the printer 300.

Referring now to FIG. 14, the bookbinding will be described. This processing is performed when a user selects the bookbinding mode as an operation mode on the display panel of the operation unit 1 shown in FIG. 7. FIG. 14 illustrates processing for forming an image in the bookbinding mode in the copying apparatus 1000 shown in FIG. 1.

When the bookbinding mode is specified, originals set in the tray 1001 of the original feeder 100 are read in sequence from a beginning page, and images of the read originals are successively stored in the hard disk 206 in the image signal control unit 202, and a number of read originals is counted. Upon completion of reading the originals, the read original images are classified according to an expression (1) shown below so as to decide an order of image formation and positions where images should be formed.

$$M=n\times 4-k \tag{1}$$

where M denotes a number of originals; n denotes an integer of 1 or larger indicating a number of sheets used for forming images of read originals; and k is a value of any one of 0, 1, 2, or 3.

Figure 14A:
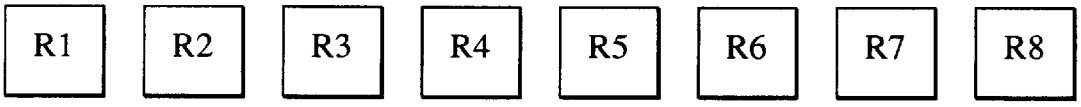
FIG. 14 illustrates a bookbinding process.

A case where there are eight originals to be read will be taken as an example for describing the process for forming images in the bookbinding mode. As shown in FIG. 14A, image data (R1, R2, R3, R4, R5, R6, R7, and R8) regarding the eight pages of originals has been stored in the hard disk 206 in an order in which they were read.

Figure 14B:
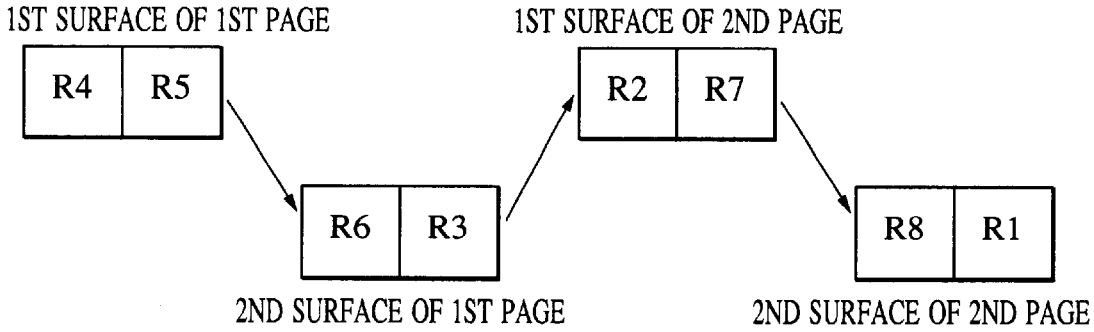

For each piece of the image data, R1 through R8, the image forming order and the image forming position are decided. Thus, as illustrated in FIG. 14B, the image of R4 is formed on a left half of a first surface (front surface) of the sheet P1 of a first page, and the image of R5 is formed on a right half thereof. The images formed on the sheets are the images that have undergone the mirror image processing set forth above.

The sheet P1 on which the images of R4 and R5 have been formed is fed to the transferring unit 116 again via a two-side copy conveying path 124. Then, the image of R6 is formed on a left half of a second surface (back surface) of the sheet P1, and the image of R3 is formed on the right half thereof. The sheet P1 carrying the images on its both surfaces is discharged as it is, namely, with its back surface facing upward, from the printer 300 and conveyed to the first bookbinding path 553 of the finisher 500.

Figure 14C:
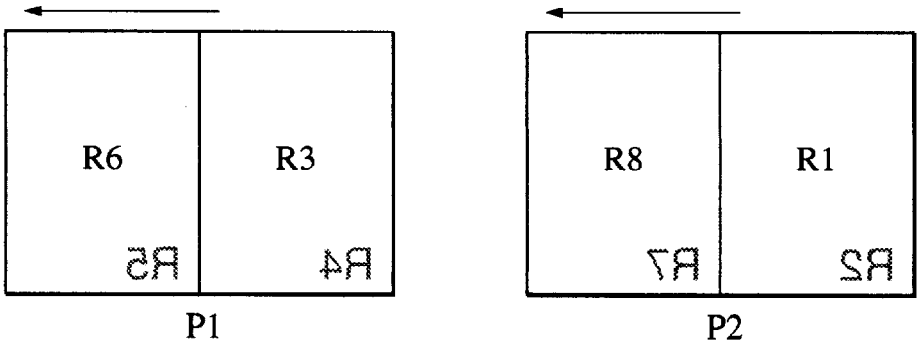

The sheet P1 is conveyed from the printer 300 to the finisher 500 in a direction of an arrow in the drawing so that its second surface, on which the images of R6 and R3 are formed, faces upward and the image of R6 is the leading end as illustrated in FIG. 14C. As shown in the drawing, the image of R5 is formed on the back side of the portion where the image of R6 is formed, and the image of R4 is formed on the back side of the portion where the image of R3 is formed.

Following the processing set forth above, the image of R2 is formed on a left half of a first surface (front surface) of the sheet P2 of a second page, and the image of R7 is formed on a right half thereof as shown in FIG. 14B. The images formed on the sheets are the images that have undergone the mirror image processing set forth above.

The sheet P2 on which the images of R2 and R7 have been formed is fed to the transferring unit 116 again via the two-side copy conveying path 124. Then, the image of R8 is formed on a left half of a second surface (back surface) of the sheet P2, and the image of R1 is formed on the right half thereof. The sheet P2 carrying the images on its two surfaces is discharged as it is, namely, with its back surface facing upward, from the printer 300 and conveyed to the first bookbinding path 553 of the finisher 500.

The sheet P2 is conveyed from the printer 300 to the finisher 500 in a direction of an arrow in the drawing so that its second surface, on which the images of R8 and R1 are formed, faces upward and the image of R8 is the leading end as illustrated in FIG. 14C. As shown in the drawing, the image of R7 is formed on the back side of the portion where the image of R8 is formed, and the image of R2 is formed on the back side of the portion where the image of R1 is formed.

Figure 14D:
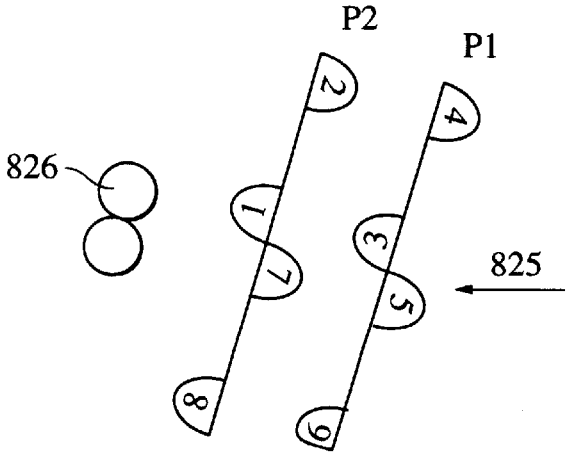

The sheets P1 and P2 are successively guided to and accommodated in the accommodating guide 820 via the first bookbinding path 553 of the finisher 500. In the accommodating guide 820, the sheet P1 is accommodated adjacently to the thrust member 825, while the sheet P2 following the sheet P1 is accommodated adjacently to the pair of folding rollers 826 as shown in FIG. 14D. In addition, the sheets are accommodated so that the first surfaces or the front surfaces of the sheets P1 and P2 face the thrust member 825. The sheets P1 and P2 are positioned in the accommodating guide 820 by the positioning member 823.

Referring now to FIG. 15 through FIG. 22, descriptions will be given of conveyance of sheets from the inserter 900 and the printer 300 to the accommodating guide 820 in the finisher 500 in the bookbinding mode. FIGS. 15 through 21 illustrate a flow of sheets from the inserter 900 and the printer 300 to the accommodating guide 820 in the finisher 500 in the bookbinding mode. FIG. 22 illustrates an example wherein binding and folding are performed for bookbinding in the finisher 500 shown in FIG. 5.

Figure 15A:
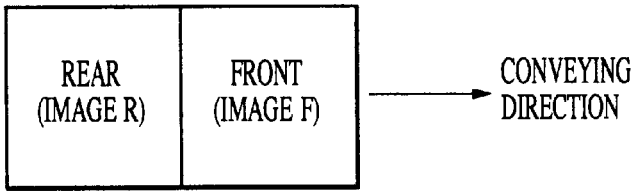
FIG. 15 illustrates flows of a sheet from an inserter and a sheet from a printer led into an accommodating guide in a finisher in a bookbinding mode.
Figure 15B:
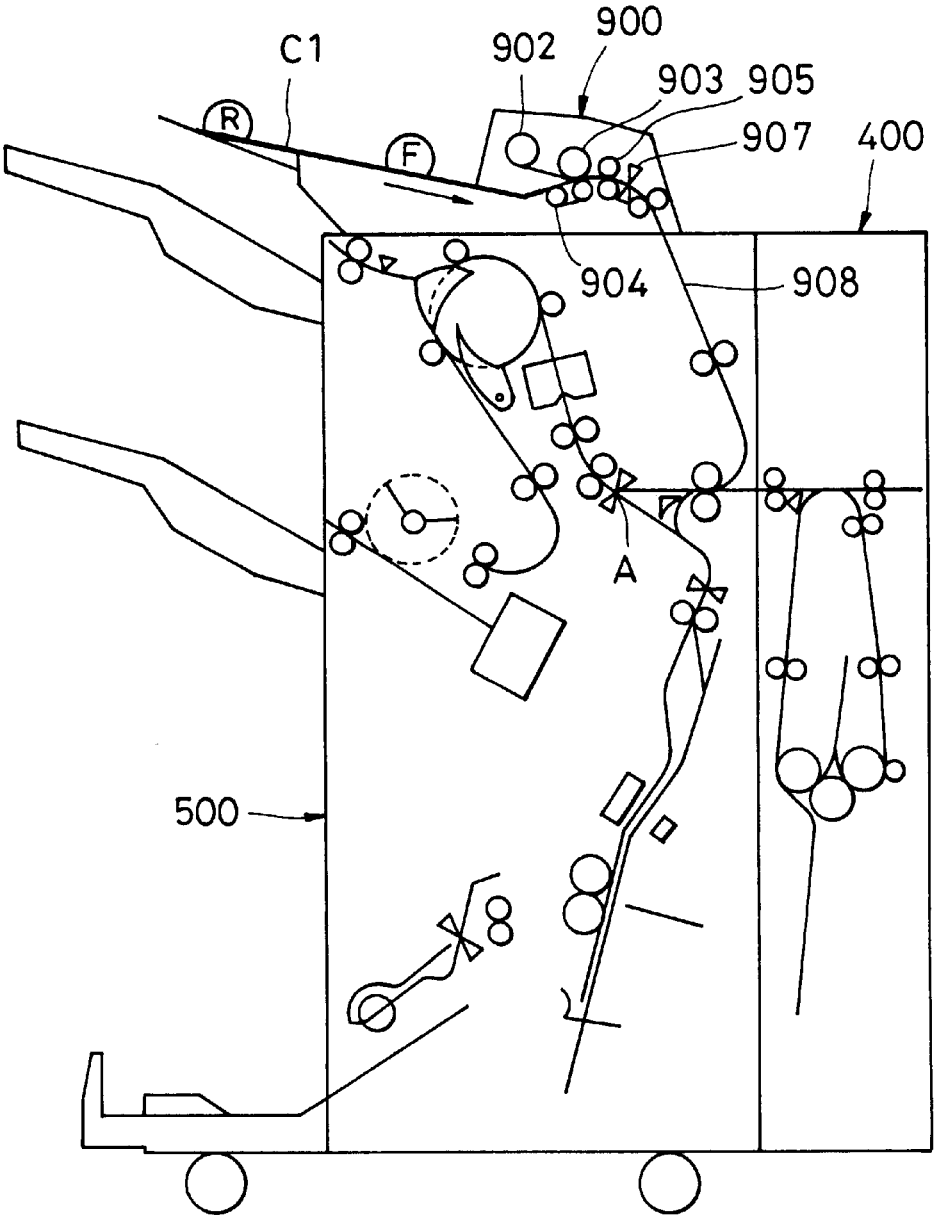
Figure 16:
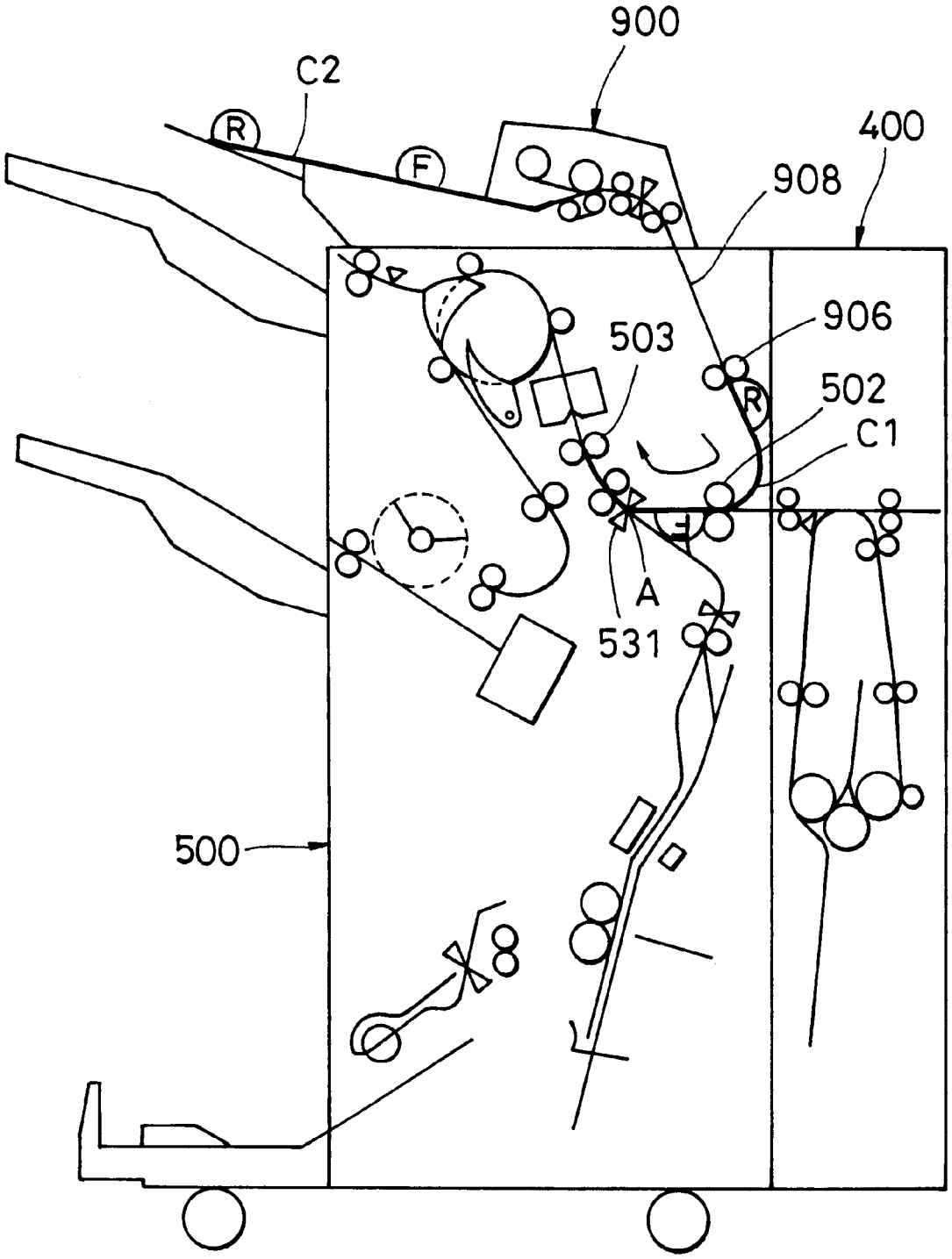
FIG. 16 illustrates the flows of the sheet from the inserter and the sheet from the printer into the accommodating guide in a finisher in a bookbinding mode.

When performing the bookbinding by inserting the sheet C1 as a cover sheet among sheets after image formation, the sheet C1 is set in the tray 901 of the inserter 900 as shown in FIG. 15B. The sheet C1 is set in the tray 901 by a user so that its surface, whereon an image R and an image F are formed, faces upward, and the sheet Cl is fed, with the image F being the leading image as shown in FIG. 15A.

More specifically, the sheet C1 is set upright and face-up as observed by the user, and a set state of the sheet (a loading direction of the sheet in relation to the tray 901) is the same as a set state of an original in the original feeder 100 (a loading direction of originals set in the tray 1001). This arrangement permits easier setting of sheets on the inserter 900.

When the user sets a bundle of sheets that includes the sheet C1 on the tray 901 and presses the start key (not shown) on the operation unit 1, feed of the sheet C1 on the top of the bundle is begun. At this time, the switching flapper 551 is changed over to the finisher path 552. The sheet C1 is guided from the conveying path 908 to the finisher path 552 via the pair of inlet rollers. When the leading edge of the sheet C1 is detected by the inlet sensor 531, feed of a sheet, namely, the sheet P1 shown in FIG. 17, from the printer 300 is begun.

Figure 17:
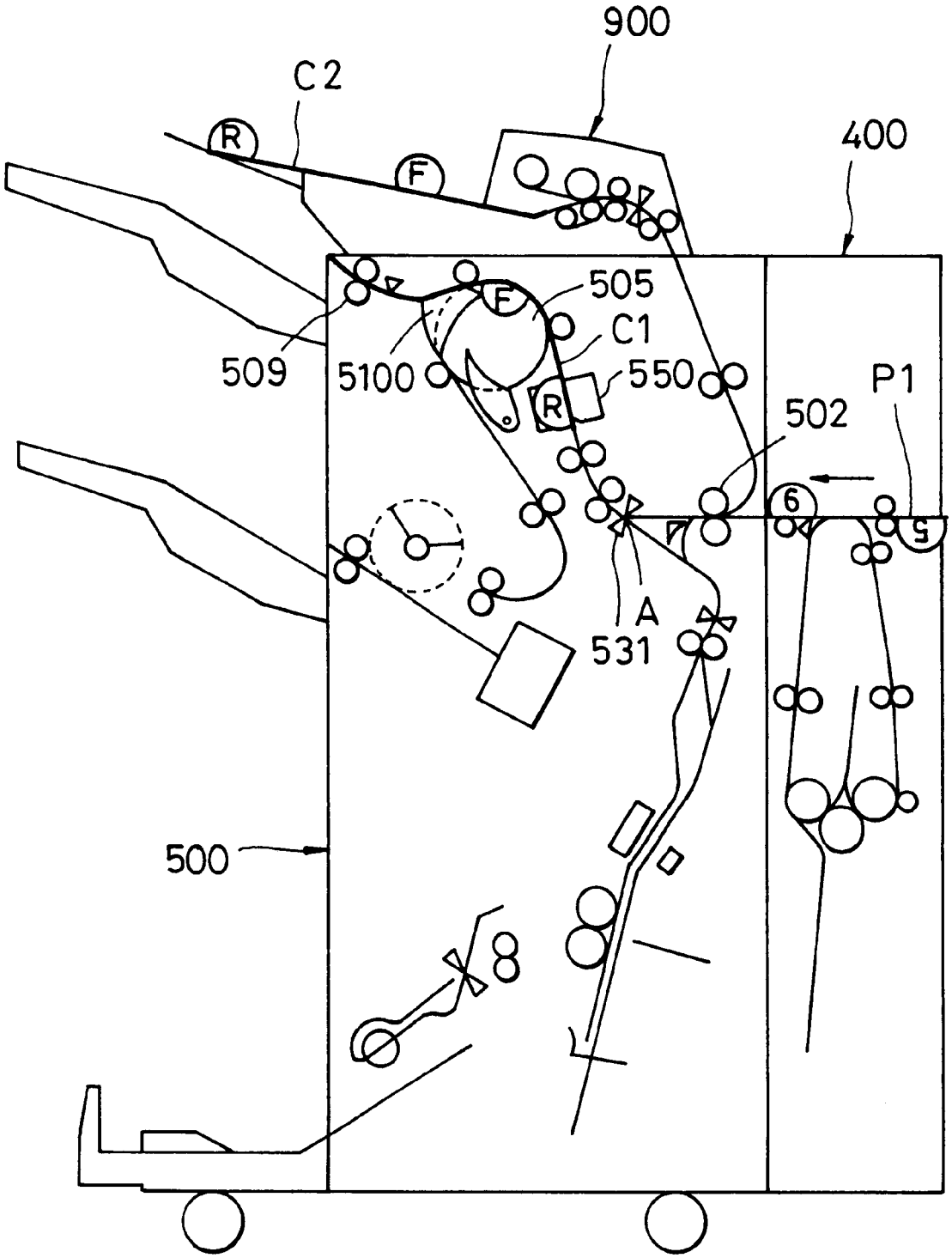
FIG. 17 illustrates the flows of the sheet from the inserter and the sheet from the printer into the accommodating guide in the finisher in the bookbinding mode.

Referring to FIG. 17, the switching flapper 5100 has been changed over to the non-sorting path 521. The sheet C1 is guided to the non-sorting path 521 via the buffer roller 505, and the sheet P1 conveyed from the printer 300 is guided into the finisher.

When the sheet C1 is guided to the non-sorting path 521 and the trailing edge of the sheet reaches a position for passing the inlet sensor 531, the conveyance of the sheet C1 is temporarily stopped as shown in FIG. 17. The sheet C1 is stopped at a position where the sheet C1 is not driven at least by the pair of inlet rollers 502.

Figure 18:
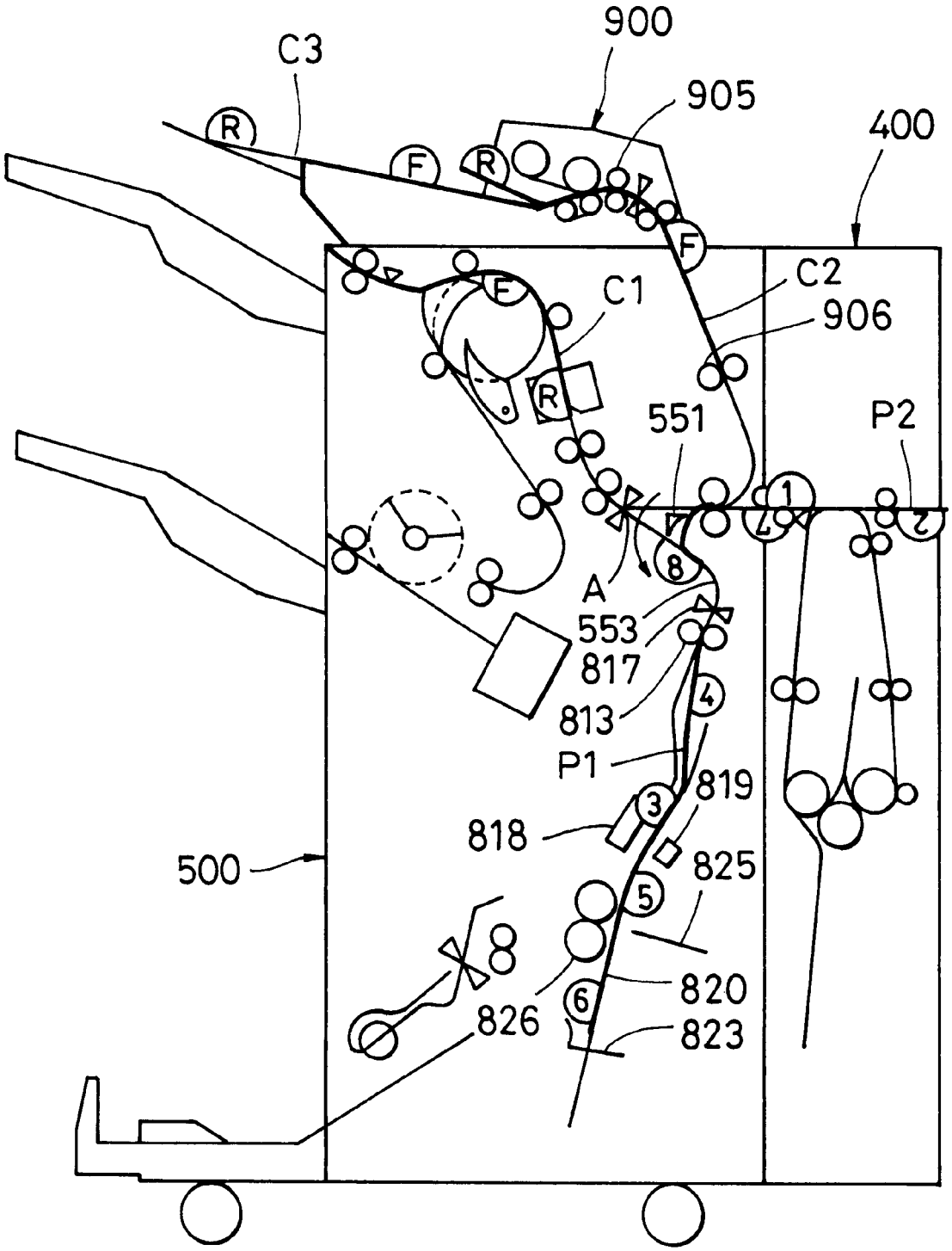
FIG. 18 illustrates the flows of the sheet from the inserter and the sheet from the printer into the accommodating guide in the finisher in the bookbinding mode.

The sheet P1 from the printer 300 has been led into the finisher 500. When the conveyance of the sheet C1 is stopped, the sheet P1 is guided to the first bookbinding path 553 by the switching flapper 551 and placed in the accommodating guide 820 as shown in FIG. 18. Following the sheet P1, the sheet P2 is guided to the first bookbinding path 553.

In this embodiment, a description has been given of the example where a total of three sheets, consisting of the sheet C1 from the inserter 900 and the sheets P1 and P2 from the printer 300, are bound as a set. If, however, a second set is output, then the sheet C2 following the sheet C1 is separated from the bundle of sheets set in the tray 901 of the inserter 900 and conveyed at the point when the sheet P2 is guided to the first bookbinding path 553. The sheet C2 separated by the separator of the inserter 900 is carried to a position before the pair of conveying rollers 906 and held at the position (before the pair of conveying rollers 906) in a standby state until all the sheets P1, P2, and C1 are all accommodated in the accommodating guide 820.

Figure 19:
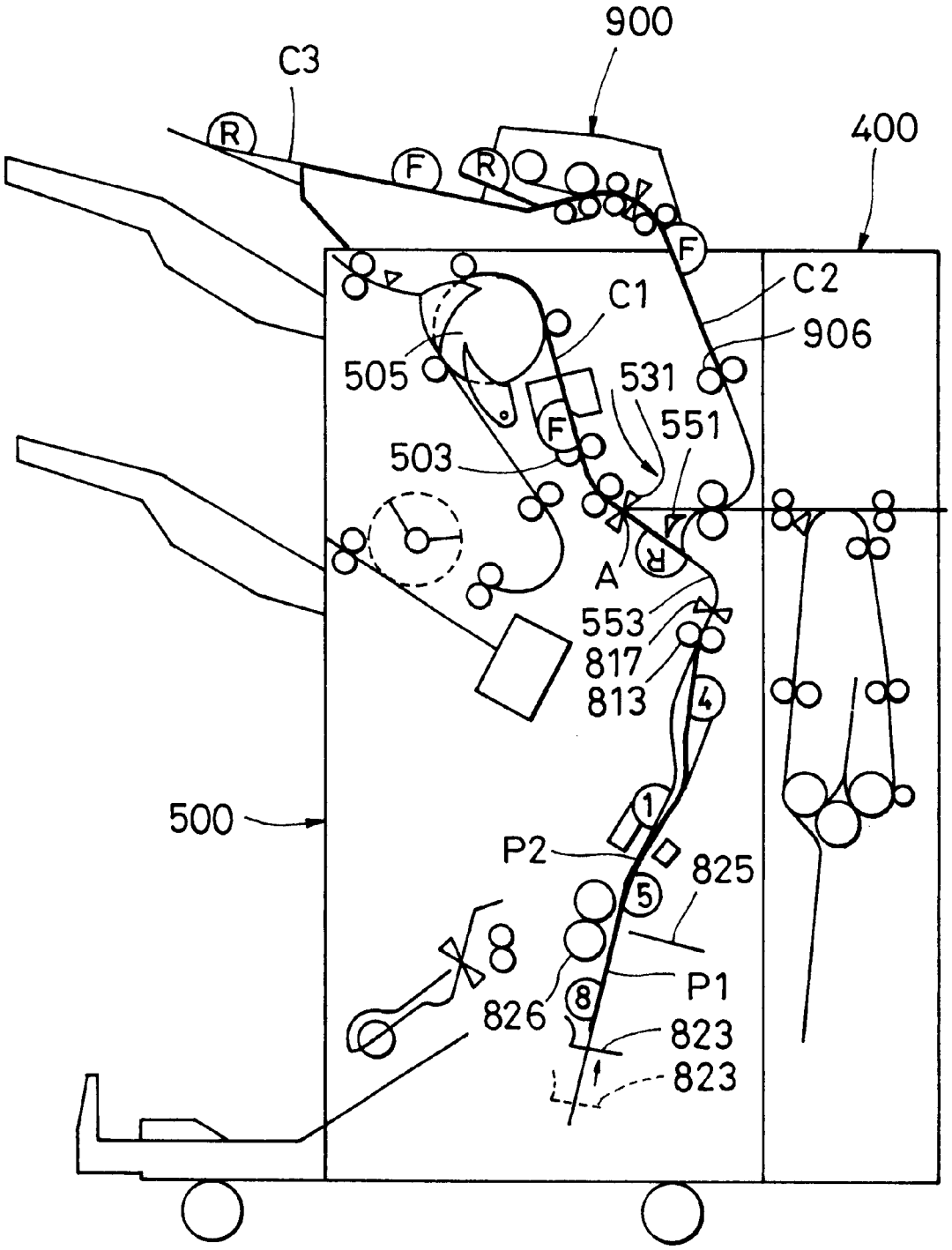
FIG. 19 illustrates the flows of the sheet from the inserter and the sheet from the printer into the accommodating guide in the finisher in the bookbinding mode.

As soon as the sheets P1 and P2 are placed in the accommodating guide 820, the conveyance of the sheet C1 is started. More specifically, as shown in FIG. 19, the sheet C1 is switched back and fed to the accommodating tray 820, then led to the accommodating guide 820 via a branch point A and the second bookbinding path 554. The sheets P1 and P2 are placed in the accommodating guide 820 in a state illustrated in FIG. 14D.

Figure 20:
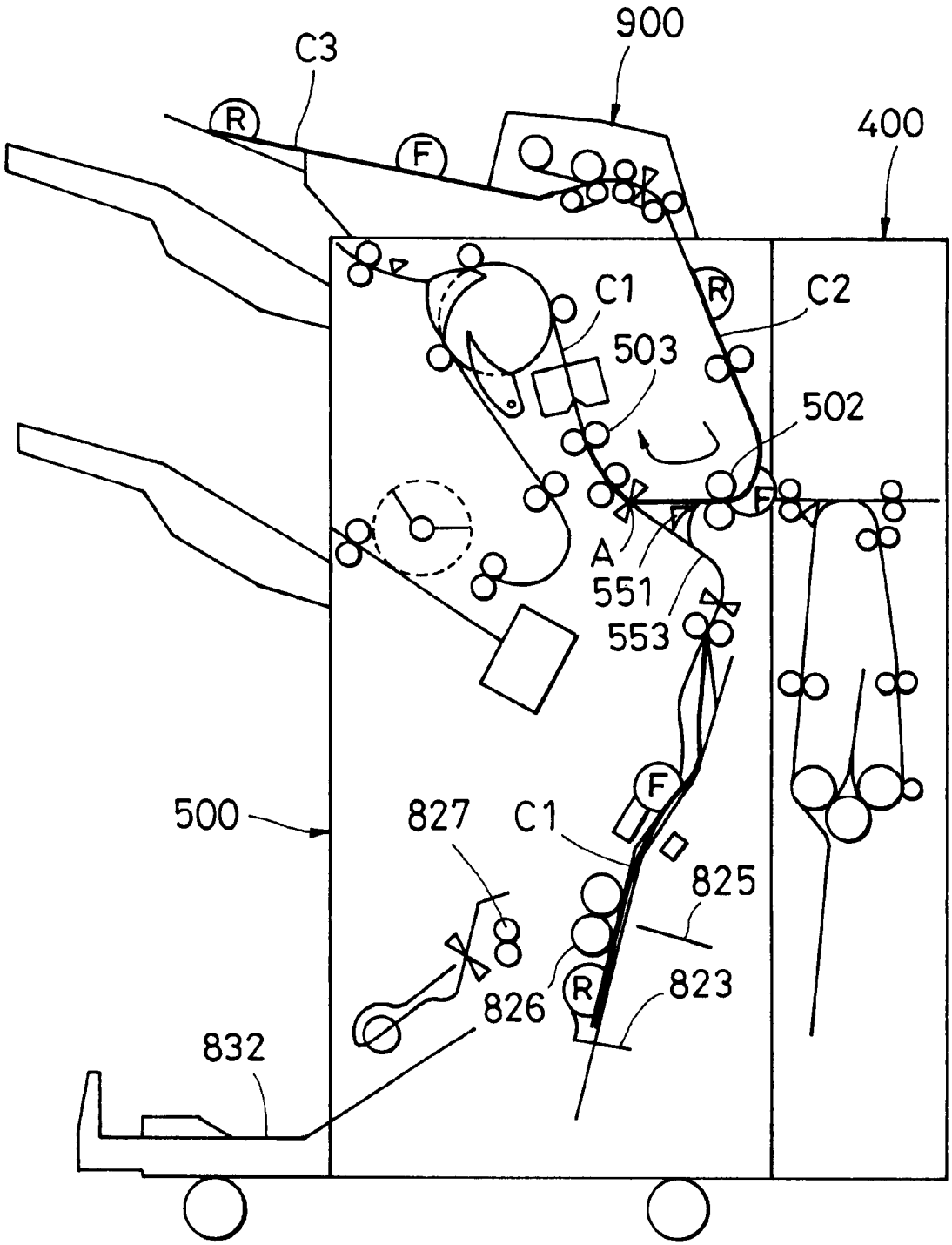
FIG. 20 illustrates the flows of the sheet from the inserter and the sheet from the printer into the accommodating guide in the finisher in the bookbinding mode.

At this time, as shown in FIG. 20, since the sheet C1 is switchback-fed, the sheet C1 is conveyed with its image R end as the leading edge, and stacked over the bundle of sheets consisting of the sheets P1 and P2b that have already been placed in the accommodating guide 820.

Figure 21:
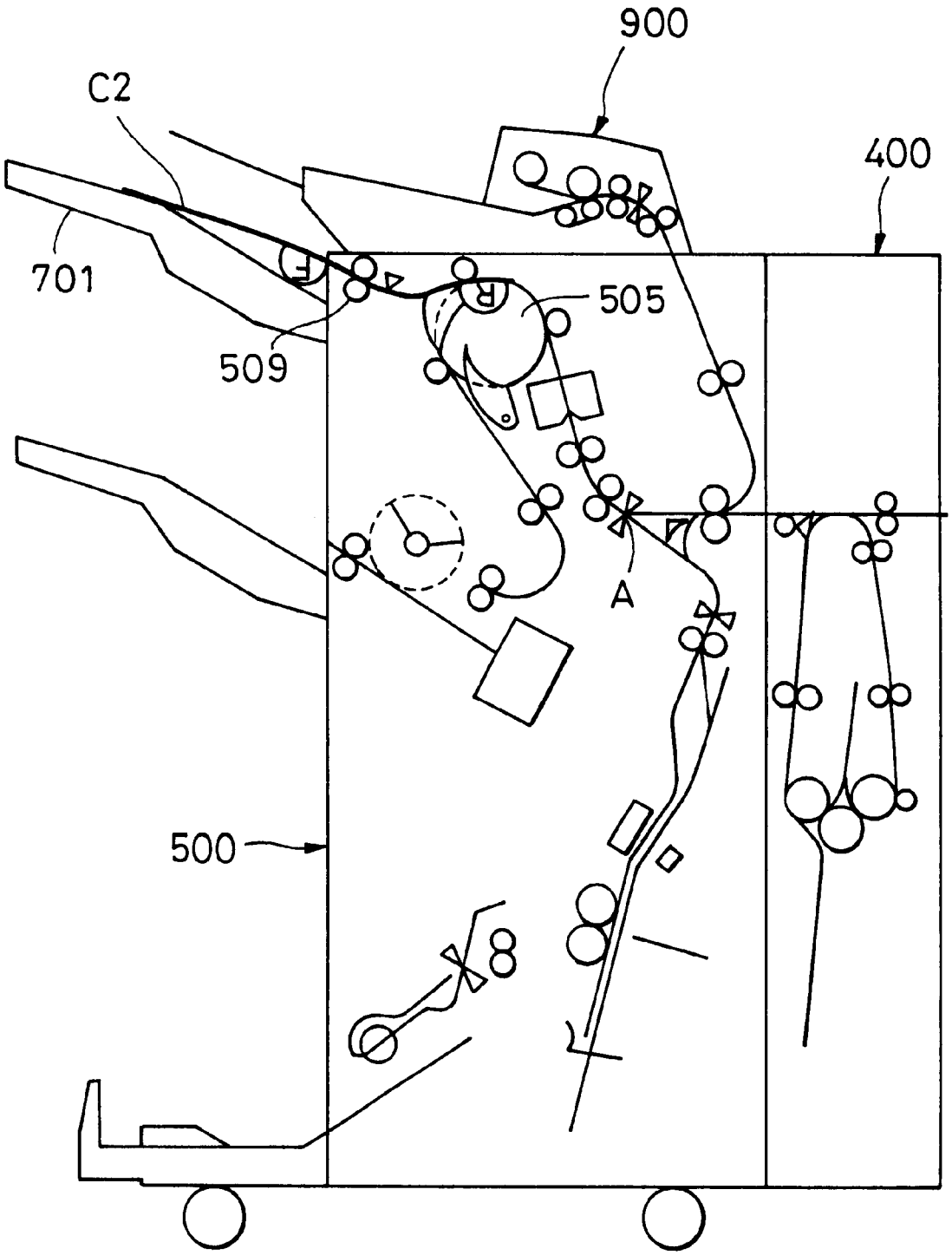
FIG. 21 illustrates the flows of the sheet from the inserter and the sheet from the printer into the accommodating guide in the finisher in the bookbinding mode.

When the second set is output, as soon as the sheet C1 is placed in the accommodating guide 820, the conveyance of the sheet C2 is restarted to carry the sheet C2 following the sheet C1 to the buffer roller 505. If the sheet C2 is an improper sheet having, for example, a size different from a predetermined size, then the sheet C2 is directly discharged to the sample tray 701 as shown in FIG. 21. In such a case, the conveyance of the sheet C2 is immediately discharged onto the sample tray 701 via the buffer roller 505 without interrupting the conveyance of the sheet C2 in a state illustrated in FIG. 18.

Figure 22A:
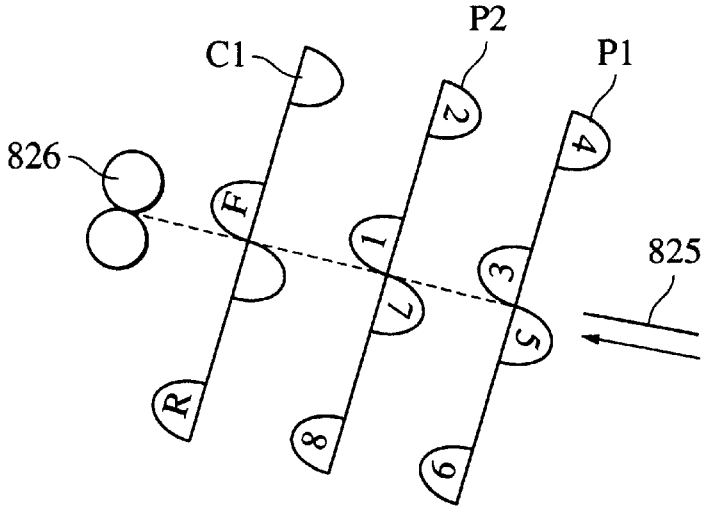
FIG. 22 illustrates the flows of the sheet from the inserter and the sheet from the printer into the accommodating guide in the finisher in the bookbinding mode.

Referring to FIG. 22A, after the sheet C1 is placed in the accommodating guide 820, the thrust member 825 is thrust to the bundle of sheets composed of the sheets C1, P1, and P2 to push out the bundle of sheets to the pair of folding rollers 826. The bundle of sheets pushed out to the pair of folding rollers 826 is folded at its central portion (an image boundary portion of image surface) by the pair of folding rollers 826, and discharged to a saddle discharge tray 832.

Figure 22B:
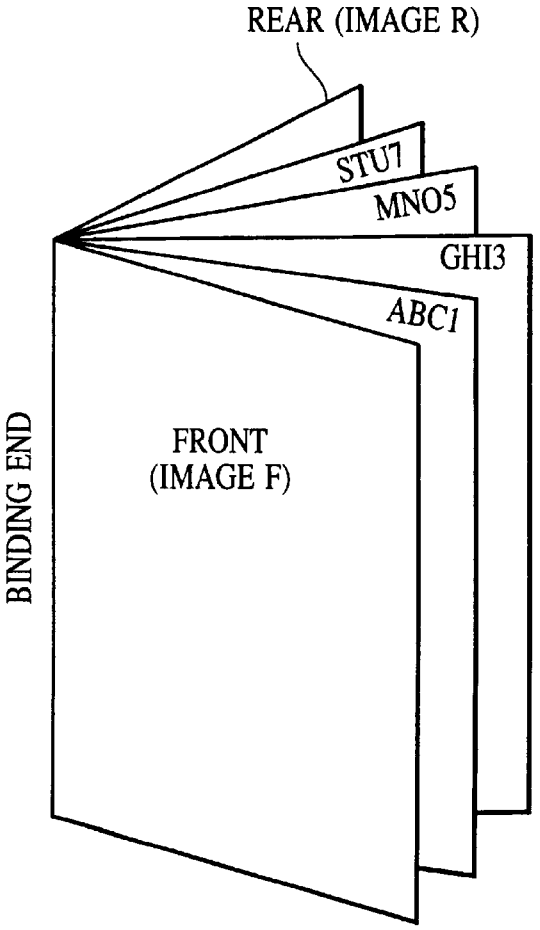

The bundle of sheets folded as described above has the image F of the sheet C1 as the cover sheet and the image R of the sheet C1 as the last page as shown in FIG. 22B. The images of the sheets P1 and P2 are arranged in the order of pages, and the orientations of the images of the sheets C1, P1, and P2 are all the same.

Thus, in the case wherein the bookbinding is performed on a bundle of sheets composed of a plurality of sheets, the feed control of the sheets from the inserter 900 and the conveyance control of the sheets from the printer 300 make it possible to place images of a sheet from the inserter 900 (the sheet C1 in this case) on a leading page and a last page, arrange images of a plurality of sheets from the printer 300 (the sheets P1 and P2 in this case) in the order of pages, and match the orientations of the images.

It is also possible to bind the bundle of sheets formed of the sheet C1 and the sheets P1 and P2 at a central portion thereof by the staplers 818 while the sheet C1 is in the accommodating guide 820. In this case, as shown in FIG. 22B, the left edge of the bound bundle of sheets is the binding edge.

Referring now to FIG. 23 through FIG. 29, processing for drive control of the finisher 500 will be described.

Figure 23:
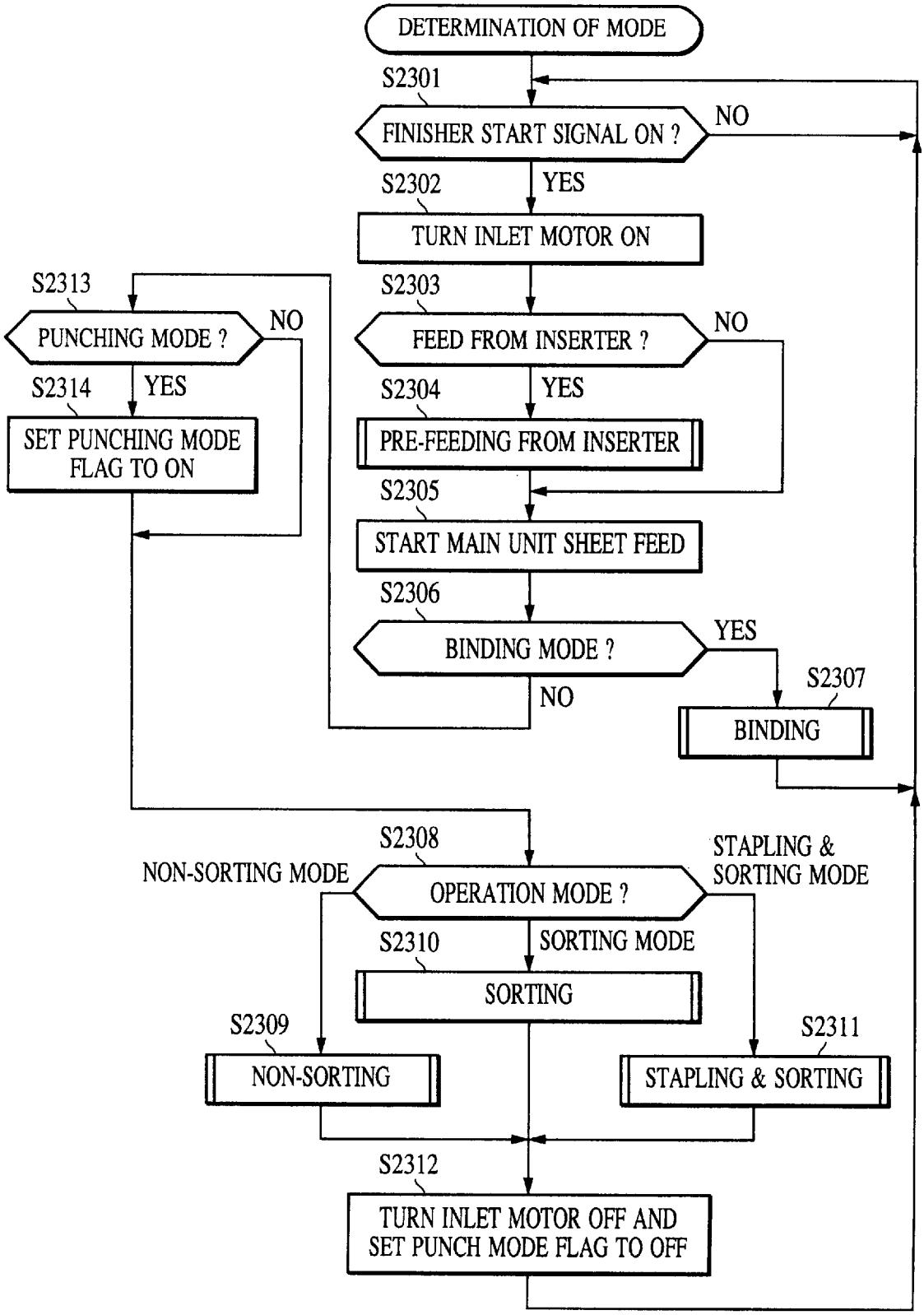
FIG. 23 shows a flowchart that illustrates processing for determining an operation mode.

FIG. 23 is a flowchart illustrating processing for determining an operation mode of the finisher 500. The processing is implemented by the CPU circuitry 510 in the finisher control unit 501 according to instructions from the CPU circuitry 150.

First, the program determines whether a finisher start signal for instructing the finisher 500 to start operation has been supplied to the finisher control unit 501 (step S2301). Processing in the step S2301 is repeated until a start key on the operation unit 1 for instructing a start of copying is pressed by a user, and the finisher start signal is supplied from the CPU circuitry 150 to the finisher control unit 501.

If the program determines in the step S2301 that the finisher start signal has been supplied to the finisher control unit 501, then drive of the inlet motor M1 is started (step S2302). Then, based on data from the communication IC 514, the program determines whether there is a feed request to the inserter 900 (step S2303). The feed request to the inserter 900 is issued to the finisher control unit 501 when the inserter is selected by a user on a setting screen displayed on the display panel of the operation unit 1 shown in FIG. 7B.

If it is determined in the step S2303 that there is the feed request to the inserter 900, then pre-feeding from the inserter is performed in a step S2304. The pre-feeding from the inserter performed in the step S2304 will be discussed in detail hereinafter with reference to FIG. 29.

If it is determined in the step S2303 that there is no feed request to the inserter 900, or if the pre-feeding from the inserter has been completed in the step S2304, then a feed signal is output to the CPU circuitry 150 of the copying apparatus main unit 1000 via the communication IC 514 in a step S2305. Upon receipt of the feed signal, the CPU circuitry 150 starts image formation.

Then, based on data regarding a post processing mode received from the CPU circuitry 150 via the communication IC 514, it is determined whether the operation mode set at the operation unit 1 is the bookbinding mode or not in a step S2306. The operation mode setting is carried out by a user on the operation mode setting screen displayed on the display panel of the operation unit 1 shown in FIG. 7A.

If it is determined in the step S2306 that the set operation mode is the bookbinding mode, then the bookbinding is performed in a step S2307. The bookbinding implemented in the step S2307 will be explained in detail hereinafter in conjunction with FIG. 28. Upon completion of the bookbinding in the step S2307, the program returns to step S1.

If it is determined in the step S2306 that the set operation mode is not the bookbinding mode, then it is determined in a step S2313 whether the user has set the punching mode on the post processing menu screen shown in FIG. 7A. If it is determined that the punching mode has been set, then a punching mode flag is set to ON in a step S2314, and the program proceeds to step S2308. If it is determined that the punching mode has not been set, then the program directly proceeds to the step S2308. In the step S2308, it is determined whether the set operation mode is the non-sorting mode, the sorting mode, or the stapling and sorting mode.

If it is determined in the step S2308 that the set operation mode is the non-sorting mode, then the non-sorting is carried out in a step S2309. The non-sorting of the step S2309 will be discussed in detail hereinafter with reference to FIG. 25.

If it is determined in the step S2308 that the set operation mode is the sorting mode, then the sorting is carried out in a step S2310. The sorting of the step S2310 will be explained in detail hereinafter with reference to FIG. 26.

If it is determined in the step S2308 that the set operation mode is the stapling and sorting mode, then the stapling and sorting is carried out in a step S2311. The stapling and sorting of the step S2311 will be explained in detail hereinafter with reference to FIG. 27.

If the non-sorting has been completed in the step S2309, the sorting has been completed in the step S2310, or the stapling and sorting has been completed in the step S2311, then the drive of the inlet motor M1 is stopped, and if the punching mode flag has been set to ON in the step S2314, then the punching mode flag is set to OFF in a step S2312. The program returns to the step S1 to wait for an input of the finisher start signal.

When any of the processing of the step S2307, the step S2309, the step S2310, or the step S2311 is performed, if it is determined in the step S2303 that there is the feed request to the inserter 900, then the pre-feeding from the inserter of the step S2304 is carried out first before implementing any of the above processing.

Figure 24:
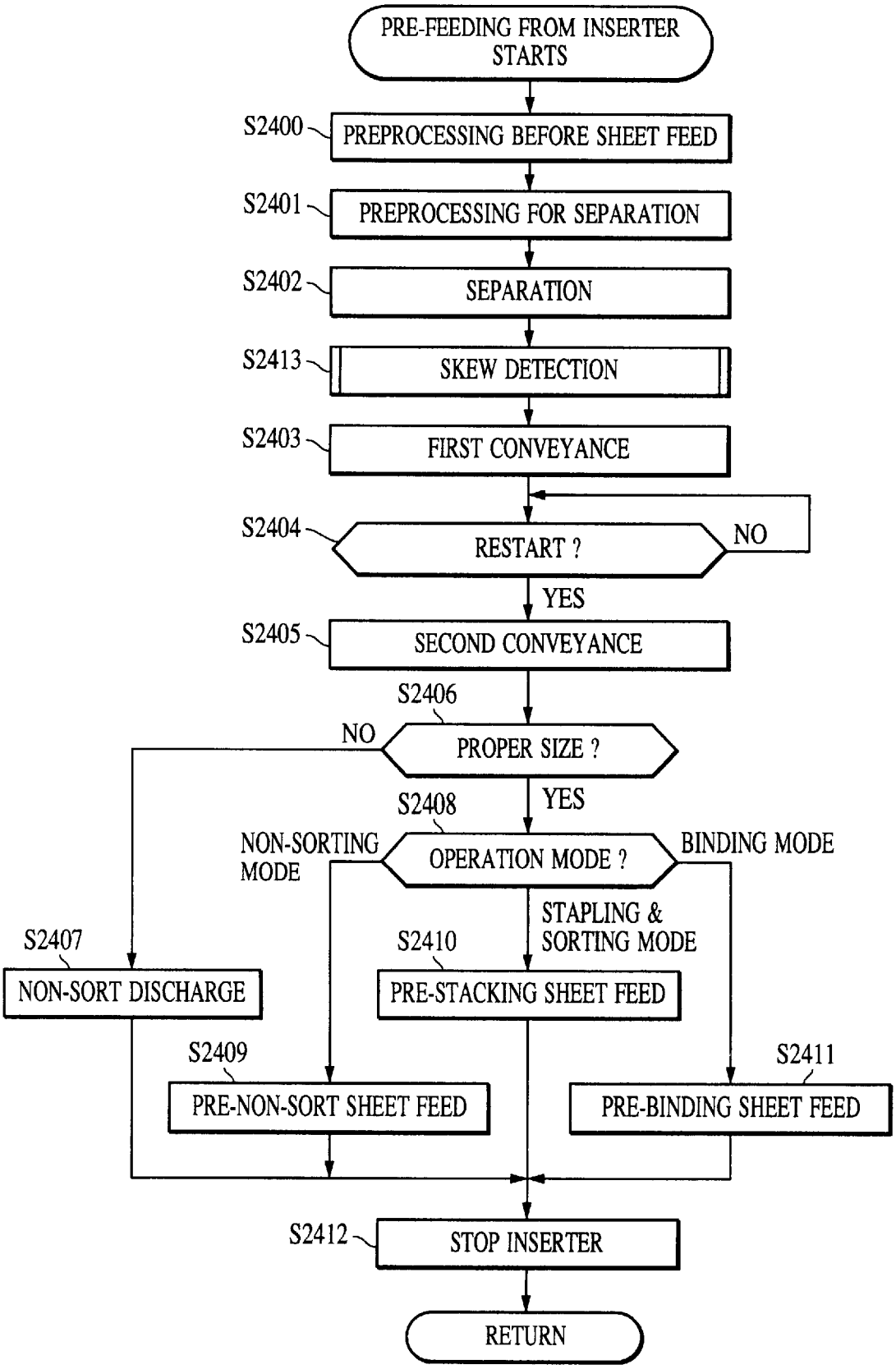
FIG. 24 shows a flowchart that illustrates pre-feeding from the inserter.

Referring now to FIG. 24, the pre-feeding from the inserter 900 carried out in the step S2304 will be explained in detail. FIG. 24 is a flowchart for explaining the details of the pre-feeding from the inserter 900 in the step S2304 of FIG. 23. This processing is implemented by the CPU circuitry 510 in the finisher control unit 501 if it is determined in the step S2303 of FIG. 23 that there is a feed request to the inserter 900.

In the pre-feeding from the inserter, pre-feeding check is conducted first in a step S2400. In the step S2400, the program checks for sheets on the tray 901 of the inserter 900 and also checks information regarding sheet designation data or the like from the operation unit 1, and sends an image formation inhibiting signal to the CPU circuitry 150 of the copying apparatus main unit 1000.

In the step S2400, the program performs the pre-feeding check and if it determines that a feeding condition for feeding a sheet from the inserter 900 is satisfied, then preprocessing for separation is performed in a step S2401. In the preprocessing for separation, the shutter solenoid SL20 shown in FIG. 6 is turned ON to open a feed shutter (not shown) of the inserter 900, then the pickup solenoid SL21 is turned ON to cause the feeding roller 902 to lower and land on a sheet on the tray 901. Furthermore, the clutch CL10 is turned ON to transmit a driving force of the feeding motor M20 to the feeding roller 902.

Upon completion of the processing of the step S2401, the drive of the feeding motor M20 is started in a predetermined time, and the separating roller 903, the separating belt 904, and the pair of drawing rollers 905 in the inserter 900 are rotated in a step S2402. The processing of the step S2402 separates the top sheet (a sheet C1 in t his embodiment) of the bundle of sheets (the bundle of sheets C in this embodiment) and conveys the sheet C1 to the conveying path 908.

After the processing of the step S2402, skew detection is performed in a step S2413. The skew detection will be discussed in detail hereinafter in conjunction with FIG. 31.

Subsequently, first conveyance is performed in a step S2403. In the processing of the step S2403, the conveyance of the sheet C1 is monitored by the feed sensor 907. When the leading edge of the sheet C1 is detected by the feed sensor 907, the clutch CL10 is turned OFF, and counting of clocks from a clock sensor provided in the feeding motor M20 is begun. When a count value reaches a predetermined value (hereinafter referred to as "N1"), the drive of the feeding motor M20 is stopped. The counting is continued until the trailing edge of the sheet C1 is detected by the feed sensor 907.

The processing of the step S2403 is carried out to temporarily stop the sheet conveyed via the pair of drawing rollers 905 from the inserter 900 at a position before the pair of conveying rollers 906 (see FIG. 18).

It is checked in a step S2404 whether there is another feed request for the sheet C1 to the inserter 900 from the CPU circuitry 150 of the copying apparatus main unit 1000. The processing of the step S2404 is repeated until another feed request for the sheet C1 is issued to the CPU circuitry 510 of the finisher control unit 501 from the CPU circuitry 150 of the copying apparatus main unit 1000.

If it is determined in the step S2404 that there is another feed request for the sheet C1, then a second conveyance is performed in a step S2405. In the processing of the step S2405, the drive of the feeding motor M20 is restarted to lead the sheet C1 stopped at the position before the pair of conveying rollers 906 to the pair of inlet rollers 502, and the buffer motor M2 and the sheet discharging motor M3 are also driven. As soon as the feed sensor 907 detects the trailing edge of the sheet C1, the counting that was begun in the processing of the step S2403 is terminated. Based on a value counted from the start to the end of the counting, a conveying direction and length of the sheet C1 are calculated.

Next, based on the conveying direction and length of the sheet C1 calculated in the step S2405 and the data regarding a specified size acquired in the step S2400 described above, it is determined in step S2406 whether the sheet C1 from the inserter 900 has an appropriate size.

If it is determined in the step S2406 that the size of the sheet C1 from the inserter 900 is not appropriate, then the switching flapper 5100 is changed over to the non-sorting path 521 to discharge the sheet C1 onto the sample tray 701 via the non-sorting path 521. At the same time, the fact that a sheet of an inappropriate size has been conveyed from the inserter 900 is reported to the CPU circuitry 150 of the copying apparatus main unit 1000 in a step S2407. Then, the program stops the inserter in a step S2412 to terminate the processing, and proceeds to the step S2305 of FIG. 23 set forth above.

In the step S2412, the program clears the image formation inhibiting signal sent out to the CPU circuitry 150 in the step S2400, and stops the drive of the feeding motor M20. The sheet set sensor 910 detects whether there is a sheet on the tray 901 of the inserter 900. If there is still a sheet on the tray 901, then the shutter solenoid SL20 is held ON.

If it is determined in the step S2406 that the size of the sheet C1 from the inserter 900 is appropriate, then the operation mode set at the operation unit 1 is determined in a step S2408.

If it is determined in the step S2408 that the operation mode is the non-sorting mode, then the pre-non-sort sheet feed is performed in a step S2409. Processing carried out in the step S2409 discharges the sheet C1 from the inserter 900 onto the sample tray 701. Upon completion of the processing of the step S2409, the program proceeds to the step S2412.

If it is determined in the step S2408 that the operation mode is the sorting mode or the stapling mode, then the program implements pre-stacking sheet feed in a step S2410, and proceeds to the step S2412.

The processing in the step S2410 changes the switching flappers 5100 and 5110 over to the sorting path 522 to guide the sheet C1 to the processing tray 630. The sheet C1 from the inserter 900 is stacked on the processing tray 630 with its image-carrying surface facing downward. On the processing tray 630, the sheets are aligned. The bookbinding can be performed by binding with the stapler 601 a bundle of sheets formed of a plurality of sheets stacked on the tray.

If it is determined in the step S2408 that the operation mode is the bookbinding mode, then pre-binding sheet feed is carried out in a step S2411. The processing in the step S2411 changes the switching flapper 5100 over to the non-sorting path 521, and carries the sheet C1 until the leading edge thereof reaches the non-sorting path 521 (refer to FIG. 17). When it is detected that the trailing edge of the sheet C1 has passed the pair of conveying rollers 503, the program stops the drive of the buffer motor M2 and the sheet discharging motor M3, and places the sheet C1 in a standby state in the non-sorting path 521. In the bookbinding mode of this embodiment, the sheet C1 from the inserter 900 is temporarily placed in the standby state in the non-sorting path 521. The position at which sheet C1 from the inserter 900 is temporarily stopped is such that the trailing edge of the sheet C1 has left the pair of conveying rollers 503, so that the sheet C1 is no longer subjected to a conveying force exerted by the pair of conveying rollers 503. After performing the processing of the step S2411, the program proceeds to the step S2412.

The pre-feeding from the inserter shown in FIG. 24 is performed to convey a sheet from the inserter 900 to the finisher 500 prior to the conveyance of a sheet from the printer 300 to the finisher 500. Especially in the cover sheet mode, the processing primarily implemented in the step S2406 allows a size of a cover sheet in advance, making it possible to minimize chances of system failures caused by mismatch between the size of a sheet from the inserter 900 and the size of a sheet from the printer 300.

Figure 25:
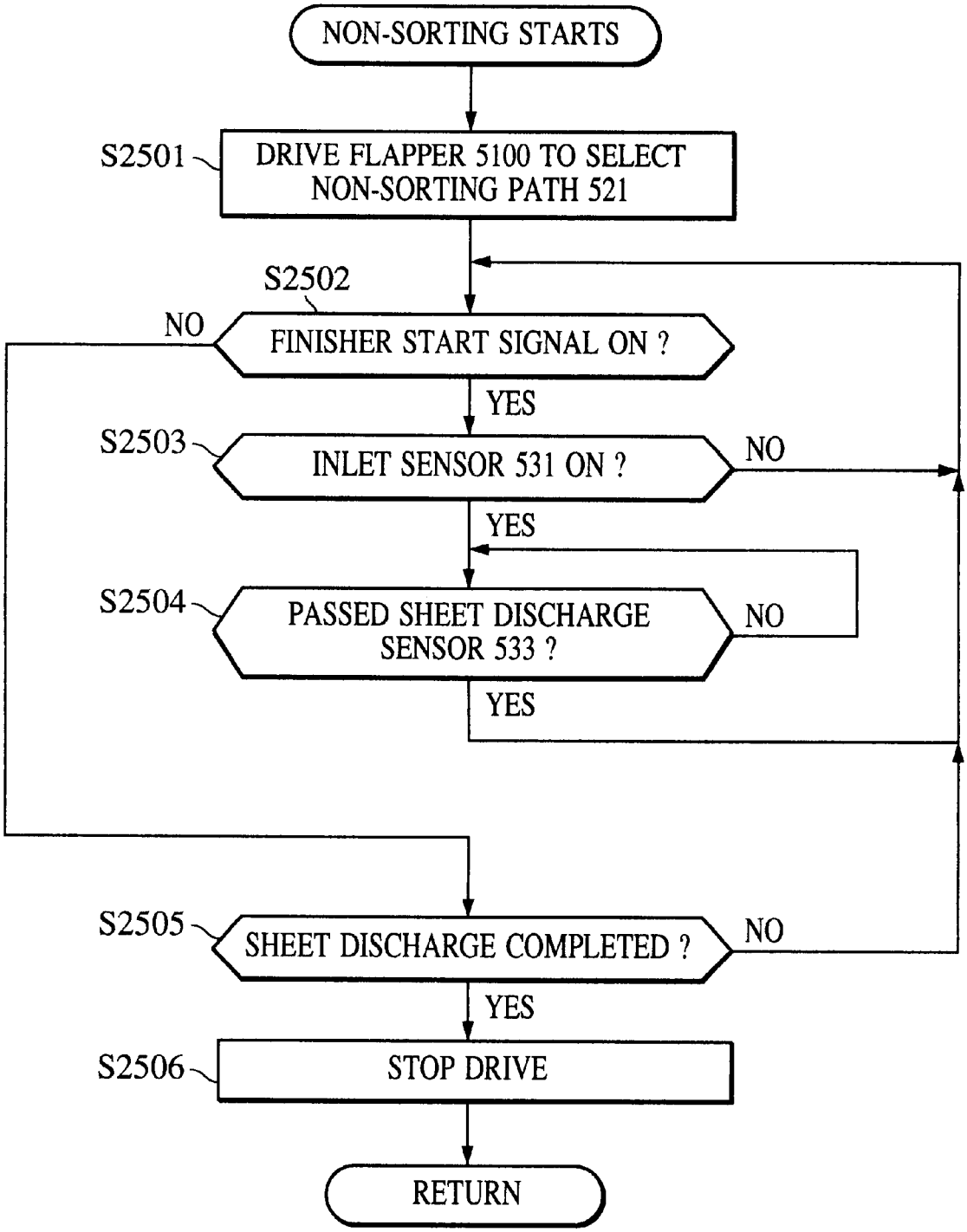
FIG. 25 shows a flowchart that illustrates a non-sorting process.

Referring now to a flowchart of FIG. 25, the non-sorting of the step S2309 of FIG. 23 will be described. This processing is implemented when it is determined in the step S2308 of FIG. 23 that the operation mode is the non-sorting mode.

In the non-sorting mode, the switching flapper 5100 is first driven to discharge a sheet onto the sample tray 701 (see FIG. 5), and the switching flapper 5100 is changed over to the non-sorting path 521 in a step S2501. At this time, the switching flapper 551 has been changed over to the finisher path 552.

Then, it is determined in a step S2502 whether or not the finisher start signal for the finisher 500 is ON. The processing of the step S2502 is performed to check whether or not a sheet is conveyed from the printer 300 to the finisher 500. If it is determined in the step S2502 that the finisher start signal is ON, then it is checked to determine whether the inlet sensor 531 is ON in a step S2503.

In the step S2503, it is detected whether or not a sheet has been conveyed from the printer 300 into the finisher 500. When the leading edge of the sheet conveyed from the printer 300 reaches a position where the inlet sensor 531 is disposed, the sensor 531 turns ON. The inlet sensor 531 stays ON until the sheet completely passes the sensor 531, that is, until the trailing edge of the sheet leaves the sensor 531.

If it is determined in the step S2503 that the inlet sensor 531 is not ON, then the program returns to the step S2502. If it is determined in the step S2503 that the inlet sensor 531 is ON, then the program starts the buffer motor M2 and the sheet discharging motor M3, and stands by in a step S2504 until the sheet discharge sensor 533 turns OFF, that is, until the sheet completely passes the sensor 533. When the sheet discharge sensor 533 turns OFF, the program returns to the step S2502.

If it is determined in the step S2502 that the finisher start signal is OFF, then it is checked in a step S2505 to determine whether or not all sheets from the printer 300 have been discharged onto the sample tray 701. If it is determined in the step S2505 that all sheets from the printer 300 have not been discharged onto the sample tray 701, then the program returns to the step S2502.

If it is determined in the step S2505 that all sheets from the printer 300 have been discharged onto the sample tray 701, then the program stops the drive of the switching flapper 5100, the buffer motor M2, and the sheet discharging motor M3 in a step S2506, and terminates the processing. After terminating the processing, the program proceeds to the step S2312 shown in FIG. 23.

Figure 26:
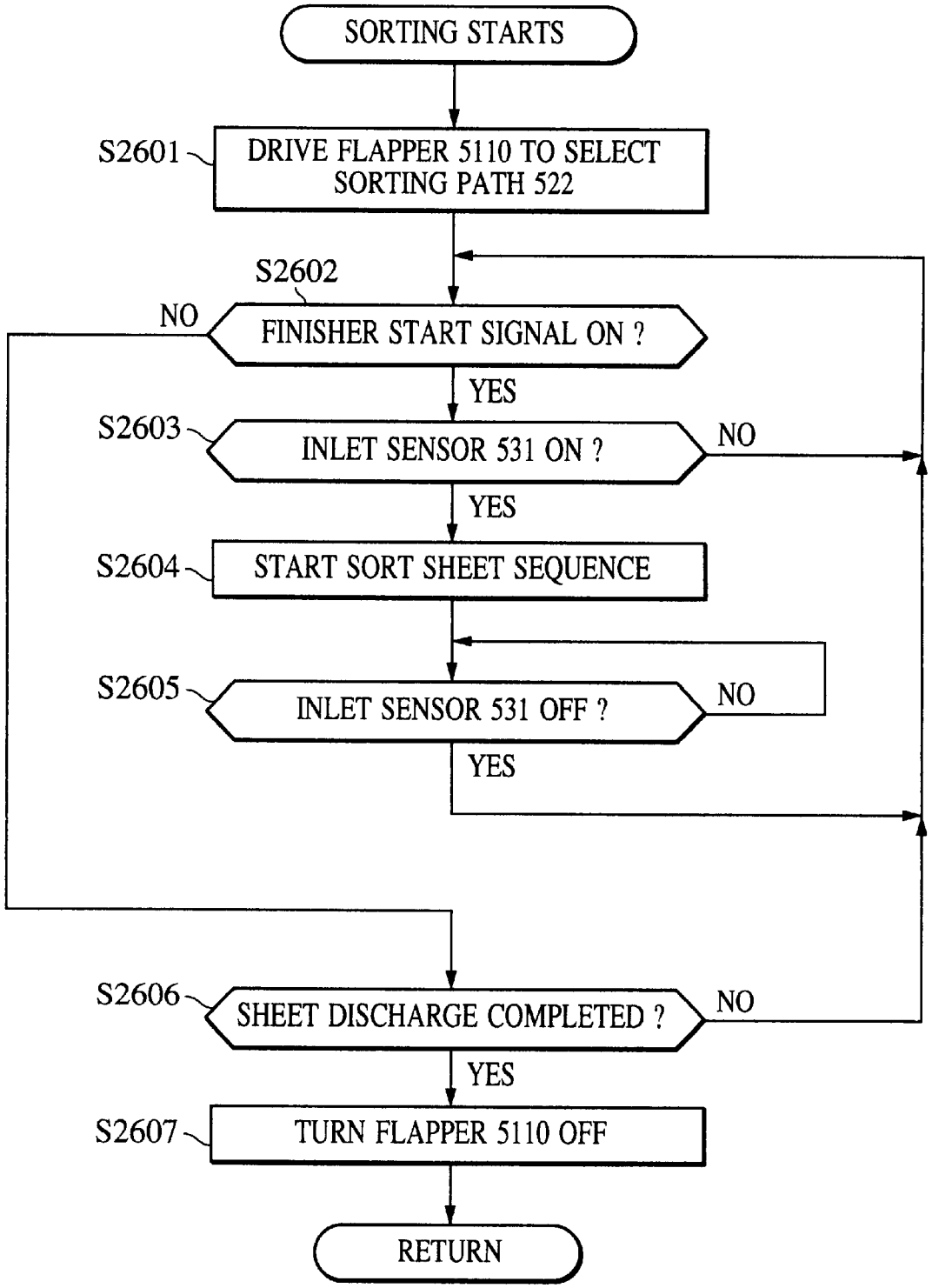
FIG. 26 shows a flowchart that illustrates a sorting process.

Referring now to a flowchart of FIG. 26, the sorting of the step S2310 of FIG. 23 will be described. The processing is performed when it is determined in the step S2308 of FIG. 23 that the operation mode is the sorting mode.

In the sorting process, the switching flapper 5110 is first driven to convey a sheet onto the processing tray 630 (see FIG. 5), and the switching flapper 5110 is changed over to the sorting path 522 in a step S2601. At this time, the switching flapper 551 has been changed over to the finisher path 552.

Then, it is determined in a step S2602 whether the finisher start signal for the finisher 500 is ON or not. The processing of the step S2602 is performed to check whether or not a sheet is conveyed from the printer 300 to the finisher 500. If it is determined in the step S2602 that the finisher start signal is ON, then it is checked whether the inlet sensor 531 is ON or not in a step S2603.

In the step S2603, it is detected whether or not a sheet has been conveyed from the printer 300 into the finisher 500. When the leading edge of the sheet conveyed from the printer 300 reaches a position where the inlet sensor 531 is disposed, the sensor 531 turns ON. The inlet sensor 531 stays ON until the sheet completely passes the sensor 531, that is, until the trailing edge of the sheet leaves the sensor 531.

If it is determined in the step S2603 that the inlet sensor 531 is not ON, then the program returns to the step S2602. If it is determined in the step S2603 that the inlet sensor 531 is ON, then the program starts a sort sheet sequence in a step S2604.

In the sort sheet sequence of the step S2604, multitask processing is carried out by the CPU 511 of the CPU circuitry 510 to control start and stop of the buffer motor M2 and to control acceleration and deceleration of the sheet discharging motor M3. The multitask processing adjusts an interval between a sheet to be conveyed to the processing tray 630 and its following sheet, and also aligns a sheet by an aligning member (not shown) provided in the tray 630 each time a sheet is accommodated in the processing tray 630. When stacking of a bundle of sheets in the processing tray 630 is completed, the bundle is discharged onto the stack tray 700.

After carrying out the processing of the step S2604, the program stands by in a step S2605 until the inlet sensor 531 turns OFF, and returns to the step S2602 as soon as the inlet sensor 531 turns OFF.

If it is determined in the step S2602 that the finisher start signal is OFF, then it is checked in a step S2606 whether or not all sheets of a bundle to be bundle-discharged in the step S2604 have been discharged onto the stack tray 700.

If the program determines in the step S2606 that all of the sheets of the bundle to be bundle-discharged have not been discharged onto the sample tray 701, then the program returns to the step S2602. If the program determines that all of the sheets of the bundle to be bundle-discharged have been discharged onto the sample tray 701, then the program stops the drive of the switching flapper 5110 in a step S2607 before terminating the processing. After completion of the processing, the program proceeds to the step S2312 shown in FIG. 23.

Figure 27:
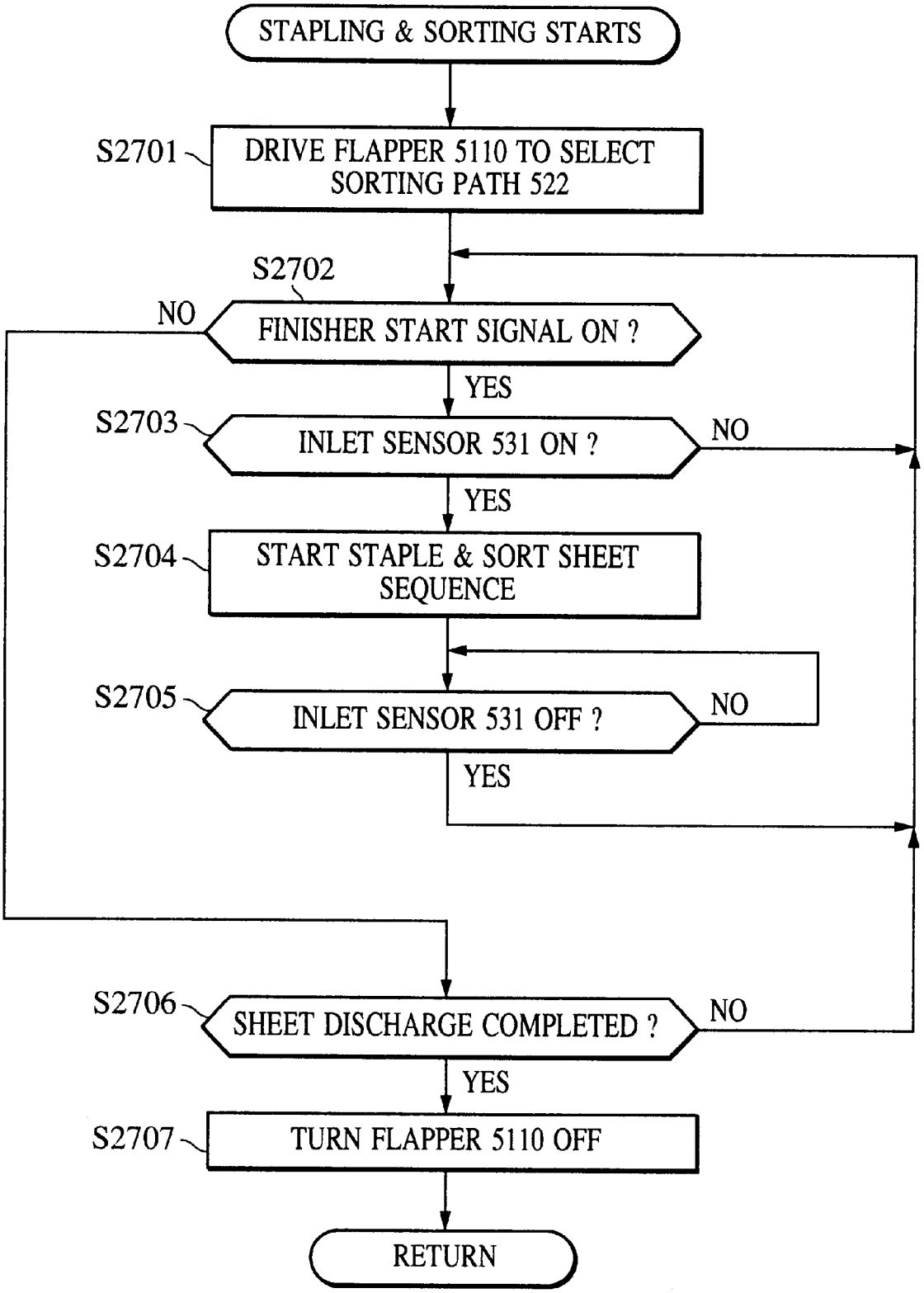
FIG. 27 shows a flowchart that illustrates a stapling and sorting process.

Referring now to the flowchart of FIG. 27, the stapling and sorting process in the step S2311 of FIG. 23 will be described. This processing is performed when it is determined in the step S2308 of FIG. 23 that the operation mode is the stapling and sorting mode.

In the stapling and sorting process, the switching flapper 5110 is first driven to convey a sheet onto the processing tray 630 (see FIG. 5), and the switching flapper 5110 is changed over to the sorting path 522 in a step S2701. At this time, the switching flapper 551 has been changed over to the finisher path 552.

Then, it is determined in a step S2702 whether the finisher start signal for the finisher 500 is ON or not. The processing of the step S2702 is performed to check whether or not a sheet is conveyed from the printer 300 to the finisher 500. If it is determined in the step S2702 that the finisher start signal is ON, then it is checked in a step S2703 whether the inlet sensor 531 is ON or not.

In the step S2703, it is detected whether or not a sheet has been conveyed from the printer 300 into the finisher 500. When the leading edge of the sheet conveyed from the printer 300 reaches a position where the inlet sensor 531 is disposed, the sensor 531 turns ON. The inlet sensor 531 stays ON until the sheet completely passes the sensor 531, that is, until the trailing edge of the sheet leaves the sensor 531.

If it is determined in the step S2703 that the inlet sensor 531 is not ON, then the program returns to the step S2702. If it is determined in the step S2703 that the inlet sensor 531 is ON, then the program starts a staple and sort sheet sequence in a step S2704.

In the staple and sort sheet sequence of the step S2704, multitask processing is carried out by the CPU 511 of the CPU circuitry 510 to control start and stop of the buffer motor M2 and to control acceleration and deceleration of the sheet discharging motor M3. The multitask processing adjusts an interval between a sheet to be conveyed to the processing tray 630 and its following sheet, and also aligns a sheet by an aligning member (not shown) provided in the tray 630 each time a sheet is accommodated in the processing tray 630. When stacking of a bundle of sheets in the processing tray 630 is completed, the bundle of sheets is stapled by the stapler 601 and bundle-discharged to the stack tray 700.

After carrying out the processing of the step S2704, the program stands by until the inlet sensor 531 turns OFF (step S2705), and returns to the step S2702 as soon as the inlet sensor 531 turns OFF.

If it is determined in the step S2702 that the finisher start signal is OFF, then it is checked in a step S2706 whether or not all sheets of a bundle to be bundle-discharged in the step S2704 have been discharged onto the stack tray 700.

If the program determines in the step S2706 that all sheets of the bundle to be bundle-discharged have not been discharged onto the sample tray 701, then the program returns to the step S2702. If the program determines that all sheets of the bundle to be bundle-discharged have been discharged onto the sample tray 701, then the program stops the drive of the switching flapper 5110 in a step S2707 before terminating the processing. After completion of the processing, the program proceeds to the step S2312 shown in FIG. 23.

Figure 28:
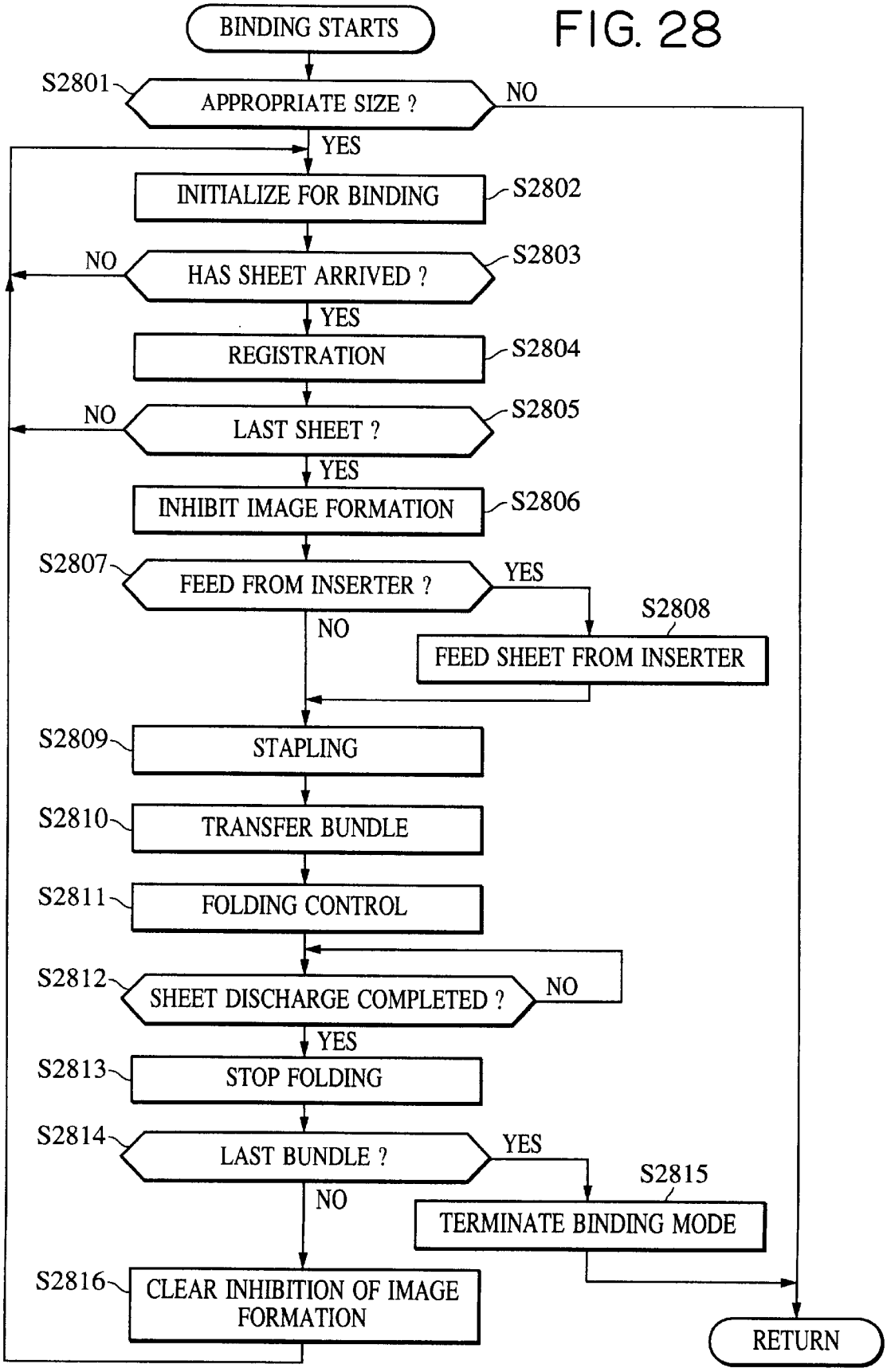
FIG. 28 shows a flowchart that illustrates the bookbinding process.

Referring now to the flowchart of FIG. 28, the bookbinding process in the step S2307 of FIG. 23 will be described. This processing is performed when it is determined in the step S2306 of FIG. 23 that the operation mode is the bookbinding mode.

In the bookbinding process, it is first determined, based on information regarding size, whether or not a size of a sheet to be conveyed from the printer 300 to the finisher 500 is an appropriate size for bookbinding (step S2801). If it is determined in the step S2801 that the size of the sheet is not appropriate for the bookbinding, then the program terminates the processing and returns to the step S2301 of FIG. 23.

If it is determined in the step S2801 that the size of the sheet is appropriate for bookbinding, then initialization for bookbinding is carried out in a step S2802. In the initialization for the bookbinding of the step S2802, the conveying motor M10 is driven to rotate the pair of bookbinding rollers 813 so as to be ready for conveying sheets. At the same time, the switching solenoid SL10 is driven to change the switching flapper 551 over to the first bookbinding path 553 to thereby guide sheets from the printer 300 to the accommodating guide 820. A width adjusting member (not shown) is set to a width that provides a predetermined allowance with respect to a sheet width, and the positioning motor M11 is revolved for a predetermined number of steps so that a distance from the sheet positioning member 823 to stapling positions of the staplers 818 is half a length in a sheet conveying direction.

Subsequently, based on a signal from the bookbinding inlet sensor 817, the program determines in a step S2803 whether a sheet has been conveyed from the printer 300 into the accommodating guide 820. If no sheet has been conveyed into the accommodating guide 820, then the program returns to the step S2802.

If the program determines in the step S2803 that a sheet from the printer 300 has been conveyed into the accommodating guide 820, then it causes the width adjusting member (not shown) to operate after a predetermined time elapses so as to perform alignment in a width direction on the sheet accommodated in the accommodating guide 820 (a step S2804).

Then, the program determines whether a sheet processed in the step S2804 is the last sheet of the sheets to be bound into one bundle (a step S2805), and if the sheet is not the last sheet, then the program returns to the step S2802. If the program determines in the step S2805 that the sheet is the last sheet, then the program causes an image formation inhibiting signal to be issued to the CPU circuitry 150 so as to prevent conveyance of sheets from the printer 300 to the finisher 500 (a step S2806).

In the following step, the program determines in a step S2807 whether sheet feed from the inserter 900 has been specified by a user through the screen of the operation unit 1 shown in FIG. 7B. If it is determined that the sheet feed from the inserter 900 has been specified, then inserter sheet feed is performed in a step S2808. The inserter sheet feed of the step S2808 will be discussed hereinafter in conjunction with the flowchart of FIG. 29.

If it is determined in the step S2807 that the sheet feed from the inserter 900 has not been designated, then the bundle of sheets aligned in the accommodating guide 820 is stapled using the staplers 818 in a step S2809.

After the processing of the step S2809 is carried out, bundle conveyance is performed in a step S2810. In the bundle conveyance of the step S2810, the positioning motor M1 is driven to lower the sheet positioning member 823 and the conveying motor M10 is driven again to rotate the pair of conveying rollers 813 in order to transfer the bundle of sheets by a distance equivalent to a distance between the stapling position of the staplers 818 and the nipping position of the pair of folding rollers 826.

Following the processing of the step S2810, folding control is conducted in a step S2811. In the folding control of step S2811, the clutch CL1 is driven and the folding motor M12 is driven to move the thrust member 825 toward the pair of folding rollers 826 in a direction of an arrow shown in FIG. 22A.

By the folding control, a center of the bundle of sheets, i.e. a stapling position on the sheets, is guided to the nipping position of the pair of folding rollers 826, and the bundle of sheets is folded by the pair of folding rollers 826. The thrust member 825 is constructed so that they can be reciprocated by a cam device. When a sensor (not shown) detects that the thrust member 825 has reciprocated once, the drive of the clutch CL1 is stopped.

After the processing of the step S2811 is performed, the program determines in a step S2812 whether or not the folded bundle of sheets has been discharged to the discharge tray 832 based on a detection signal from the bookbinding sheet discharge sensor 830. The bookbinding sheet discharge sensor 830 detects a trailing edge of the folded sheets. Step S2812 is repeated until it is determined that the bundle of sheets has been discharged to the discharge tray 832.

If it is determined in the step S2812 that the bundle of sheets has been discharged to the discharge tray 832, then the drive of the folding motor M12 is stopped in a step S2813, and it is determined in a step S2814 whether the bundle of sheets is a last bundle of sheets to be subjected to bookbinding.

If it is determined in the step S2814 that the bundle of sheets is the last bundle of sheets to be subjected to bookbinding, then termination processing of the bookbinding mode is carried out in a step S2815. In the termination processing of the bookbinding mode carried out in the step S2815, the width adjusting member and the sheet positioning member 823 are moved back to predetermined standby positions, and the switching flapper 551 is changed over to the finisher path 552 before terminating the bookbinding mode. After performing the processing of the step S2815, the program returns to the step S2301 of the flowchart shown in FIG. 23.

If it is determined in the step S2814 that the bundle of sheets is not the last bundle of sheets to be subjected to bookbinding, then the program clears the image formation inhibiting signal and informs the CPU circuitry 150 to that effect in a step S2816, and returns to the step S2802.

Figure 29:
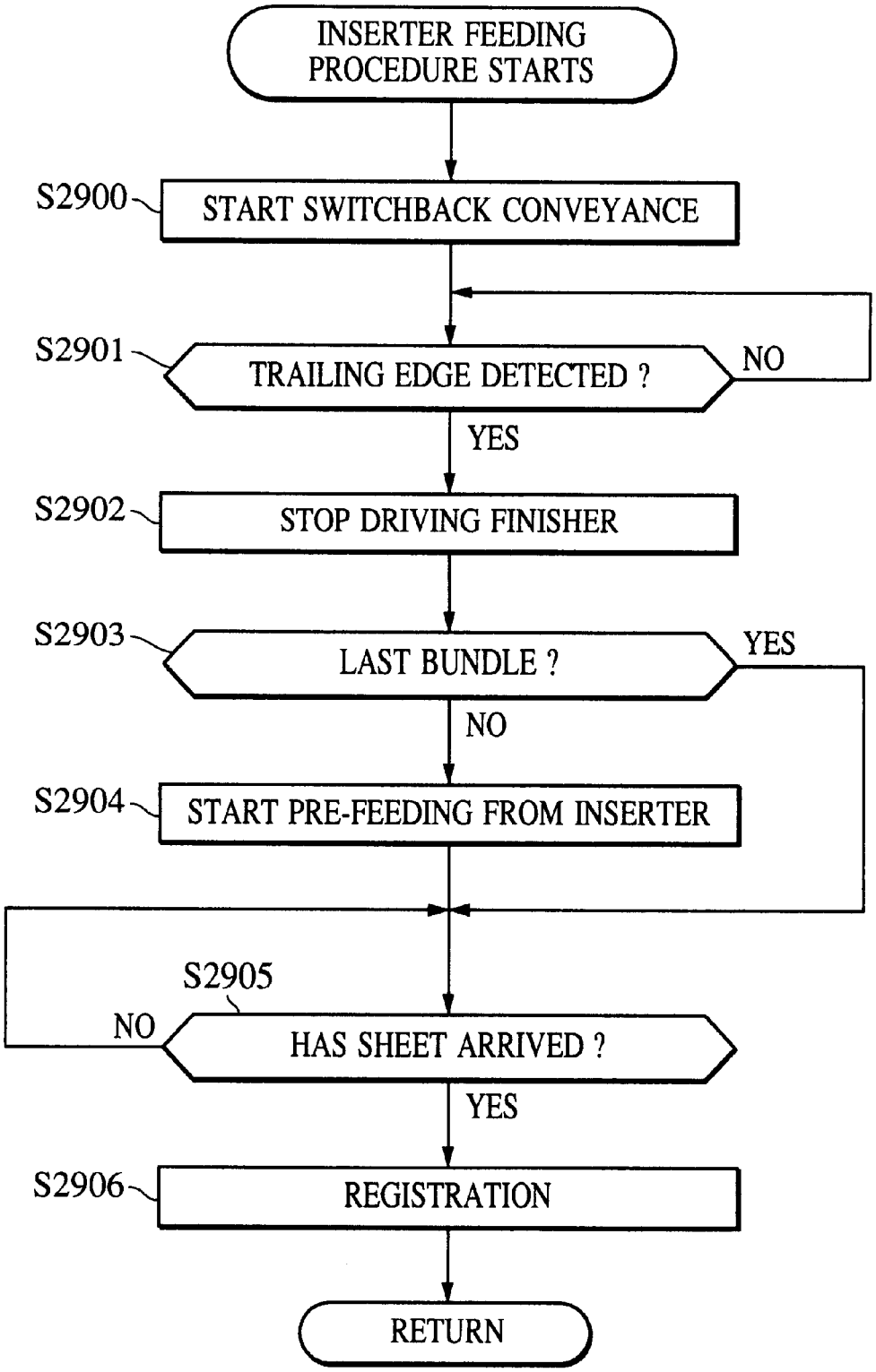
FIG. 29 shows a flowchart that illustrates an inserter sheet feeding process.

Sheet feed from the inserter 900 implemented in the step S2808 of FIG. 28 will now be described in conjunction with the flowchart of FIG. 29. This processing is performed if it is determined in the step S2807 of FIG. 28 that sheet feed from the inserter 900 has been specified. The processing is for guiding sheets from the inserter 900 to the accommodating guide 820.

In this embodiment, prior to the sheet feed from the inserter 900, the pre-feeding from the inserter shown in FIG. 24 is implemented. The sheet C1 from the inserter 900 is already waiting in the non-sorting path 521 as shown in FIG. 17 because of the pre-binding sheet feed of the step S2411 of the pre-feeding from the inserter shown in FIG. 24.

In the sheet feed from the inserter 900, switchback conveyance of the sheet from the inserter 900 that is waiting in the non-sorting path 521 is begun in step S2900. In the switchback conveyance of the step S2900, rotational directions of the inlet motor M1 and the buffer motor M2 are set to reverse directions, then the drive of these motors is started in order to lead the sheet C1 from the inserter 900, which is waiting in the non-sorting path 521, to the second bookbinding path 554 as shown in FIG. 19. At the same time, the drive of the conveying motor M1O is begun.

Subsequently, it is determined in a step S2901 whether or not the trailing edge of the sheet C1 from the inserter 900 that is to be conveyed from the non-sorting path 521 to the second bookbinding path 554 has been detected by the inlet sensor 531. The step S2901 is repeated until the trailing edge of the sheet C1 is detected by the inlet sensor 531.

If the trailing edge of the sheet C1 from the inserter 900 is detected by the inlet sensor 531 in the step S2901, then processing for stopping the drive of the finisher is performed in a step S2902. In the processing for stopping the drive of the finisher in the step S2902, the drive of the inlet motor M1 and the buffer motor M2 is stopped. In other words, the conveyance of the sheet C1 is continued until the trailing edge of the sheet C1 from the inserter 900 is detected in the step S2901.

Next, it is determined in step S2903 whether or not a bundle of sheets under processing is the last bundle of sheets to be subjected to bookbinding, and if a determination result is negative, then a start command for starting the pre-feeding from the inserter 900 is issued in a step S2904. When the start command is issued, the pre-feeding from the inserter is carried out in parallel to the bookbinding.

Subsequently, based on a detection signal received from the bookbinding inlet sensor 817, it is determined in a step S2905 whether or not the sheet C1 from the inserter 900 has been carried into the accommodating guide 820. The step S2905 is repeated until the sheet C1 from the inserter 900 is carried into the accommodating guide 820. The bookbinding inlet sensor 817 detects the trailing edge of a sheet. If it is determined in the step S2903 that the bundle of sheets under processing is the last bundle of sheets to be subjected to bookbinding, then the program proceeds to a step S2905.

If it is determined in the step S2905 that the sheet C1 from the inserter 900 has been carried into the accommodating guide 820, then the width adjusting member (not shown) is actuated after elapse of a predetermined time so as to perform alignment in a widthwise direction on the sheet accommodated in the accommodating guide 820 (a step S2906). Then, the program terminates the processing and proceeds to the step S2809 of FIG. 28.

Referring now to a flowchart shown in FIG. 30, processing in the punching mode will be described. This processing is carried out under constant monitoring by the CPU circuitry 510 in the finisher control unit 501 according to instructions received from the CPU circuitry 150 of the main unit.

First, an instruction for starting operation of the finisher 500 is supplied from the CPU circuitry 150 to the CPU circuitry 510 in the finisher control unit 501, and it is checked whether the finisher start signal is ON or not in step S3001. The processing of the step S3001 is repeated until the finisher start signal turns to ON.

If it is determined in the step S3001 that the finisher start signal is ON, then it is determined in a step S3002 whether the punching mode flag is ON in the processing of the step S2314 shown in FIG. 23. If the punching mode flag is not ON, then the program returns to the step S3001. If the punching mode flag is ON, then the program determines in a step S3003 whether the inlet sensor 531 is ON or not, i.e., whether or not the leading edge of a sheet has reached the inlet sensor 531.

If it is determined in the step S3003 that the inlet sensor 531 is ON, then the program waits in a step S3004 until the trailing edge of the sheet leaves the sensor 531, that is, until the inlet sensor 531 turns OFF. When the inlet sensor 531 turns OFF and a predetermined time elapses, the program actuates the punching motor M30 to rotate the punching roller in the punching unit 550 in a step S3005. When the program determines in a step S3006 that the punching roller has rotated once, the program stops the drive of the punching motor M30 in a step S3007, and returns to the step S3003.

If the program determines in the step S3003 that the inlet sensor 531 is not ON, then it determines in a step S3008 whether or not the punching mode flag is OFF. If the program determines that the punching mode flag is not OFF, then the program returns to the step S3003. If the program determines that the punching mode flag is OFF, then the program waits in a step S3009 until the finisher start signal switches to OFF, and returns to the step S3001 as soon as the finisher start signal switches to OFF.

Referring now to a flowchart shown in FIG. 31, the skew detection of the step S2413 in FIG. 24 mentioned above will be described in detail. This processing follows the processing of the step S2402 of FIG. 24, and implemented by the CPU circuitry 510 of the finisher control unit 501.

First, the program determines in a step S3101 whether or not the skew sensor 930 has turned ON. If the program determines that the sensor 930 has not turned ON, then the program determines in a step S3102 whether or not the sensor 931 has turned ON. If the program determines that the sensor 931 has not turned ON, then the program returns to the step S3101 again. The processing of the step S3101 and the step S3102 is repeated until either the sensor 930 or the sensor 931 turns ON, that is, until the leading edge of the sheet reaches the sensor 930 or 931. The sensor 930 and the sensor 931 are provided at different positions on the same line orthogonal to a direction in which sheets are conveyed as previously mentioned. Hence, if a sheet is fed in a skew state from the tray 901 of the inserter 900, the leading edge of the sheet reaches either of the sensors first.

If the sensor 930 turns ON earlier than the sensor 931, then the program proceeds to a step S3103. In the step S3103, the program clears SKEW_CN, which corresponds to a skew detection counter, to zero. In a step S3104, the program sets skew_detectf_g, which corresponds to a flag indicating "under skew detection, " to ON. Thereafter, the program waits in a step S3105 until the sensor 931 turns ON.

If the sensor 931 turns ON earlier than the sensor 930, then the program proceeds to a step S3106. In the step S3106, the program clears SKEW_CN, which corresponds to the skew detection counter, to zero. In a step S3107, the program sets skew_detectf_g, which corresponds to the flag indicating "under skew detection," to ON. Thereafter, the program waits in a step S3108 until the sensor 930 turns ON.

If the program determines in the step S3105 that the sensor 931 has turned ON, or determines in the step S3108 that the sensor 930 has turned ON, then the program sets skew_detectf_g (the "under skew detection" flag) to OFF in a step S3109, then checks in a step S3110 a count value of SKEW_CN (the skew detection counter) obtained from counting started at the moment skew_detectf_g (the "under skew detection" flag) was set to ON and stopped at the moment skew_detectf_g was set to OFF. The processing described above is performed to detect a skew amount of a sheet. Thus, according to this embodiment, an amount of skew of a sheet with respect to the sheet feeding direction is calculated based on a value of SKEW_CN (the skew detection counter) obtained by counting from the moment the sensor 930 detects a sheet to the moment the sensor 931 detects the sheet.

If the value of SKEW_CN (the skew detection counter) checked in the step S3110 is SKEW_REF1, which corresponds to a skew reference value 1, or less (SKEW_CN≦SKEW_REF1), then the program terminates the processing and proceeds to the step S2403 of FIG. 24.

If the value of SKEW_CN (the skew detection counter) checked in the step S3110 exceeds SKEW_REF2, which corresponds to a skew reference value 2 (SKEW_REF2<SKEW_CN), then the program sets an inserter skew jam, stops all loads (e.g. the motors M1 through M4, the motors M10 through M12, the feeding motor M20, the punching motor M30, the clutches CL1 and CL10, and the solenoids SL1, SL2, SL10, SL20, and SL21), and also urges the CPU circuitry 150 of the copying apparatus main unit to perform an emergency stop (a step S3111). Upon receipt of information from the finisher control unit 501, the CPU circuitry 150 of the main unit causes the information to be displayed on the display panel of the operation unit 1 to notify the user, and also stops conveyance of sheets with images formed thereon to prevent the sheets from being fed into the finisher 500.

Stopping all loads automatically inhibits the feeding of sheets from the inserter 900, the conveyance of sheets into the finisher 500, punching sheets by the punching unit 550, stapling by the stapler 601, and all other processing. Thus, the operations in the finisher 500 described above are all inhibited until a jammed sheet is removed by a user. When the sheet has been removed by the user, the program clears the inhibition of the operations in the finisher 500, and informs the CPU circuitry 150 of the main unit that the inhibition has been cleared. Upon receipt of the information from the finisher control unit 501, the CPU circuitry 150 of the main unit causes the information to be displayed on the display panel of the operation unit 1 to notify the user.

If the value of SKEW_CN (the skew detection counter) checked in the step S3110 exceeds SKEW_REF1, which corresponds to the skew reference value 1, but not more than SKEW_REF2, which corresponds to the skew reference value 2 (i.e., if SKEW_REF1<SKEW_CN≦SKEW_REF2), then the program determines in step S3112 whether or not the punching mode has been set by the user on the post processing menu screen of the operation unit 1 shown in FIG. 7A. If the program decides that the punching mode has not been set, then the program immediately terminates the processing and proceeds to the step S2403 of FIG. 24.

If the program decides in the step S3112 that the punching mode has been set, then the program sets the inserter skew jam as in the step S3111, stops all loads (e.g. the motors M1 through M4, the motors M10 through M12, the feeding motor M20, the punching motor M30, the clutches CL1 and CL10, and the solenoids SL1, SL2, SL10, SL20, and SL21), and also urges the CPU circuitry 150 of the copying apparatus main unit to perform an emergency stop (a step S3113). Upon receipt of information from the finisher control unit 501, the CPU circuitry 150 of the main unit causes the information to be displayed on the display panel of the operation unit 1 to notify the user, and also stops conveyance of sheets with images formed thereon to prevent the sheets from being fed into the finisher 500.

Stopping all loads automatically inhibits the feeding of sheets from the inserter 900, the conveyance of sheets into the finisher 500, punching sheets by the punching unit 550, stapling by the stapler 601, and all other processing. Thus, the operations in the finisher 500 described above are all inhibited until a jammed sheet is removed by a user. When the sheet has been removed by the user, the program clears the inhibition of the operations in the finisher 500, and informs the CPU circuitry 150 of the main unit that the inhibition has been cleared. Upon receipt of the information from the finisher control unit 501, the CPU circuitry 150 of the main unit causes the information to be displayed on the display panel of the operation unit 1 to notify the user.

Regarding the processing of the step S3112, in the case of, for example, SKEW_REF1<SKEW_CN≦SKEW_REF2 and if the operation mode set by the user is a mode other than the punching mode (e.g. the stapling and sorting mode, the sorting mode, or the bookbinding mode as shown in FIG. 7A), then the conveyance of sheets is continued instead of stopping all loads.

The reason is as described below. Referring to FIG. 5, when stapling is carried out, for example, sheets are aligned on the processing tray 630 prior to the stapling, or the sheets are also aligned in the accommodating guide 820 prior to the stapling when bookbinding is implemented. If a detected skew amount is SKEW_REF2, which corresponds to the skew reference value 2, or less, then the skew of a sheet can be corrected before final processing is performed. In other words, when processing, such as stapling and sorting, sorting, or bookbinding, other than punching is carried out, there is no risk of damaging quality of alignment of sheets in final bundling.

The punching process is performed while sheets are being conveyed on a sheet conveying path to improve productivity and save cost, and the alignment as described above is not performed during the punching process. For this reason, according to this embodiment, more strict detection of a skew jam is carried out in the punching process than in other processing. The value of SKEW_REF2, which corresponds to the skew reference value 2, takes into account a danger in that a paper jam may occur during conveyance of sheets, and if this value is exceeded, all loads are stopped.

Performing emergency stop processing permits sheet conveyance to be interrupted before an actual paper jam takes place, minimizing a chance of damage to quality of a sheet. This means that the jammed sheet can be removed from the finisher 500 by the user and reset on the tray 901 of the inserter, so that the sheet can be reused by issuing an instruction for resuming the processing from the operation unit 1. This arrangement makes it possible to prevent such an inconvenience that a sheet is torn or stained due to a paper jam and the user has to prepare another sheet of the same type.

Thus, in this embodiment, a skew amount of a sheet from the inserter 900 is detected by the sensor 930 and the sensor 931, and control is selected based on the detected skew amount of the sheet and also on whether or not punching is involved. For instance, when the skew reference value 1 is set to 3 mm and the skew reference value 2 is set to 9 mm, and if a skew amount of a sheet from the inserter 900 that is detected by the sensor 930 and the sensor 931 exceeds 9 mm, then there is a likelihood of a sheet jam; hence, an emergency stop is performed and processing, such as feeding and conveying or punching of sheets, is inhibited. If the detected skew amount of the sheet is 3 mm or less, then no emergency stop is effected, and processing, such as feeding and conveying or punching of sheets, is enabled.

Furthermore, if, for example, a detected sheet skew amount exceeds 3 mm and is 9 mm or less, and the punching mode has been set by a user beforehand, then there is a likelihood of a failure in punching at a desired position. Hence, an emergency stop is performed, and feeding and conveying of sheets, punching, or other type of processing is inhibited. This arrangement protects a user from spending extra time and efforts for preparing the same type of sheet again due to a failure of punching at a desired position. If a detected sheet skew amount exceeds 3 mm and is 9 mm or less, and punching has not been selected by the user, then there is no danger of disturbing alignment of sheets. Hence, control is conducted to continue conveyance of sheets without performing an emergency stop, thus improving productivity.

In the case of the above example where the sheet skew amount is 9 mm or less, even if the sheet is being processed in the punching mode, such a skew amount does not lead to a paper jam or other type of sheet conveyance failure. Therefore, control may be conducted so that conveyance of a sheet may be continued and directly discharged to the tray 701 or 700 without stopping all loads, while inhibiting, for example, the punching process. Alternatively, the control may be carried out to stop all loads after discharging the sheet to the tray 701 or 700. In either case, the fact that the processing set by the user has not been implemented is notified at least to the user.

In this embodiment, the descriptions have been given mainly of the example where a sheet from the inserter 900 skews. Obviously, however, skew of a sheet from the copying apparatus main unit can be also coped with. In this case, skew of a sheet is detected by a plurality of sensors (not shown) which are equivalent to the skew sensors 930 and 931 and installed at predetermined positions on a sheet conveying path. Based on sheet detection results supplied by these sensors (not shown), a skew amount of the sheet from the copying apparatus main unit is determined, and processing similar to the one described primarily in conjunction with FIG. 30 and FIG. 31 may be implemented. As another alternative for achieving reduced cost, the plural sensors (not shown) mentioned above may be employed to make it possible to calculate skew amounts of sheets from both the copying apparatus and the inserter 900, thus obviating the need for the skew sensors 930 and 931.

Figure 30:
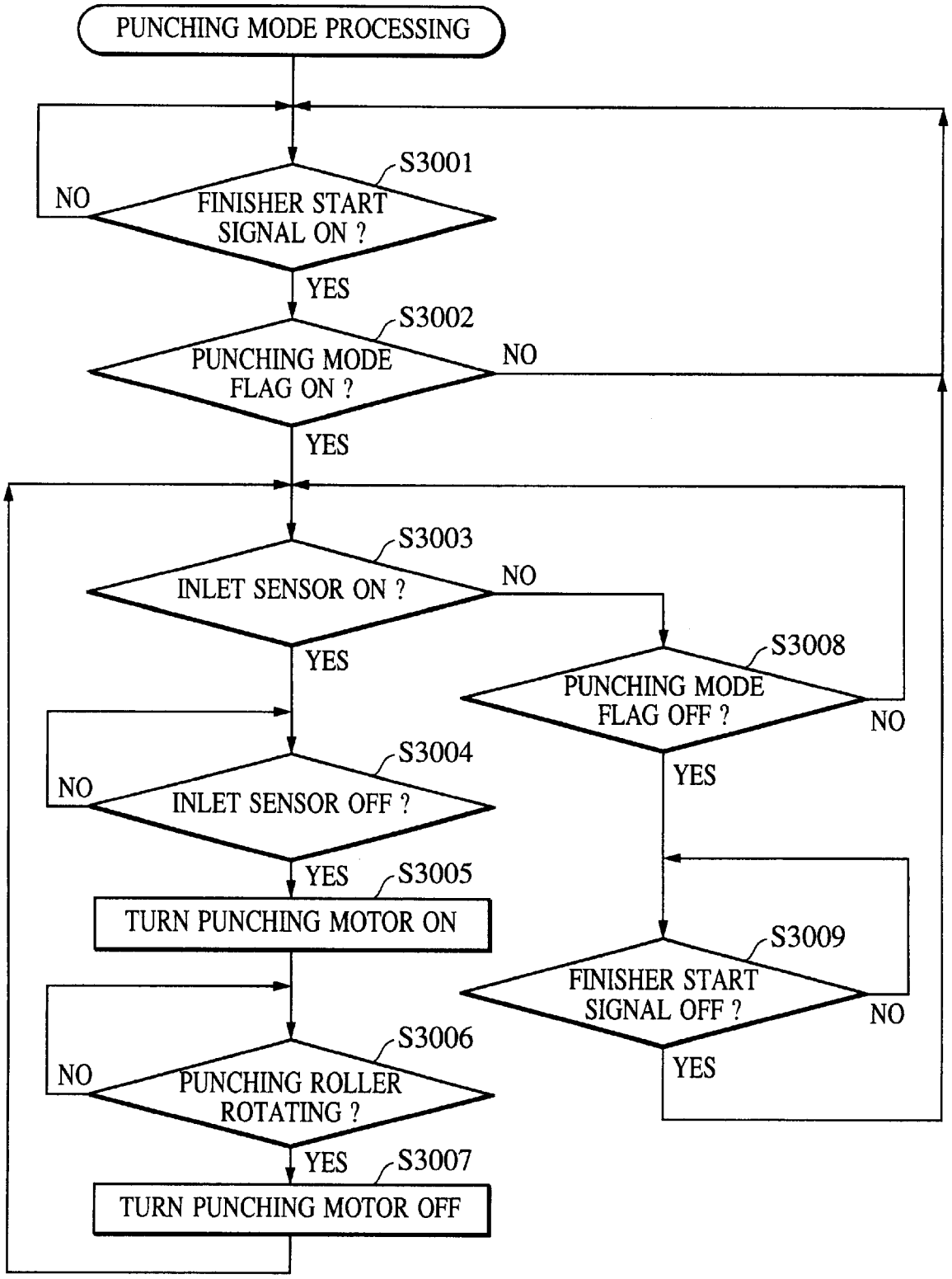
FIG. 30 shows a flowchart that illustrates a punching process.
Figure 31:
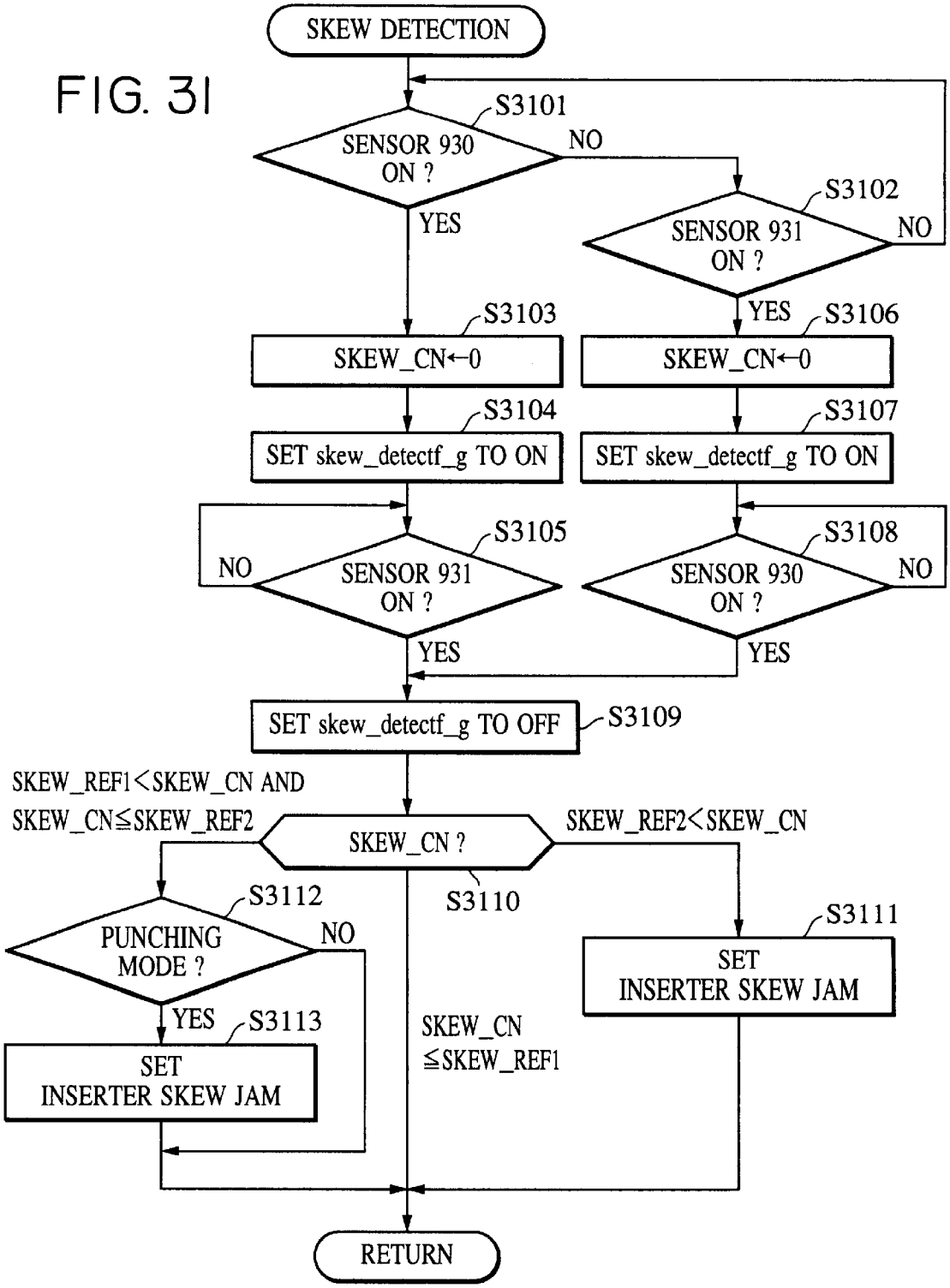
FIG. 31 shows a flowchart that illustrates a skew detection process.

The program for implementing the processing or the function described in conjunction with FIG. 30 and FIG. 31 may be stored as a program code in the ROM 512 of the finisher control unit 501, and the CPU 511 of the finisher control unit reads the code to implement the function. Alternatively, the program may be stored in the ROM 151 of the CPU circuitry 150 of the copying apparatus main unit, and a CPU (not shown) of the CPU circuitry 150 reads the program to implement the function.

Thus, according to the embodiment, even if a sheet from a copying apparatus main unit or a sheet from the inserter 900 is conveyed in a skew state, the occurrence of a paper jam in the apparatus while the sheet is being conveyed can be prevented, as well as preventing the sheet from being damaged or stained, ruining the quality of the sheet. Moreover, a failure to performing predetermined processing, such as binding, punching, or folding, at a predetermined position on a sheet can be also prevented. This saves a user from spending extra time and efforts for preparing the same type of sheet again, and also prevents an increase in cost.

It is very likely that a sheet supplied from the inserter 900 is a special sheet with a high added value (e.g. a sheet on which a photographic image has been formed, a cover sheet of a brochure, a glossy sheet, or a colored sheet) or a sheet, such as a color output sheet, that cannot be prepared by a currently used copying machine, including a monochrome copying machine. The advantages described above, therefore, are all the more useful.

In addition, the construction of the embodiment is especially advantageous in processing, such as the punching process in the embodiment, wherein the processing is carried out on a sheet without performing alignment of sheets.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A sheet processing apparatus comprising:

a first stacking tray connectable to an image forming apparatus and on which sheets are stacked;

a conveyor for conveying a sheet loaded on said first stacking tray and a sheet on which an image has been formed by said image forming apparatus; and a second stacking tray for stacking the sheets conveyed from said first stacking tray and the sheet on which an image has been formed by said image forming apparatus;

wherein sheet processing is performed on the sheet conveyed by said conveyor from said first stacking tray, according to an operation mode of said image forming apparatus, said sheet processing apparatus comprising:

detecting means for detecting a skew amount of a sheet conveyed from said first stacking tray;

determining means for determining whether to perform sheet processing by said sheet processing apparatus; and control means for controlling conveyance of the sheet by said conveyor based on a skew amount of the sheet detected by said detecting means and a determination result of said determining means, wherein said control means inhibits conveyance of a sheet by said conveyor if a detected skew amount of a sheet detected exceeds a first predetermined skew amount and said determining means determines to perform said sheet processing, and permits conveyance of a sheet by said conveyor if the detected skew amount of the sheet exceeds the first predetermined skew amount and said determining means determines not to perform said sheet processing.

2. A sheet processing apparatus according to claim 1, wherein said control means inhibits conveyance of a sheet by said conveyor if a skew amount of a sheet detected by said detecting means exceeds a second predetermined skew amount, which is larger than the first predetermined skew amount, and permits conveyance of the sheet by said conveyor if the skew amount of the sheet detected by said detecting means is not more than the first predetermined skew amount.

3. A sheet processing apparatus according to claim 1, wherein said control means informs said image forming apparatus whenever it inhibits conveyance of a sheet by said conveyor.

4. A sheet processing apparatus according to claim 1, wherein the sheet processing performed is punching.

5. A control method for a sheet processing apparatus comprising a first stacking tray connectable to an image forming apparatus and on which sheets are stacked, a conveyor for conveying a sheet loaded on said first stacking tray and a sheet on which an image has been formed by said image forming apparatus, wherein sheet processing is performed on the sheet conveyed by said conveyor from said first stacking tray, according to an operation mode of said image forming apparatus, said control method comprising the steps of:

detecting a skew amount of a sheet conveyed from said first stacking tray;

determining whether to perform sheet processing by said sheet processing apparatus; and controlling conveyance of the sheet by said conveyor based on a skew amount of the sheet detected in said detecting step and a determination result of said determining step, wherein said control method inhibits conveyance of a sheet by said conveyor if a detected skew amount of a sheet exceeds a first predetermined skew amount and said determining step determines to perform said sheet processing, and permits conveyance of a sheet by said conveyor if the detected skew amount of the sheet exceeds the first predetermined skew amount and said determining step determines not to perform said sheet processing.

6. An image forming apparatus comprising:

image forming means for forming an image on a sheet based on input data;

a first stacking tray on which a sheet is loaded;

conveyor for conveying the sheet loaded on said first stacking tray and a sheet on which an image has been formed by said image forming means;

a second stacking tray for stacking the sheets conveyed from said first stacking tray and the sheet on which an image has been formed by said image forming means, wherein sheet processing is performed on the sheet conveyed by said conveyor from said first stacking tray, according to an operation mode of said image forming apparatus, said image forming apparatus comprising:

detecting means for detecting a skew amount of the sheet conveyed from said first stacking tray;

determining means for determining whether to perform sheet processing by said image forming apparatus; and control means for controlling conveyance of the sheet by said conveyor based on a skew amount of the sheet detected by said detecting means and a determination result of said determining means, wherein said control means inhibits conveyance of a sheet by said conveyor if a skew amount of a sheet detected by said detecting means exceeds a first predetermined skew amount and said determining means determines to perform said sheet processing, and permits conveyance of a sheet by said conveyor if the skew amount of the sheet detected by said detecting means exceeds the first predetermined skew amount and said determining means determines not to perform said sheet processing.

7. A sheet processing apparatus for implementing sheet processing to a sheet, comprising:

conveyor for conveying a sheet for processing; and control means for inhibiting operation of said conveyor based on a skew amount of the sheet conveyed by said conveyor, wherein said control means permits the operation of said conveyor if the skew amount of the sheet conveyed by said conveyor is a skew amount lower than an amount that will cause sheet conveyance failure; and said control means inhibits the operation of said conveyor if the sheet is a sheet for a job involving sheet processing, and permits the operation of said conveyor if the sheet is a sheet for a job in which sheet processing is not performed when the skew amount of the sheet conveyed by said conveyor is the skew amount lower than the amount that will cause sheet conveyance failure.

8. A sheet processing apparatus according to claim 7, wherein said apparatus selectively performs a plurality of types of sheet processing that are different from one another, and wherein said control means permits the operation of said conveyor, depending on a type of sheet processing to be performed, rather than inhibiting the operation of said conveyor even if the sheet is a sheet for the job involving sheet processing, when the skew amount of the sheet conveyed by said conveyor is the skew amount lower than the amount that will cause sheet conveyance failure.

9. An apparatus according to claim 8, further comprising:

aligning means for aligning a sheet conveyed by said conveyor;

wherein said control means permits the operation of said conveyor if a type of sheet processing to be performed is one that is performed after alignment by said aligning means.

10. An apparatus according to claim 9, wherein said control means inhibits the operation of said conveyor if the type of sheet processing to be performed is one that is performed without the alignment by said aligning means.

11. An apparatus according to claim 10, wherein the sheet processing performed after the alignment by said aligning means includes binding, and the sheet processing performed without performing the alignment by said aligning means includes punching of a sheet.

12. An apparatus according to claim 8, wherein one of said plurality of types of sheet processing is punching of a sheet; and said control means inhibits the operation of said conveyor if the sheet is a sheet for a punching job, and permits the operation of said conveyor if the sheet is a sheet for a job other than a punching job when the skew amount of the sheet conveyed by said conveyor is a skew amount lower than an amount that will cause sheet conveyance failure.

13. A sheet processing apparatus according to claim 7, further comprising:

a stacking tray on which sheets are loaded;

wherein said conveyor conveys the sheet loaded on said stacking tray; and said control means inhibits the operation of said conveyor so as to prevent at least the sheet loaded on said stacking tray from being conveyed.

14. A sheet processing apparatus according to claim 7, wherein said sheet processing apparatus is connectable to an image forming apparatus; and said control means inhibits the operation of said conveyor to prevent conveying of a sheet from said image forming apparatus to said sheet processing apparatus.

15. A sheet processing apparatus according to claim 7, further comprising notifying means for informing an operator in the event that the operation of said conveyor has been inhibited.

16. A control method for a sheet processing apparatus having a conveyor for conveying a sheet and for performing sheet processing to the sheet conveyed by said conveyor, comprising the steps of:

inhibiting an operation of said conveyor based on a skew amount of the sheet conveyed by said conveyor;

permitting the operation of said conveyor if the skew amount of the sheet conveyed by said conveyor is a skew amount lower than the amount that will cause sheet conveyance failure; and inhibiting the operation of said conveyor if the sheet is a sheet for a job involving sheet processing, or permitting the operation of said conveyor if the sheet is a sheet for a job in which sheet processing is not performed when the skew amount of the sheet conveyed by said conveyor is the skew amount lower than the amount that will cause sheet conveyance failure.

17. A computer-readable storage medium storing a program for causing a sheet processing apparatus, which has a conveyor for conveying a sheet and for performing sheet processing to the sheet conveyed by said conveyor to implement the steps of:

inhibiting an operation of said conveyor based on a skew amount of the sheet conveyed by said conveyor;

permitting the operation of said conveyor if the skew amount of the sheet conveyed by said conveyor is a skew amount lower than the amount that will cause sheet conveyance failure; and inhibiting the operation of said conveyor if the sheet is a sheet for a job involving sheet processing, and permitting the operation of said conveyor if the sheet is a sheet for a job in which sheet processing is not performed when the skew amount of the sheet conveyed by said conveyor is the skew amount lower than the amount that will cause sheet conveyance failure.

18. A sheet processing apparatus for performing sheet processing to a sheet, comprising:

a conveyor for conveying a sheet;

aligning means for aligning a sheet conveyed by said conveyor; and control means for inhibiting sheet processing on the sheet based on a skew amount of the sheet conveyed by said conveyor;

wherein said control means permits implementation of sheet processing to the sheet if the skew amount of the sheet conveyed by said conveyor is a skew amount lower than the amount that will cause sheet conveyance failure and if the sheet is a sheet for a job involving sheet processing performed after the alignment by said aligning means is performed, or inhibits implementation of the sheet processing on the sheet if the skew amount of the sheet conveyed by said conveyor is a skew amount lower than the amount that will cause sheet conveyance failure and if the sheet is a sheet for a job involving sheet processing performed without implementing the alignment by said aligning means.

19. A control method for a sheet processing apparatus which has conveyor for conveying a sheet, aligning means for aligning a sheet conveyed by said conveyor, and processing means for performing sheet processing on the sheet, comprising the steps of:

inhibiting sheet processing on the sheet based on a skew amount of the sheet conveyed by said conveyor;

permitting implementation of the sheet processing on the sheet if the skew amount of the sheet conveyed by said conveyor is a skew amount lower than the amount that will cause sheet conveyance failure and if the sheet is a sheet for a job involving sheet processing performed after the alignment by said aligning means is performed; and inhibiting implementation of the sheet processing on the sheet if the skew amount of the sheet conveyed by said conveyor is a skew amount lower than the amount that will cause sheet conveyance failure and if the sheet is a sheet for a job involving sheet processing performed without implementing the alignment by said aligning means.

20. A computer-readable storage medium storing a program for causing a sheet processing apparatus, which has conveyor for conveying a sheet, aligning means for aligning the sheet conveyed by said conveyor and processing means for performing sheet processing to the sheet conveyed from said conveyor, to implement the steps of:

inhibiting sheet processing on the sheet based on a skew amount of the sheet conveyed by said conveyor;

performing sheet processing on the sheet if the skew amount of the sheet conveyed by said conveyor is a skew amount lower than the amount that will cause sheet conveyance failure and if the sheet is a sheet for a job involving sheet processing performed after the alignment by said aligning means is performed; and inhibiting implementation of sheet processing on the sheet if the skew amount of the sheet conveyed by said conveyor is a skew amount lower than the amount that will cause sheet conveyance failure and if the sheet is a sheet for a job involving sheet processing performed without performing the alignment by said aligning means.

* * * * *

UNITED STATES PATENT AND TRADEMARK OFFICE

CERTIFICATE OF CORRECTION

PATENT NO. : 6,353,726 B1
DATED : March 5, 2002
INVENTOR(S) : Mitsushige Murata et al.

It is certified that error appears in the above-identified patent and that said Letters Patent is hereby corrected as shown below:

Column 2,
Line 40, “FIG. 2 is a diagram” should read -- FIG. 2, consisting of FIGS. 2A and 2B, provides diagrams --.
Line 50, “FIG. 7” should read -- FIG. 7, consisting of FIGS. 7A and 7B,” --.
Line 52, “FIG. 8” should read -- FIG. 8, consisting of FIGS. 8A and 8B, --.

Column 3,
Line 1, “FIG. 13” should read -- FIG. 13, consisting of FIGS. 13A and 13B, --.
Line 4, “FIG. 14” should read -- FIG. 14, consisting of FIGS. 14A and 14C, --.
Line 5, “FIG. 15” should read -- FIG. 15, consisting of FIGS. 15A and 15B, --.
Line 27, “FIG. 22” should read -- FIG. 22, consisting of FIGS. 22A and 22B, --.

Column 6,
Line 49, “output” should read -- outputs --.

Column 16,
Line 53, “P2b” should read -- P2 --.

Column 19,
Line 11, “t his” should read -- this --.

Column 26,
Line 44, “implemented” should read -- is implemented --.

Column 30,
Line 7, “performing” should read -- perform --.

UNITED STATES PATENT AND TRADEMARK OFFICE

CERTIFICATE OF CORRECTION

PATENT NO. : 6,353,726 B1
DATED : March 5, 2002
INVENTOR(S) : Mitsushige Murata et al.

It is certified that error appears in the above-identified patent and that said Letters Patent is hereby corrected as shown below:

Column 34,
Line 17, “conveyor” should read -- a conveyor --.
Line 39, “conveyor” should read -- a conveyor --.

Signed and Sealed this

Second Day of July, 2002

*Attest:*

*Attesting Officer*

JAMES E. ROGAN
*Director of the United States Patent and Trademark Office*